US006586167B2

(12) United States Patent
Katoh et al.

(10) Patent No.: US 6,586,167 B2
(45) **Date of Patent: *Jul. 1, 2003**

(54) METHOD FOR THERMALLY FORMING IMAGE FOR PLATE MAKING AND THERMALLY PROCESSED IMAGE RECORDING MATERIAL FOR PLATE MAKING

(75) Inventors: Kazunobu Katoh, Minami-ashigara (JP); Toyohisa Oya, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/909,853

(22) Filed: Jul. 23, 2001

(65) Prior Publication Data

US 2002/0039708 A1 Apr. 4, 2002

(30) Foreign Application Priority Data

Jul. 21, 2000 (JP) ..... 2000-219982

(51) Int. Cl.[7] ..... G03C 1/06; G03C 5/29; G03C 7/333

(52) U.S. Cl. ..... 430/351; 430/204; 430/218; 430/264; 430/383; 430/391; 430/543; 430/552; 430/553; 430/554; 430/555; 430/556; 430/558; 430/559; 430/620; 430/619

(58) Field of Search ..... 430/351, 383, 430/391, 619, 264, 543, 552, 553, 554, 555, 556, 558, 559, 204, 218

(56) References Cited

U.S. PATENT DOCUMENTS

| | | | | | |
|---|---|---|---|---|---|
| 4,021,240 | A | * | 5/1977 | Cerquone et al. | |
| 5,888,704 | A | * | 3/1999 | Kikuchi | 430/351 |
| 5,939,248 | A | * | 8/1999 | Kirk et al. | 430/619 |
| 6,013,421 | A | * | 1/2000 | Nakamura et al. | 430/351 |
| 6,130,022 | A | * | 10/2000 | Naruse | 430/203 |

OTHER PUBLICATIONS

U.S. Ser. No. 09/809,024, filed Mar. 16, 2001 by Oya, et al.

* cited by examiner

*Primary Examiner*—Thorl Chea
(74) *Attorney, Agent, or Firm*—Sughrue Mion, PLLC

(57) ABSTRACT

A method for thermally forming images for plate making, which comprises forming an image for plate making by using a thermally processed image recording material comprising a silver salt of an organic acid, a reducing agent, a color image forming material and an organic binder on a support, wherein the image consists essentially of a developed silver image and a color forming dye image and the color forming dye image shows an absorbance for ultraviolet region higher than that for visible region and has a transmission density of 0.3 or more for the region of 360–450 nm. There are provided a thermally processed image recording material and method for thermally forming images that provide significant difference of ultraviolet absorption between image areas and non-image areas suitable for printing plate making.

16 Claims, No Drawings

METHOD FOR THERMALLY FORMING IMAGE FOR PLATE MAKING AND THERMALLY PROCESSED IMAGE RECORDING MATERIAL FOR PLATE MAKING

TECHNICAL FIELD

The present invention relates to a method for thermally forming images for plate making and a thermally processed image recording material for plate making. More precisely, the present invention relates to a thermally processed image recording material for plate making that can be used as an intermediate material in printing plate making, further specifically a thermally processed image recording material for plate making that is used for output of an edited original on a film and subsequent printing of formed images on a printing plate such as PS plates, as well as a method for thermally recording images for plate making using the thermally processed image recording material for plate making.

RELATED ART

Methods for forming images utilizing thermally processed image recording materials using silver salts of organic acids are described in, for example, U.S. Pat. Nos. 3,152,904 and 3,457,075 and D. Klosterboer, "Thermally Processed Silver Systems", Imaging Processes and Materials, Neblette, 8th ed., compiled by J. Sturge, V. Walworth and A. Shepp, Chapter 9, p. 279, (1989). Such thermally processed image recording materials comprise a reducible non-photosensitive silver source (e.g., silver salt of an organic acid), a photocatalyst (e.g., silver halide) in a catalytically active amount and a reducing agent for silver, which are usually dispersed in an organic binder matrix. While the photosensitive materials are stable at an ordinary temperature, when they are heated to a high temperature (e.g., 80° C. or higher) after light exposure, silver is produced through an oxidation-reduction reaction between the reducible silver source (which functions as an oxidizing agent) and the reducing agent. The oxidation-reduction reaction is accelerated by catalytic action of a latent image generated upon exposure. The silver produced from the reaction of the reducible silver salt in the exposed areas provides silver images and hence contrast with respect to the non-exposed areas, and thus images are formed.

The aforementioned image recording materials and image forming methods can be used for making printing plates. A method for recording images for printing plate making comprises steps of drawing images with laser lights or the like, developing the images to form silver images, and printing the images on a printing plate with a ultraviolet ray at 350–450 nm using the images as a mask to reproduce the images on the printing plate utilizing the transmission of the UV ray through portions other than the portions where the silver images that shield the UV ray are not formed. Therefore, it is desirable that the image recording material for plate making used for the production of mask should show significant difference of transmission for ultraviolet rays between the image areas and the non-image areas.

A thermally processed image recording material utilizing a silver salt of an organic acid must preliminarily contain all of the materials required for the image formation in its films, and such materials remain in the films as original chemical species or reaction products thereof even after the heat development. It is so far attempted to make the image recording material substantially colorless by devising the substances so that they should not show absorbance for the visible region and thus they should not be obstacles to visual observation of the images. However, in such a purpose for printing plate making, the substances are further desired to show low absorbance for ultraviolet rays. In thermally processed materials, it has been a big technical problem to maintain UV absorbance of non-image areas to be low and increase UV absorbance of image areas, since the materials contain many kinds of substances and organic substances generally show absorbance in the ultraviolet region though the degree may be different.

SUMMARY OF THE INVENTION

An object of the present invention is to solve the aforementioned problems of the prior art. That is, the object to be achieved by the present invention is to provide a thermally processed image recording material and method for thermally forming images that provide significant difference of ultraviolet absorption between image areas and non-image areas suitable for printing plate making.

The inventors of the present invention assiduously studied in order to achieve the aforementioned object. As a result, they found that a superior thermally processed image recording material and method for thermally forming images that provide the desired effect can be obtained by using a reducing agent and a color image forming material in combination in a thermally processed image recording material to form an image consisting of a developed silver image and color forming dye image so that the color forming dye image should show an absorbance for ultraviolet region higher than that for visible region and have a transmission density of 0.3 or more for the region of 360–450 nm. Thus, they accomplished the present invention.

That is, the present invention provides a method for thermally forming images for plate making, which comprises forming an image for plate making by using a thermally processed image recording material comprising a silver salt of an organic acid, a reducing agent, a color image forming material and an organic binder on a support, wherein the image consists essentially of a developed silver image and a color forming dye image and the color forming dye image shows an absorbance for ultraviolet region higher than that for visible region and has a transmission density of 0.3 or more for the region of 360–450 nm.

According to another aspect of the present invention, there is provided a thermally processed image recording material for plate making comprising a silver salt of an organic acid, a reducing agent, a color image forming material and an organic binder on a support, which forms an image consisting of a developed silver image and a color forming dye image, and in which the color forming dye image shows an absorbance for ultraviolet region higher than that for visible region and has a transmission density of 0.3 or more for the region of 360–450 nm.

Preferably, the organic binder is a hydrophobic thermoplastic organic polymer.

Preferably, the organic binder consists of polymer latex dispersed in water.

Preferably, the reducing agent consists of microparticles solid-dispersed in water.

Preferably, the reducing agent consists of a compound represented by the formula $Q^1$—NHNH—$Q^2$ wherein $Q^1$ represents an aromatic group or 5- to 7-membered unsaturated ring bonding to —NHNH—$Q^2$ at a carbon atom, and Q represents a carbamoyl group, an acyl group, an alkoxycarbonyl group, an aryloxycarbonyl group, a sulfonyl group or a sulfamoyl group.

Preferably, a thermally processed image recording material containing a halogen precursor is used.

Preferably, the halogen precursor consists of microparticles solid-dispersed in water.

Preferably, the color image forming material is a compound represented by any one of the following formulas (1) to (18):

(1)

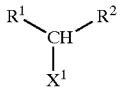

(2)

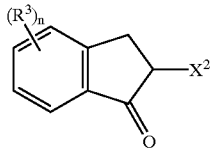

(3)

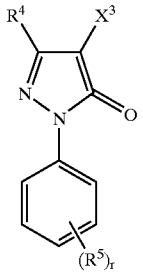

(4)

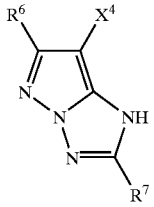

(5)

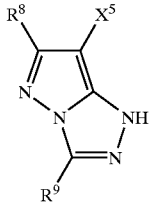

(6)

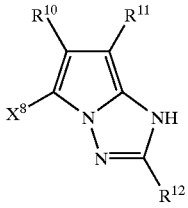

(7)

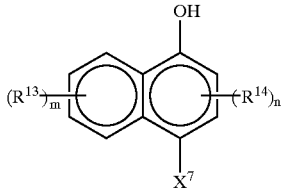

-continued (8)

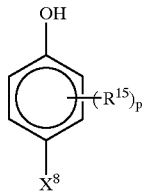

(9)

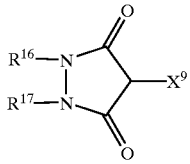

(10)

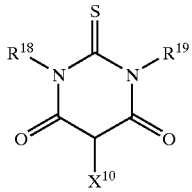

(11)

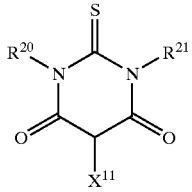

(12)

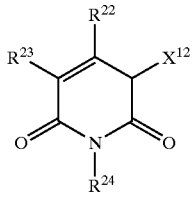

(13)

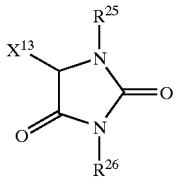

(14)

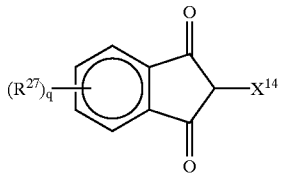

(15)

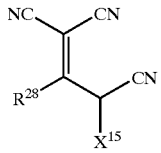

-continued (16)

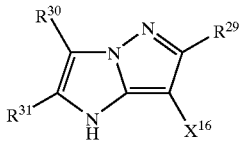

(17)

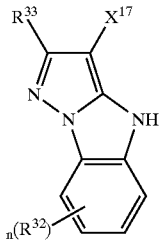

(18)

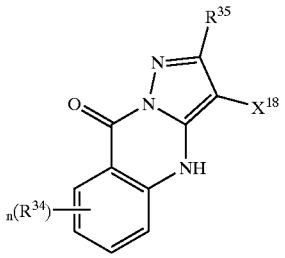

wherein, in the formulas (1) to (18), $X^1$ to $X^{18}$ each independently represents a hydrogen atom or a substituent; in the formula (1), $R^1$ and $R^2$ each independently represent an electron withdrawing group; in the formulas (2) to (18), $R^3$ to $R^{35}$ each independently represent a hydrogen atom or a substituent, m, n, p and q each independently represent an integer of 0–4; and r represents an integer of 0–5.

Preferably, the color image forming material is in the form of solid-dispersed microparticles.

Preferably, the color image forming material is of divalent type.

Preferably, the thermally processed image recording material for plate making of the present invention contains an ultrahigh contrast agent.

According to the present invention, it became possible to provide a thermally processed image recording material and method for thermally forming images that give a large difference in ultraviolet absorption between image areas and non-image areas, which is suitable for printing plate making.

DETAILED EXPLANATION OF THE INVENTION

Hereafter, methods for practicing the present invention and embodiments of the present invention will be explained in detail. In the present specification, ranges indicated with "-" mean ranges including the numerical values before and after "-" as the minimum and maximum values.

The silver salt of an organic acid that can be used for the present invention is a silver salt relatively stable against light, but forms a silver image when it is heated at 80° C. or higher in the presence of an exposed photocatalyst (e.g., a latent image of photosensitive silver halide) and a reducing agent. The silver salt of an organic acid may be any organic substance containing a source of reducible silver ions. Silver salts of an organic acid, in particular, silver salts of a long chain aliphatic carboxylic acid having from 10 to 30, preferably from 15 to 28 carbon atoms, are preferred. Complexes of organic or inorganic acid silver salts of which ligands have a complex stability constant in the range of 4.0–10.0 are also preferred. The silver supplying substance can preferably constitute about 5–70 weight % of the image-forming layer. Preferred examples of the silver salts of an organic acid include silver salts of organic compounds having carboxyl group. Specifically, the silver salts of an organic acid maybe silver salts of an aliphatic carboxylic acid and silver salts of an aromatic carboxylic acid, but not limited to these. Preferred examples of the silver salts of an aliphatic carboxylic acid include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate, mixtures thereof and so forth.

Silver salts of compounds having mercapto or thione group and derivatives thereof may also be used. Preferred examples of these compounds include silver salt of 3-mercapto-4-phenyl-1,2,4-triazole, silver salt of 2-mercaptobenzimidazole and so forth. Compounds containing an imino group may also be used. Preferred examples of such compounds include silver salts of benzotriazole and derivatives thereof, for example, silver salts of benzotriazoles such as silver methylbenzotriazole.

The shape of the organic silver salt that can be used in the present invention is not particularly limited, and those of various shapes can be used. For example, those of acicular shape, scaly shape, aggregated shape and so forth. Particularly preferred are those of acicular shape and scaly shape. As for acicular crystals, the short axis is preferably from 0.01–0.20 μm, more preferably from 0.01–0.15 μm, and the long axis is preferably from 0.10–5.0 μm, more preferably from 0.10–4.0 μm. The grain size distribution of the organic silver salt is preferably monodispersed distribution. The term "monodisperse" as used herein means that the percentage of the values obtained by dividing the standard deviations of the length of the short axis and long axis by the lengths of the short axis and long axis, respectively, are preferably 100% or less, more preferably 80% or less, still more preferably 50% or less.

The silver salt of an organic acid used in the present invention can be preferably desalted. The desalting method is not particularly limited and any known methods may be used. Known filtration methods such as centrifugal filtration, suction filtration, ultrafiltration and flocculation washing by coagulation may be preferably used.

In the present invention, for obtaining an organic acid silver salt solid dispersion having a high S/N ratio and a small grain size and being free from coagulation, there is preferably used a dispersion method comprising steps of converting an aqueous dispersion that contains a silver salt of an organic acid as an image-forming medium and contains substantially no photosensitive silver salt into a high-speed flow, and then releasing the pressure.

The dispersion thus obtained after such a process is then mixed with an aqueous photosensitive silver salt solution to produce a coating solution containing the photosensitive image-forming medium. The coating solution enables the manufacture of a thermally processed image recording material exhibiting low haze and low fog, and having high sensitivity. When a photosensitive silver salt coexists at the time of dispersing process under a high-pressure and at high-speed flow, fog may increase and sensitivity may markedly decrease. Furthermore, when an organic solvent is used as a dispersion medium instead of water, haze and fog may increase and sensitivity may likely be decreased. When a conversion method where a part of the organic acid silver salt in the dispersion is converted into a photosensitive silver salt is used instead of the method of mixing an aqueous photosensitive silver salt solution, sensitivity may likely be decreased.

The above-described aqueous dispersion obtained by using conversion under a high-pressure and at high-speed flow is substantially free from a photosensitive silver salt. The content thereof is 0.1 mole % or less based on the non-photo-sensitive organic silver salt, and a photosensitive silver salt is not added intentionally.

The solid dispersing apparatuses and techniques used for performing the above-described dispersion method in the present invention are described in detail, for example, in Toshio Kajiuchi and Hiromoto Usui, Bunsan-Kei Rheology to Bunsanka Gijutsu (Rheology of Dispersion System and Dispersion Technology), pp.357–403, Shinzan Sha Shuppan (1991), and Kagaku Kogaku no Shinpo (Progress of Chemical Engineering), pp. 184–185, compiled by Corporation Kagaku Kogakukai Tokai Shibu, Maki Shoten (1990). The dispersion method used in the present invention comprises the steps of supplying an aqueous dispersion containing at least an organic silver salt under a positive pressure by means of a high-pressure pump or the like into a pipeline, passing the dispersion through a narrow slit provided inside the pipeline, and then subjecting the dispersion to rapid pressure reduction to perform fine dispersion.

As for the high-pressure homogenizer which may be used in the present invention, it is considered that the dispersion into fine grains is generally achieved by dispersion forces such as (a) "shear force" generated at the passage of dispersoid through a narrow slit under a high pressure at a high speed, and (b) "cavitation force" generated at the time of the release of the dispersoid from the high pressure so as to be under normal pressure. As a classic example of the dispersion apparatus of this type, Golline homogenizer can be mentioned. By using this apparatus, the solution to be dispersed is transported under a high pressure and converted into a high-speed flow through a narrow slit on the cylinder surface, and the energy of the flow allows collision of the flow against the peripheral wall surface to achieve emulsification and dispersion. The pressure applied may generally be from 100–600 kg/cm$^2$ and the flow velocity may be from several m/sec to 30 m/sec. In order to increase the dispersion efficiency, some apparatuses are designed wherein a high flow velocity section is formed into a serrated shape to increase the frequency of collision. Apparatuses capable of dispersion under a further higher pressure and at a further higher flow velocity have been developed in recent years, and examples include Microfluidizer (manufactured by Microfluidex International Corporation), Nanomizer (manufactured by Tokusho Kika Kogyo KK) and so forth.

Examples of the dispersing apparatus which can be suitably used in the present invention include Microfluidizer M-110S-EH (with G10Z interaction chamber), M-110Y (with H10Z interaction chamber), M-140K (with G10Z interaction chamber), HC-5000 (with L30Z or H230Z interaction chamber) and HC-8000 (with E230Z or L30Z interaction chamber), all manufactured by Microfluidex International Corporation.

By using these apparatuses, an aqueous dispersion containing at least an organic silver salt is transported under a positive pressure by means of a high-pressure pump or the like into a pipeline, and the solution is passed though a narrow slit provided inside the pipeline to apply a desired pressure. Then, the pressure in the pipeline is rapidly released to the atmospheric pressure to apply a rapid pressure change to the dispersion to obtain an optimal organic silver salt dispersion for use in the present invention.

In the dispersion operation of the present invention, the organic silver salt is preferably dispersed in the presence of a dispersant (dispersion aid) soluble in an aqueous solvent. Examples of the dispersion aid include synthetic anion polymers such as polyacrylic acid, copolymers of acrylic acid, maleic acid copolymers, maleic acid monoester copolymers and acrylomethyl-propanesulfonic acid copolymers, semisynthetic anion polymers such as carboxymethyl starch and carboxymethyl cellulose, anionic polymers such as alginic acid and pectic acid, compounds described in Japanese Patent Laid-open Publication (Kokai, hereinafter referred to as JP-A) 7-350753, known anionic, nonionic or cationic surfactants, other known polymers such as polyvinyl alcohol, polyvinylpyrrolidone, carboxymethyl cellulose, hydroxypropyl cellulose and hydroxypropylmethyl cellulose, and naturally-occurring polymer compounds such as gelatin, and these may be appropriately selected and used. Polyvinyl alcohol and water-soluble cellulose derivatives are particularly preferred.

The dispersing aid is generally mixed with the organic silver salt in a form of powder or wet cake before the dispersing process, and fed as slurry into a dispersing apparatus. However, the dispersing aid may be mixed with the organic silver salt beforehand, and then the mixture may be subjected to a treatment such as by heating or treatment with a solvent to form an organic silver salt powder or wet cake. The pH may be controlled with a suitable pH modifier before, during or after the dispersing operation.

Other than the mechanical dispersion, the organic silver salt can be made into microparticles by roughly dispersing the salt in a solvent through pH control, and then changing the pH in the presence of a dispersing aid. For the operation, an organic solvent may be used as a solvent for the rough dispersion, and such organic solvent can be removed after the formation of grains.

The dispersion prepared can be stored with stirring to prevent precipitation of the grains during storage, or stored in a highly viscous state by means of hydrophilic colloids (e.g., a jelly state formed with gelatin). Furthermore, the dispersion may contain a preservative in order to prevent proliferation of microorganisms during storage.

While the silver salt of an organic acid can be used in a desired amount, it is preferably used in an amount of 0.1–5.0 g/m$^2$, more preferably 0.3–2.5 g/m$^2$, as silver amount.

In the present invention, the color forming dye image shows an absorbance for ultraviolet region higher than that for visible region and has a transmission density of 0.3 or more for the region of 360–450 nm. A higher transmission density exceeding 0.3 is more preferred. However, a higher transmission density is accompanied by increase of auxiliary absorption for the visible region. Therefore, it is practically 0.3–4.0, preferably 0.5–3.0. The transmission density can be measured by using a Machbeth transmission densitometer. Such color development can be controlled by changing the combination of the color image forming material and the reducing agent. As the color image forming material and the reducing agent used for the present invention, a combination of materials selected from the groups of compounds explained below.

The color image forming material used for the present invention will be explained hereafter. The color image forming material used for the present invention is preferably a compound represented by any one of the following formulas (1) to (18).
(1)
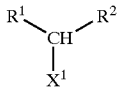
(2)
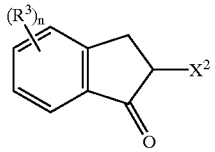
(3)
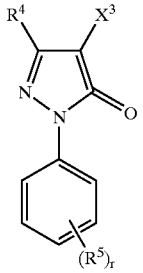
(4)
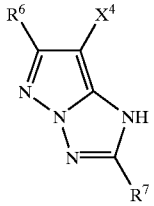
(5)
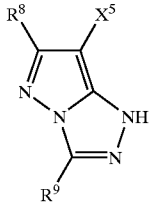
(6)
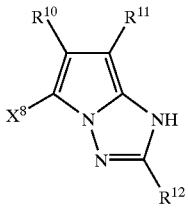
(7)
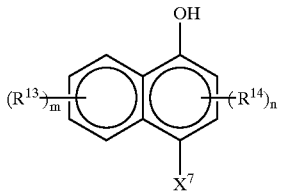
-continued
(8)
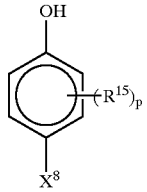
(9)
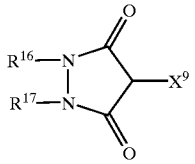
(10)
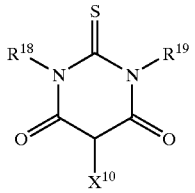
(11)
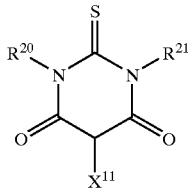
(12)
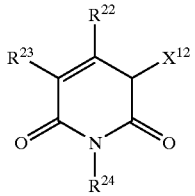
(13)
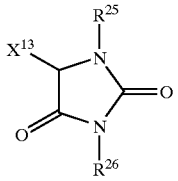
(14)
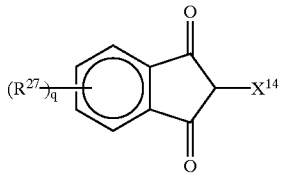
(15)
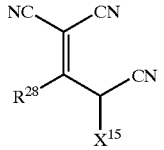

-continued (16)

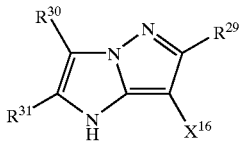

(17)

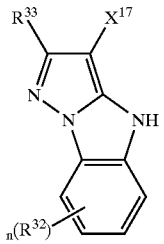

(18)

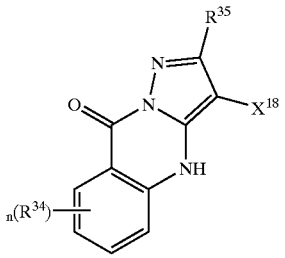

In the formulas (1) to (18), $X^1$ to $X^{18}$ each independently represents a hydrogen atom or a substituent. In the formula (1), $R^1$ and $R^2$ each independently represent an electron withdrawing group. In the formulas (2) to (18), $R^3$ to $R^{35}$ each independently represent a hydrogen atom or a substituent, m, n, p and q each independently represent an integer of 0–4, and r represents an integer of 0–5.

In the formulas (1) to (18), $X^1$ to $X^{18}$ each independently represent hydrogen atom or a substituent. The substituents represented by $X^1$ to $X^{18}$ may be identical to or different from each other or one another. Preferred examples of the substituents represented by X1 to $X^{18}$ include a halogen atom (for example, fluorine atom, chlorine atom, bromine atom and iodine atom), an aryl group having preferably 6–30 carbon atoms, more preferably 6–20 carbon atoms, further preferably 6–12 carbon atoms (for example, phenyl, p-methylphenyl, naphthyl etc.), an alkoxy group having preferably 1–20 carbon atoms, more preferably 1–12 carbon atoms, further preferably 1–8 carbon atoms (for example, methoxy, ethoxy, butoxy etc.), an aryloxy group having preferably 6–20 carbon atoms, more preferably 6–16 carbon atoms, further preferably 6–12 carbon atoms (for example, phenyloxy, 2-naphthyloxy etc.), an alkylthio group having preferably 1–20 carbon atoms, more preferably 1–16 carbon atoms, further preferably 1–12 carbon atoms (for example, methylthio, ethylthio, butylthio etc.), an arylthio group having preferably from 6 to 20 carbon atoms, more preferably from 6 to 16 carbon atoms, further preferably from 6 to 12 carbon atoms (for example, phenylthio, naphthylthio etc.), an acyloxy group having preferably 1–20 carbon atoms, more preferably 2–16 carbon atoms, further preferably 2–10 carbon atoms (for example, acetoxy, benzoyloxy etc.), an acylamino group having preferably 2–20 carbon atoms, more preferably 2–16 carbon atoms, further preferably 2–10 carbon atoms (for example, N-methylacetylamino, benzoylamino etc.), a sulfonylamino group having preferably 1–20 carbon atoms, more preferably 1–16 carbon atoms, further preferably 1–12 carbon atoms (for example, methanesulfonyl-amino, benzenesulfonylamino etc.), a carbamoyl group having preferably 1–20 carbon atoms, more preferably 1–16 carbon atoms, further preferably 1–12 carbon atoms (for example, carbamoyl, N,N-diethylcarbamoyl, N-phenylcarbamoyl etc.), an acyl group having preferably 2–20 carbon atoms, more preferably 2–16 carbon atoms, further preferably 2–12 carbon atoms (for example, acetyl, benzoyl, formyl, pivaloyl etc.), an alkoxycarbonyl groups having preferably 2–20 carbon atoms, more preferably 2–16 carbon atoms, further preferably 2–12 carbon atoms (for example, methoxycarbonyl etc.), sulfo group, a sulfonyl group having preferably 1–20 carbon atoms, more preferably 1–16 carbon atoms, further preferably 1–12 carbon atoms (for example, mesyl, tosyl etc.), a sulfonyloxy group having preferably 1–20 carbon atoms, more preferably 1–16 carbon atoms, further preferably 1–12 carbon atoms (for example, methanesulfonyloxy, benzenesulfonyloxy etc.), azo group, a heterocyclic group, a heterocyclylmercapto group, cyano group and so forth. The heterocyclic group used herein represents a saturated or unsaturated heterocyclic group, and examples thereof include, for example, pyridyl group, quinolyl group, quinoxalinyl group, pyrazinyl group, benzotriazolyl group, pyrazolyl group, imidazolyl group, benzimidazolyl group, tetrazolyl group, hydantoin-1-yl group, succinimido group, phthalimido group and so forth. The substituents represented by $X^1$ to $X^{18}$ may further be substituted with one or more other substituents, and such substituents may be any substituents so long as they do not degrade the photographic performance.

As the substituents represented by $X^1$ to $X^{18}$, those known as leaving groups of divalent couplers for photography are preferred, and examples thereof include, for example, a halogen atom, an alkoxy group, an aryloxy group, an alkylthio group, an arylthio group, a heterocyclic group, a heterocyclylmercapto group and so forth. Particularly preferred as $X^1$ to $X^{18}$ are those known as leaving groups of divalent couplers for photography.

In the formula (1), $R^1$ and $R^2$ may be the same or different from each other, and each independently represent an electron-withdrawing group. The electron withdrawing group used herein means a substituent that gives a positive value of the Hammett's substituent constant σp, and specific examples thereof include cyano group, an alkoxycarbonyl group, an aryloxycarbonyl group, a carbamoyl group, an imino group, an imino group substituted at N atom, a thiocarbonyl group, a sulfamoyl group, an alkylsulfonyl group, an arylsulfonyl group, nitro group, a halogen atom, a perfluoroalkyl group, a perfluoroalkanamido group, a sulfonamido group, an acyl group, benzoyl group, formyl group, phosphoryl group, carboxyl group (or a salt thereof), sulfo group (or a salt thereof), a heterocyclic group, an alkenyl group, an alkynyl group, acyloxy group, acylthio group, sulfonyloxy group, an aryl group substituted with any one of these electron withdrawing groups and so forth. The heterocyclic group is a saturated or unsaturated heterocyclic group, and examples thereof include pyridyl group, quinolyl group, quinoxalinyl group, pyrazinyl group, benzotriazolyl group, imidazolyl group, benzimidazolyl group, hydantoin-1-yl group, succinimido group, phthalimido group, indolynyl group and so forth. $R^1$ and $R^2$ may be bonded together to form a saturated or unsaturated carbon ring or heterocycle. The electron withdrawing group represented by $R^1$ or $R^2$ is preferably a substituent having 30 carbon atoms or less, more preferably 20 carbon atoms or less. More preferably, $R^1$ and $R^2$ represent cyano group, an alkoxycarbonyl group, an aryloxycarbonyl group, a carbamoyl group, an imino group, an acyl group, benzoyl group or a heterocyclic group.

In the formulas (2) to (18), $R^3$ to $R^{35}$ each independently represent hydrogen atom or a substituent. The substituents represented by $R^3$ to $R^{35}$ may be identical to or different from each other or one another, and they may be any of substituents that do not degrade photographic performance. Specific examples thereof include, for example, a halogen atom (for example, fluorine atom, chlorine atom, bromine atom and iodine atom), a linear, branched or cyclic alkyl group or an alkyl group consisting of a combination thereof having preferably 1–20 carbon atoms, more preferably 1–16 carbon atoms, further preferably 1–13 carbon atoms (for example, methyl, ethyl, n-propyl, isopropyl, sec-butyl, tert-butyl, tert-octyl, n-amyl, tert-amyl, n-dodecyl, n-tridecyl, cyclohexyl etc.), an alkenyl group having preferably 2–20 carbon atoms, more preferably 2–16 carbon atoms, further preferably 2–12 carbon atoms (for example, vinyl, allyl, 2-butenyl, 3-pentenyl etc.), an aryl group having preferably 6–30 carbon atoms, more preferably 6–20 carbon atoms, further preferably 6–12 carbon atoms (for example, phenyl, p-methylphenyl, naphthyl etc.), an alkoxy group having preferably 1–20 carbon atoms, more preferably 1–16 carbon atoms, further preferably 1–12 carbon atoms (for example, methoxy, ethoxy, propoxy, butoxy etc.), an aryloxy group having preferably 6–30 carbon atoms, more preferably 6–20 carbon atoms, further preferably 6–12 carbon atoms (for example, phenyloxy, 2-naphthyloxy etc.), an acyloxy group having preferably 2–20 carbon atoms, more preferably 2–16 carbon atoms, further preferably 2–12 carbon atoms (for example, acetoxy, benzoyloxy etc.), an amino group having preferably 0–20 carbon atoms, more preferably 1–16 carbon atoms, further preferably 1–12 carbon atoms (for example, dimethylamino group, diethylamino group, dibutylamino group, anilino group etc.), an acylamino group having preferably 2–20 carbon atoms, more preferably 2–16 carbon atoms, further preferably 2–13 carbon atoms (for example, acetylamino, tridecanoylamino, benzoyl-amino etc.), a sulfonylamino group having preferably 1–20 carbon atoms, more preferably 1–16 carbon atoms, further preferably 1–12 carbon atoms (for example, methanesulfonyl-amino, butanesulfonylamino, benzenesulfonylamino etc.), a ureido group having preferably 1–20 carbon atoms, more preferably 1–16 carbon atoms, further preferably 1–12 carbon atoms (for example, ureido, methylureido, phenylureido etc.), a carbamate group having preferably 2–20 carbon atoms, more preferably 2–16 carbon atoms, further preferably 2–12 carbon atoms (for example, methoxycarbonylamino, phenyloxycarbonyl-amino etc.), carboxyl group, a carbamoyl group having preferably 1–20 carbon atoms, more preferably 1–16 carbon atoms, further preferably 1–12 carbon atoms (for example, carbamoyl, N,N-diethylcarbamoyl, N-dodecylcarbamoyl, N-phenylcarbamoyl etc.), an alkoxycarbonyl group having preferably 2–20 carbon atoms, more preferably 2–16 carbon atoms, further preferably 2–12 carbon atoms (for example, methoxycarbonyl, ethoxycarbonyl, butoxycarbonyl etc.), an acyl group having preferably 2–20 carbon atoms, more preferably 2–16 carbon atoms, further preferably 2–12 carbon atoms (for example, acetyl, benzoyl, formyl, pivaloyl etc.), sulfo group, a sulfonyl group having preferably 1–20 carbon atoms, more preferably 1–16 carbon atoms, further preferably 1–12 carbon atoms (for example, mesyl, tosyl etc.), a sulfamoyl group having preferably 0–20 carbon atoms, more preferably 0–16 carbon atoms, further preferably 0–12 carbon atoms (for example, sulfamoyl, methylsulfamoyl, dimethylsulfamoyl, phenylsulfamoyl, etc.), cyano group, nitro group, hydroxyl group, mercapto group, an alkylthio group having preferably 1–20 carbon atoms, more preferably 1–16 carbon atoms, further preferably 1–12 carbon atoms (for example, methylthio, butylthio etc.), a heterocyclic group having preferably 2–20 carbon atoms, more preferably 2–16 carbon atoms, further preferably 2–12 carbon atoms (for example, pyridyl, imidazoyl, pyrrolidyl etc.) and so forth. These substituents may be further substituted with other substituents.

When m, p and q represents an integer of 2 or more, a plurality of $R^{13}$, $R^{15}$ or $R^{27}$ are adjacent to each other, two of adjacent $R^{13}$, $R^{15}$ or $R^{27}$ may be bonded to each other to form a ring.

Preferred examples of the substituents represented by $R^3$ to $R^{35}$ are a halogen atom, an alkyl group, an aryl group, an alkoxy group, an aryloxy group, an acyloxy group, an anilino group, an acylamino group, a sulfonylamino group, carboxyl group, a carbamoyl group, an acyl group, sulfo group, a sulfonyl group, a sulfamoyl group, cyano group, hydroxyl group, a mercapto group, an alkylthio group and a heterocyclic group.

In the present invention, the compounds represented by the formulas (1) to (18) are preferably used as the color image forming material, but more preferred are those compounds represented by the formula (1), (3), (4), (6), (9), (10), (11) or (15), and particularly preferred are those compounds represented by the formula (3), (4), (9), (10) or (11).

Specific examples of the compounds represented by the formulas (1) to (18) will be shown below. However, the color image forming material used for the present invention is not limited to these specific examples.

(A-101)

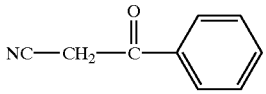

(A-102)

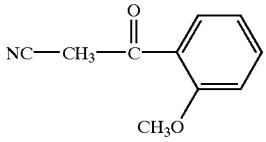

(A-103)

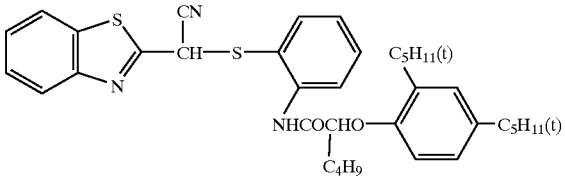

(A-104)

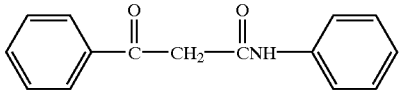

(A-105)

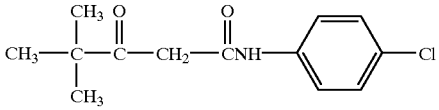

(A-106)

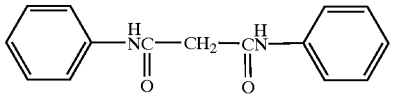

-continued
(A-107)
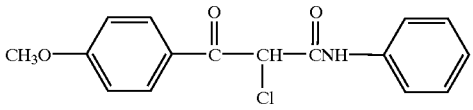
(A-108)
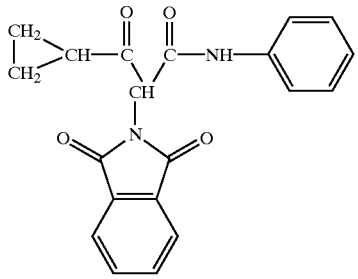
(A-109)
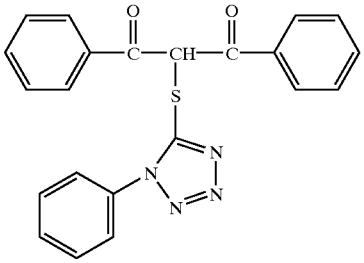
(A-110)
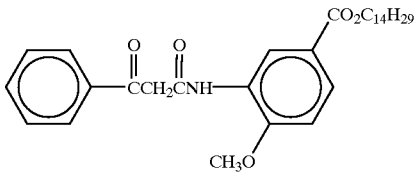
(A-111)
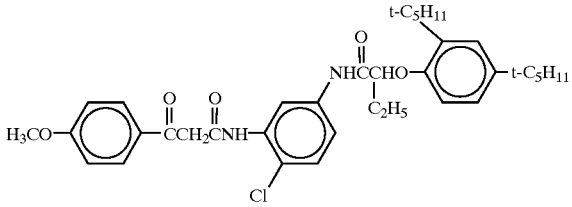
(A-112)
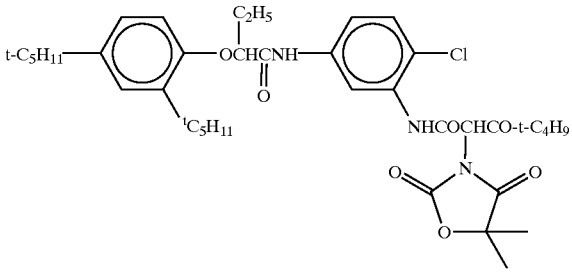
-continued
(A-113)
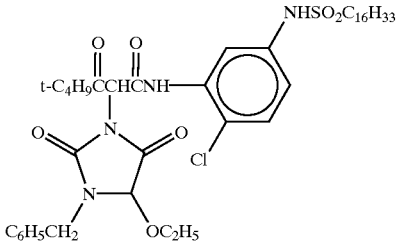
(A-201)
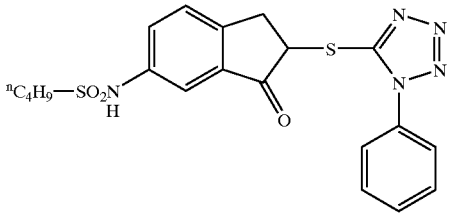
(A-202)
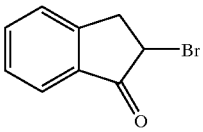
(A-203)
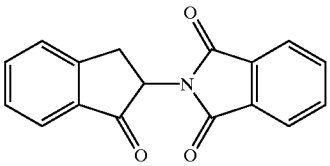
(A-204)
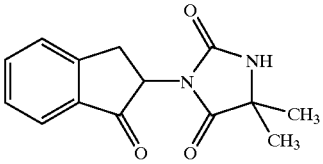
(A-205)
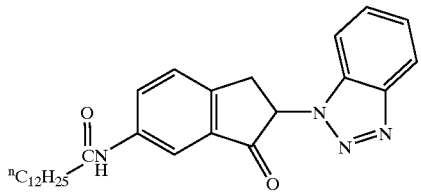
(A-206)
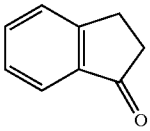
(A-207)
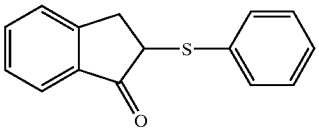

-continued
(A-208)
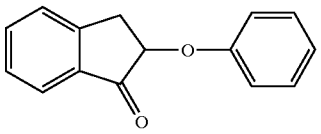
(A-209)
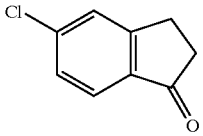
(A-301)
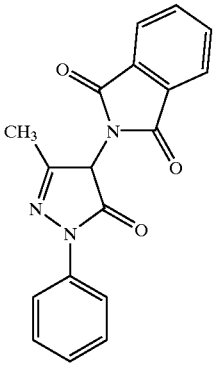
(A-302)
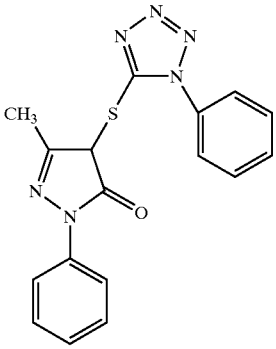
(A-303)
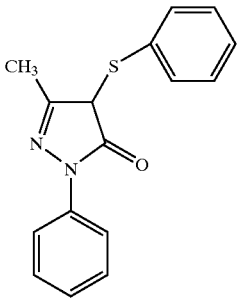
(A-304)
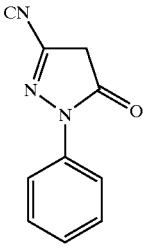
-continued
(A-305)
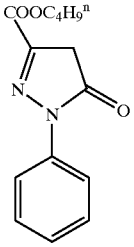
(A-306)
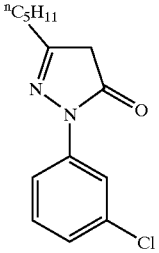
(A-307)
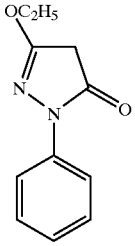
(A-308)
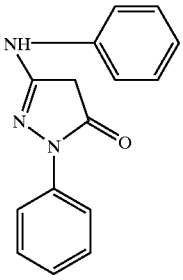
(A-309)
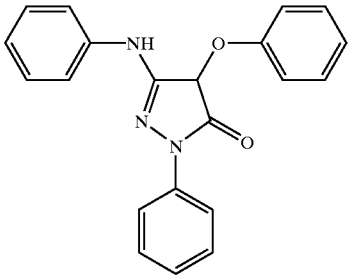

-continued
(A-310)
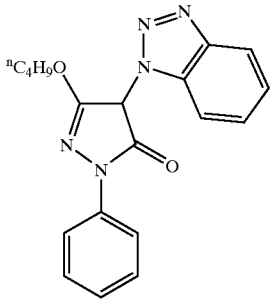
(A-311)
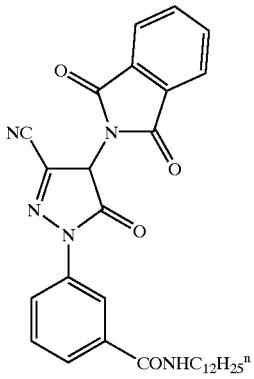
(A-312)
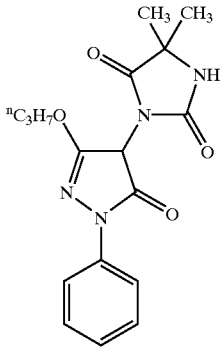
(A-401)
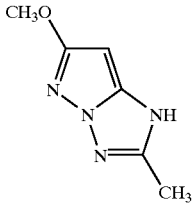
(A-402)
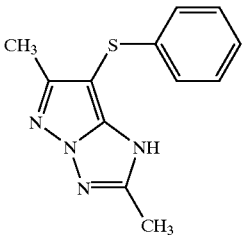
-continued
(A-403)
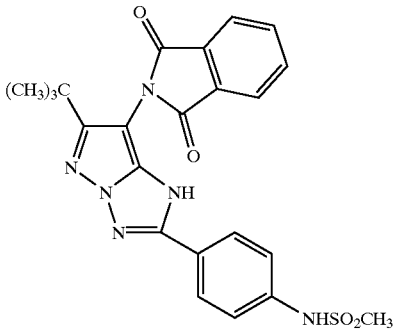
(A-404)
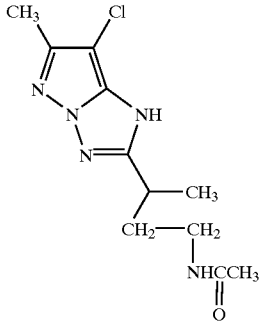
(A-405)
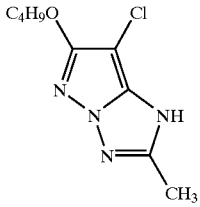
(A-406)
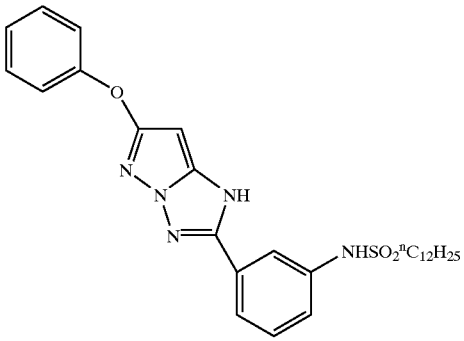
(A-407)
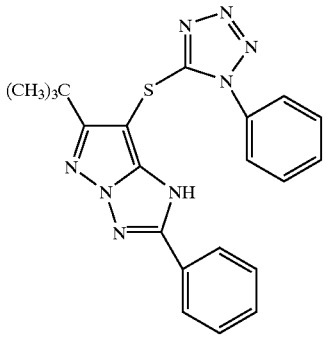

-continued
(A-408)
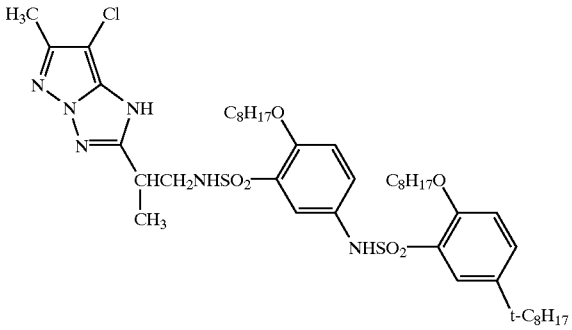
(A-409)
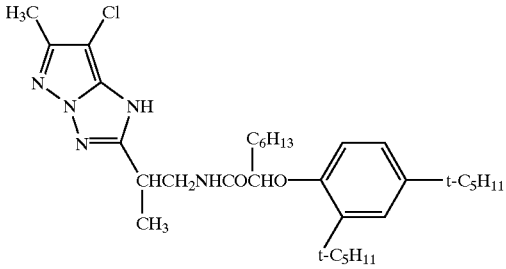
(A-501)
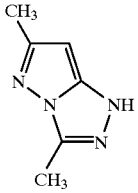
(A-502)
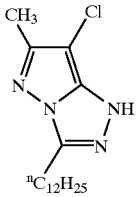
(A-503)
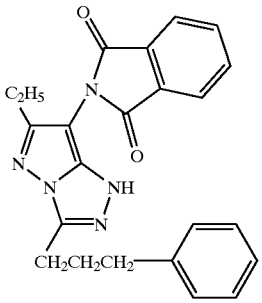
(A-504)
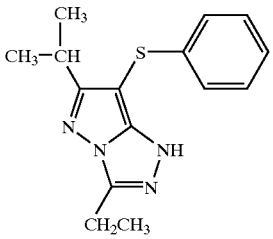
-continued
(A-505)
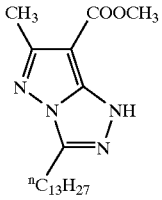
(A-506)
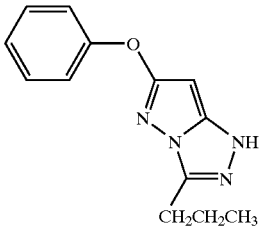
(A-507)
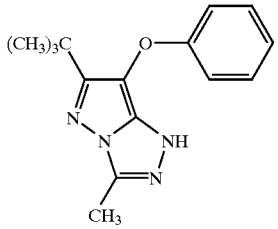
(A-508)
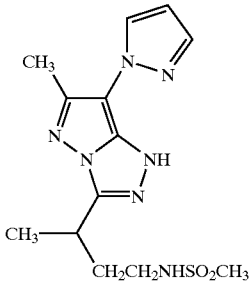
(A-601)
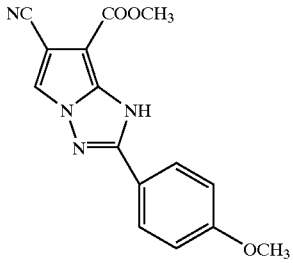
(A-602)
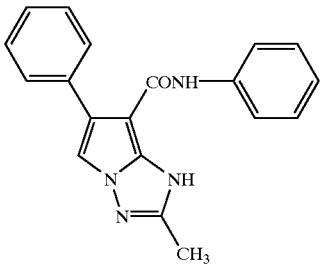

-continued
(A-603)
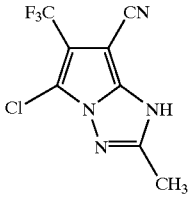
(A-604)
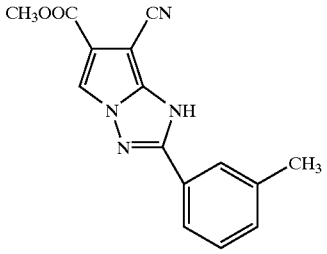
(A-605)
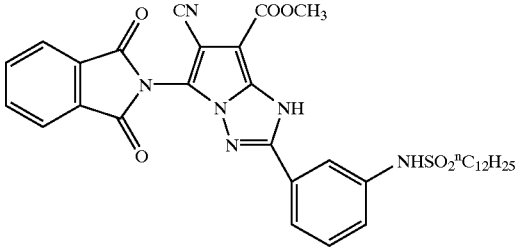
(A-606)
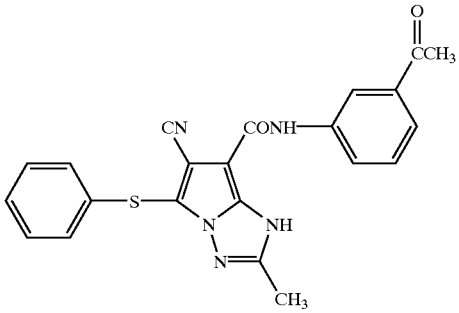
(A-607)
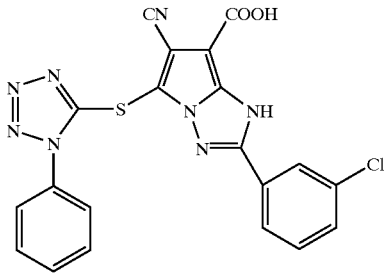
(A-701)
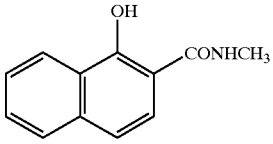
-continued
(A-702)
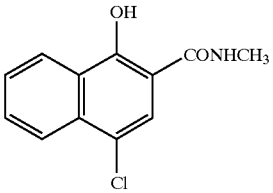
(A-703)
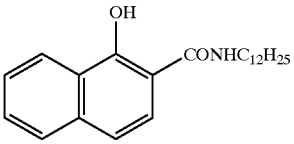
(A-704)
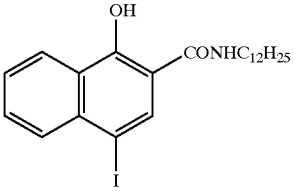
(A-705)
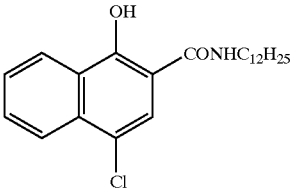
(A-706)
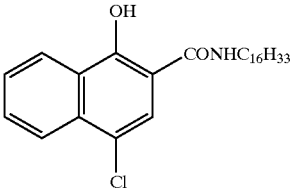
(A-707)
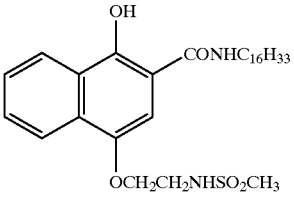
(A-708)
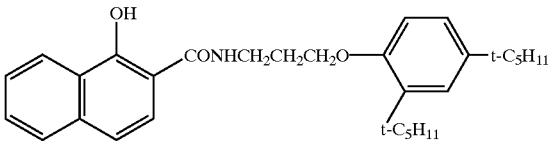
(A-709)
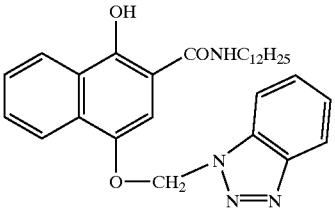

-continued
(A-710)
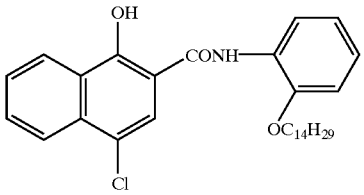
(A-801)
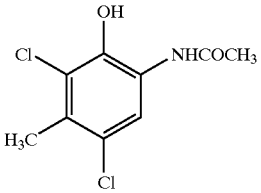
(A-802)
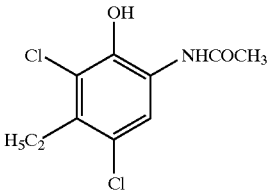
(A-803)
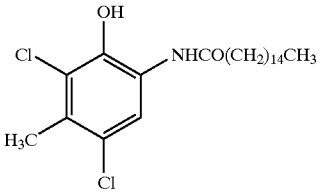
(A-804)
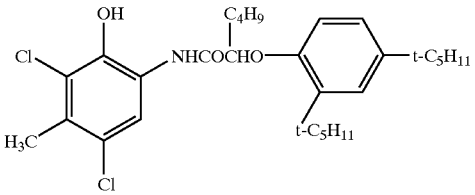
(A-805)
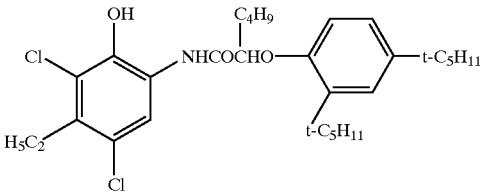
(A-806)
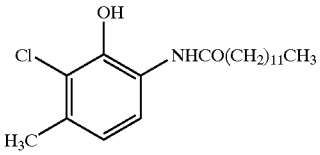
-continued
(A-807)
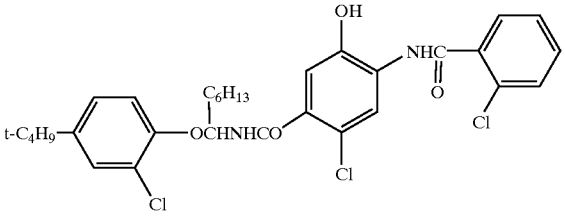
(A-901)
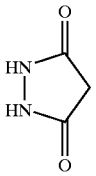
(A-902)
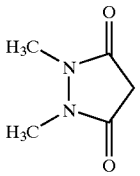
(A-903)
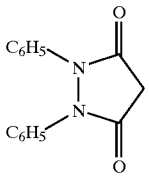
(A-904)
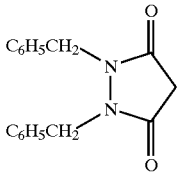
(A-905)
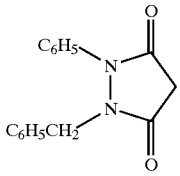
(A-906)
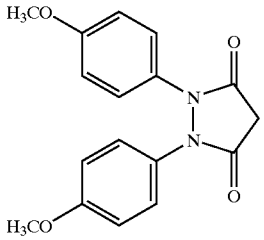

-continued
(A-907)
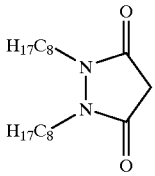
(A-908)
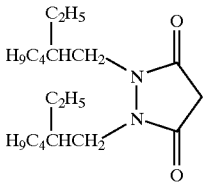
(A-909)
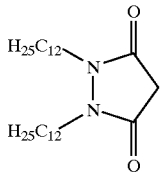
(A-910)
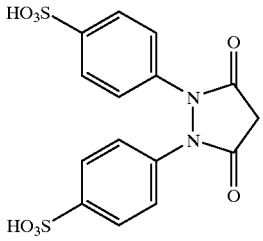
(A-911)
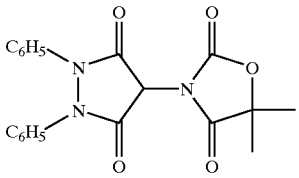
(A-912)
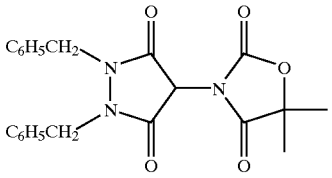
(A-913)
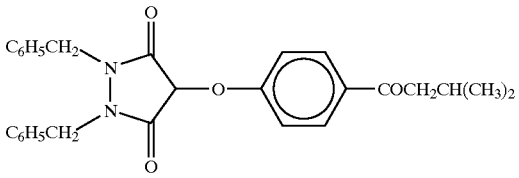
(A-1001)
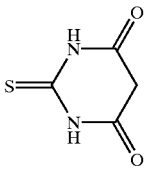
-continued
(A-1002)
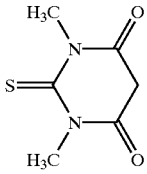
(A-1003)
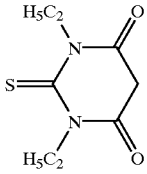
(A-1004)
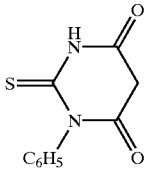
(A-1005)
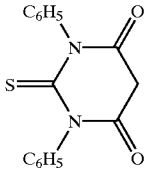
(A-1006)
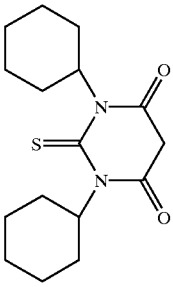
(A-1007)
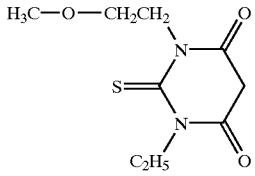
(A-1008)
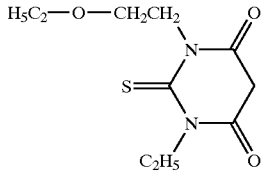
(A-1009)
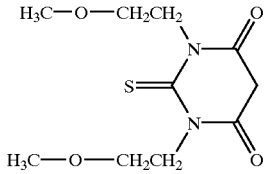

-continued
(A-1010)
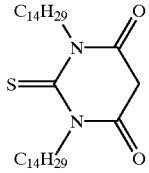
(A-1011)
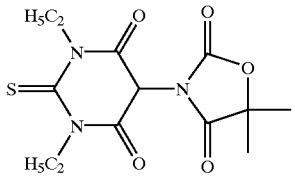
(A-1012)
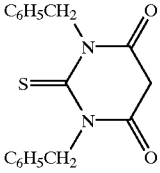
(A-1013)
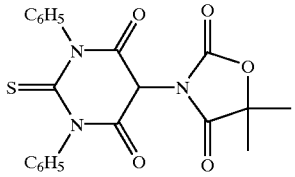
(A-1014)
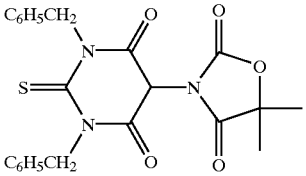
(A-1101)
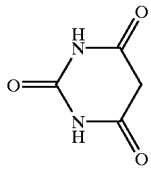
(A-1102)
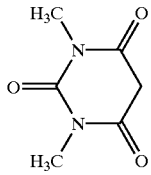
(A-1103)
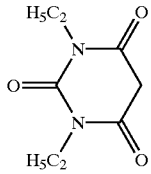
-continued
(A-1104)
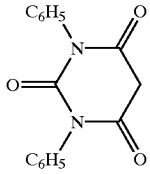
(A-1105)
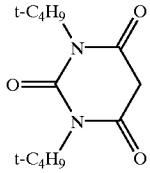
(A-1106)
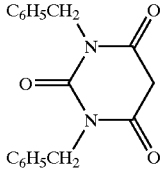
(A-1107)
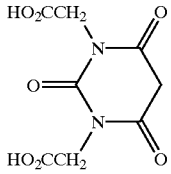
(A-1108)
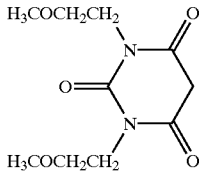
(A-1109)
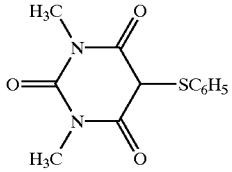
(A-1110)
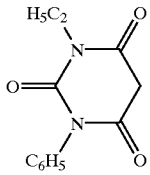
(A-1111)
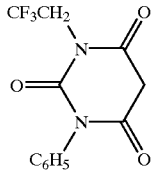

-continued
(A-1112)
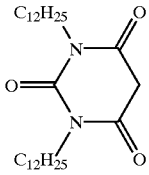
(A-1113)
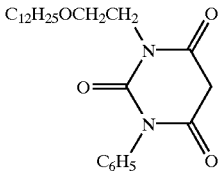
(A-1114)
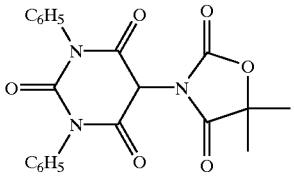
(A-1115)
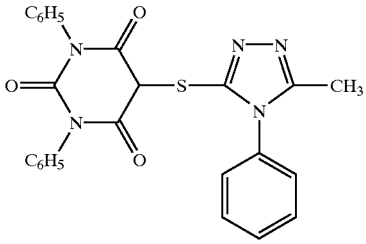
(A-1201)
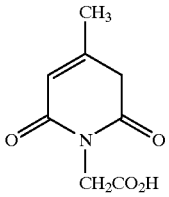
(A-1202)
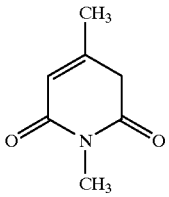
(A-1203)
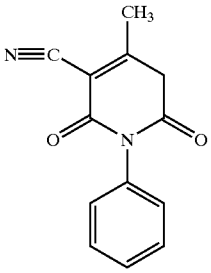
-continued
(A-1204)
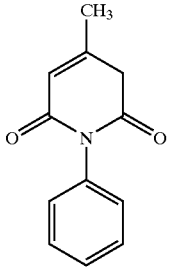
(A-1205)
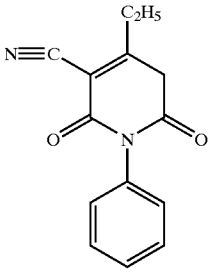
(A-1206)
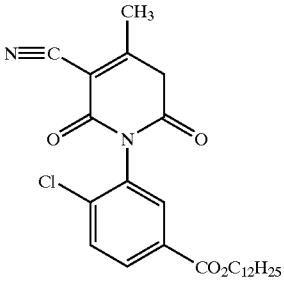
(A-1207)
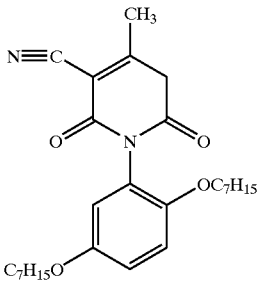
(A-1208)
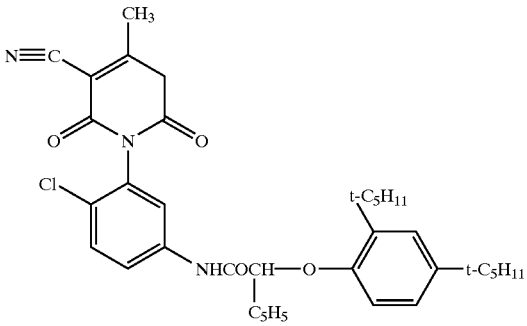

-continued
(A-1209)
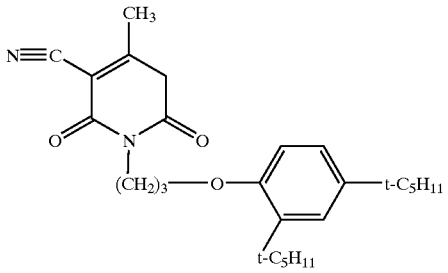
(A-1301)
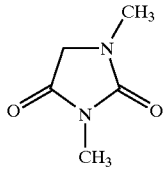
(A-1302)
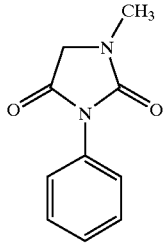
(A-1303)
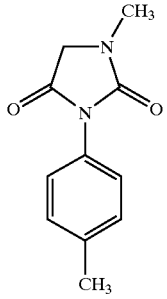
(A-1304)
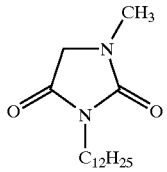
(A-1305)
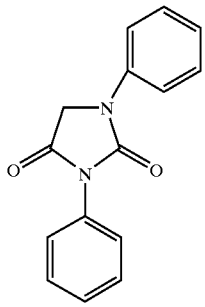
-continued
(A-1306)
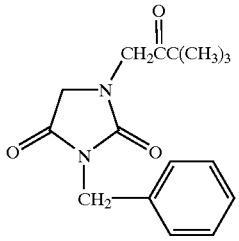
(A-1307)
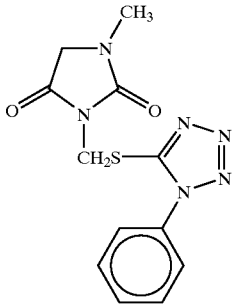
(A-1308)
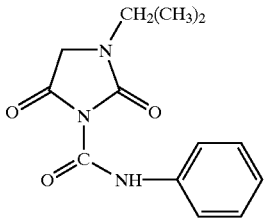
(A-1309)
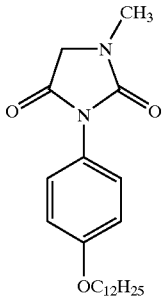
(A-1310)
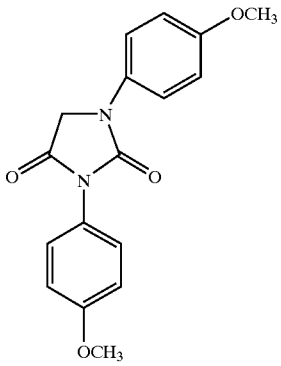

-continued
(A-1401)
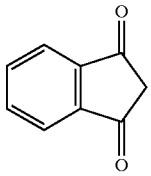
(A-1402)
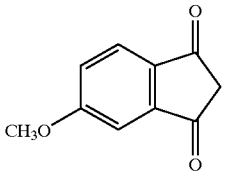
(A-1403)
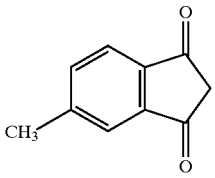
(A-1404)
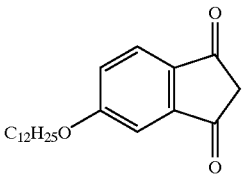
(A-1405)
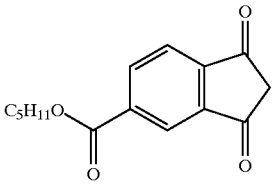
(A-1406)
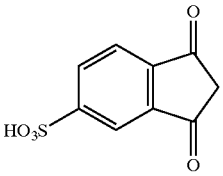
(A-1407)
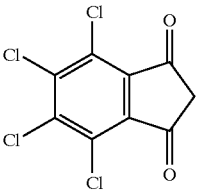
(A-1408)
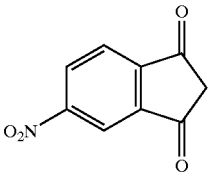
-continued
(A-1409)
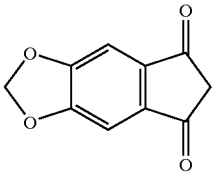
(A-1501)
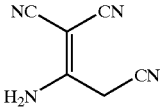
(A-1502)
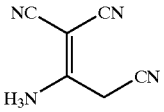
(A-1503)
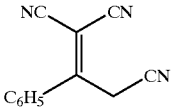
(A-1504)
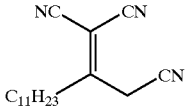
(A-1505)
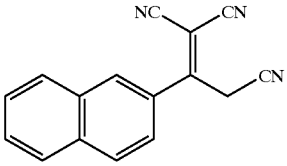
(A-1506)
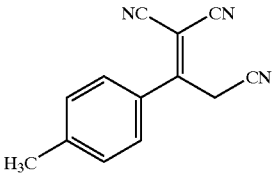
(A-1507)
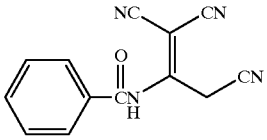
(A-1508)
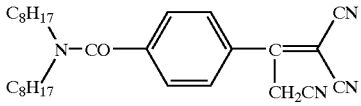
(A-1509)
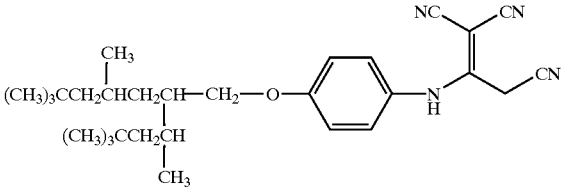

The color image forming materials A–G below are also preferably used in the present invention.

The color image forming materials represented by the formulas (1) to (18) and the color image forming materials A–G can readily be synthesized by methods known in the art of photography.

The amount of the color image forming material used for the present invention is preferably 0.2–200 mmol, more preferably 0.3–100 mmol, further preferably 0.5–30 mmol, per mole of silver. The color image forming materials may be used each alone or as a combination of two or more kinds of them.

The color image forming material used for the present invention may be used after being dissolved in water or an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve. Alternatively, the color image forming material may also be used as an emulsified dispersion mechanically prepared according to a known emulsification dispersion method by using an oil such as dibutyl phthalate, tricresyl phosphate, glyceryl triacetate or diethyl phthalate, ethyl acetate or cyclohexanone as an auxiliary solvent for dissolution. Or, the color image forming material may be used after dispersion of powder of the color image forming material in water by using a ball mill, colloid mill, sand grinder mill, MANTON GAULIN, or microfluidizer, or by means of ultrasonic wave according to a known method for solid dispersion.

The color image forming material used for the present invention may be added to any layers on the same side of a support as the layer(s) containing the photosensitive silver halide and silver salt of an organic acid. However, the color image forming material is preferably added to the image-forming layer containing the photosensitive silver halide and silver salt of an organic acid.

The thermally processed image recording material of the present invention contains a reducing agent for the silver salt of an organic acid. As such a reducing agent for the silver salt of an organic acid, various compounds that reduce silver ion to metal silver are known. Photographic developers known for conventional wet type development such as phenidones, hydroquinones and catechols, and phenol derivatives, in particular, hindered phenols and sulphonamidophenols are known as reducing agents effective for heat development.

In the present invention, a hydrazine compound represented by the formula (D) is used as a particularly preferred reducing agent.

$$Q^1—NHNH—Q^2 \qquad \text{Formula (D)}$$

In the formula, $Q^1$ represents an aromatic group or 5- to 7-membered unsaturated ring bonding to —NHNH—$Q^2$ at a carbon atom, and $Q^2$ represents a carbamoyl group, an acyl group, an alkoxycarbonyl group, an aryloxycarbonyl group, a sulfonyl group or a sulfamoyl group.

Preferred examples of the 5- to 7-membered unsaturated ring represented by $Q^1$ include benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadia-zole ring, 1,2,4-oxadiazole ring, 1,2,5-oxadiazole ring, thiazole ring, oxazole ring, isothiazole ring, isoxazole ring, thiophene ring and so forth. Condensed rings in which these rings are condensed together are also preferred.

These rings may have one or more substituents, and when they have two or more substituents, those substituents may be identical or different from each other or one another. Examples of the substituents include a halogen atom, an alkyl group, an aryl group, a carbonamido group, an alkylsulfonamido group, an arylsulfonamido group, an alkoxy group, an aryloxy group, an alkylthio group, an arylthio group, a carbamoyl group, a sulfamoyl group, cyano group, an alkylsulfonyl group, an arylsulfonyl group, an alkoxycarbonyl group, an aryloxycarbon-yl group, and an acyl group. When these substituents are substitutable group, they may further have one or more substituents. Preferred examples of the substituents are a halogen atom, an alkyl group, an aryl group, a carbonamido group, an alkylsulfonamido group, an arylsulfonamido group, an alkoxy group, an aryloxy group, an alkylthio group, an arylthio group, an acyl group, an alkoxycarbonyl group, an aryloxycarbonyl group, a carbamoyl group, cyano group, a sulfamoyl group, an alkylsulfonyl group, an arylsulfonyl group and an acyloxy group.

The carbamoyl group represented by $Q^2$ has preferably 1–50 carbon atoms, more preferably 6–40 carbon atoms. Examples thereof include, for example, unsubstituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbamoyl, N-3-pyridylcarbamoyl and N-benzylcarbamoyl.

The acyl group represented by $Q^2$ has preferably 1–50 carbon atoms, more preferably 6–40 carbon atoms. Examples thereof include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl and 2-hydroxymethylbenzoyl.

The alkoxycarbonyl group represented by $Q^2$ has preferably 2–50 carbon atoms, more preferably 6–40 carbon atoms. Examples thereof include, for example, methoxycarbonyl, ethoxycarbonyl, isobutyloxycarbonyl, cyclohexyloxycarbonyl, dodecyloxycarbonyl and benzyloxycarbonyl.

The aryloxycarbonyl group represented by $Q^2$ has preferably 6–50 carbon atoms, more preferably 6–40 carbon atoms. Examples thereof include, for example, phenoxycarbonyl, 4-octyloxyphenoxycarbonyl, 2-hydroxymethylphenoxycarbonyl and 4-dodecyloxyphenoxycarbonyl.

The sulfonyl group represented by $Q^2$ has preferably 1–50 carbon atoms, more preferably 6–40 carbon atoms. Examples thereof include, for example, methylsulfonyl, butylsulfonyl, octylsulfonyl, 2-hexadecylsulfonyl, 3-dodecyloxypropylsulfonyl, 2-octyloxy-5-tert-octylphenylsulfonyl and 4-dodecyloxyphenylsulfonyl.

The sulfamoyl group represented by $Q^2$ has preferably 0–50 carbon atoms, more preferably 6–40 carbon atoms. Examples thereof include, for example, unsubstituted sulfamoyl, N-ethylsulfamoyl, N-(2-ethylhexyl)sulfamoyl, N-decylsulfamoyl, N-hexadecylsulfamoyl, N-{3-(2-ethylhexyloxy)propyl}-sulfamoyl, N-(2-chloro-5-dodecyloxycarbonylphenyl)sulfamoyl and N-(2-tetradecyloxyphenyl)sulfamoyl.

The groups represented by $Q^2$ may further have at substitutable positions one or more of the groups mentioned above as preferred substituents of the 5- to 7-membered unsaturated ring represented by $Q^1$. When they have two or more substituents, those substituents may be identical or different from each other or one another.

The preferred compounds represented by the formula (D) will be explained hereinafter. The unsaturated ring represented by $Q^1$ is preferably a 5- or 6-membered ring, and further preferably, $Q^1$ is benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thiazole ring, oxazole ring, isothiazole ring, isoxazole ring or a ring consisting of any of these rings condensed with benzene ring or unsaturated heterocyclic ring. $Q^2$ is preferably a carbamoyl group. Particularly preferably, $Q^2$ is a carbamoyl group having hydrogen atom on the nitrogen atom.

The compounds represented by the formula (D) can be synthesized according to the methods described in JP-A-9-152702, JP-A-8-286340, JP-A-9-152700, JP-A-9-152701, JP-A-9-152703, JP-A-9-152704 and so forth.

Specific examples of the compounds represented by the formula (D) will be listed below. However, the compounds used for the present invention are not limited by these specific examples.

D-101

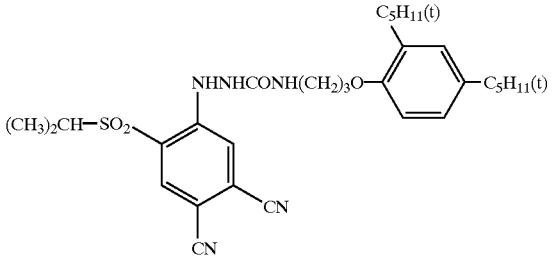

D-102

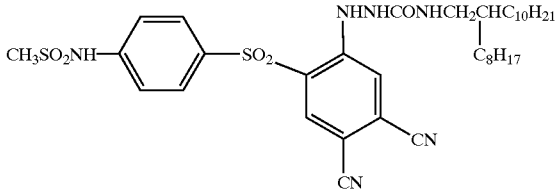

D-103

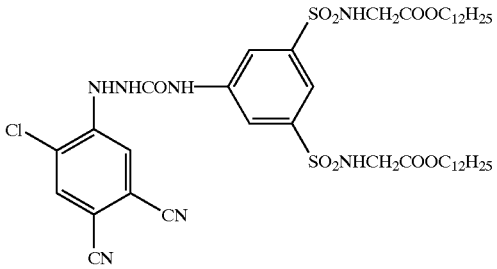

D-104

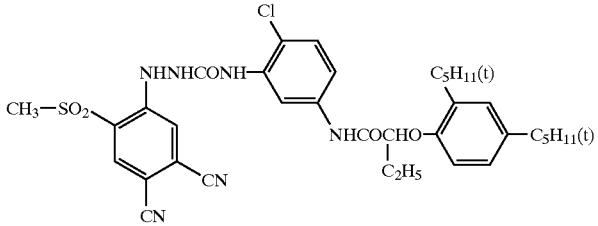

D-105

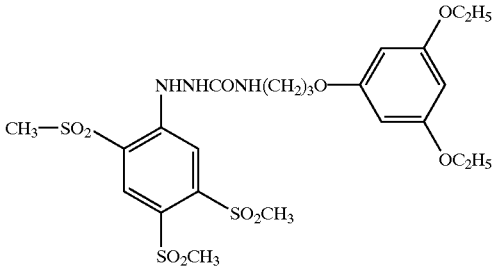

D-106

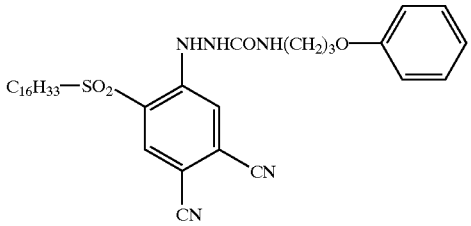

D-107

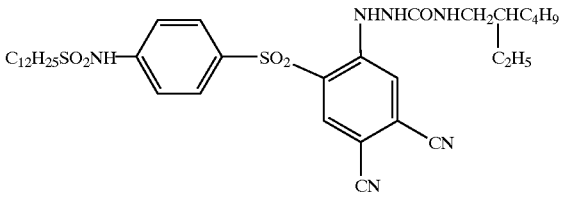

D-108

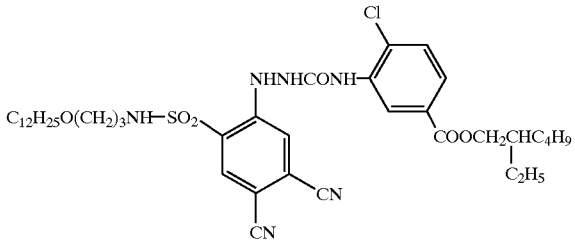

D-109

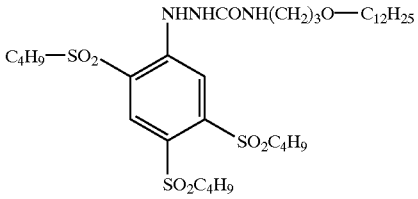

D-110

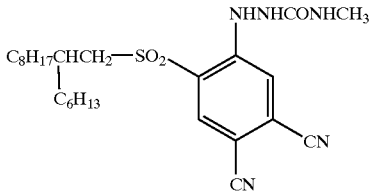

-continued
D-111
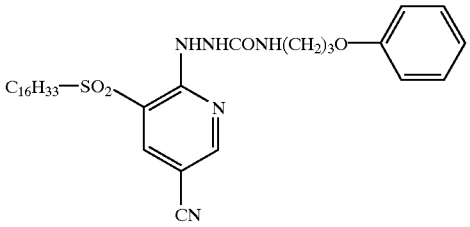
D-112
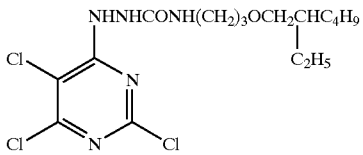
D-113
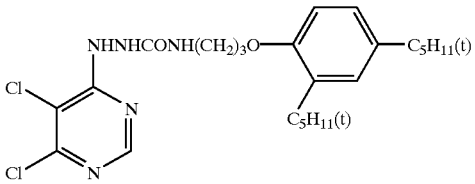
D-114
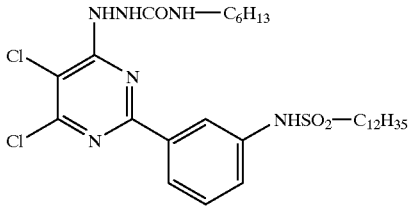
D-115
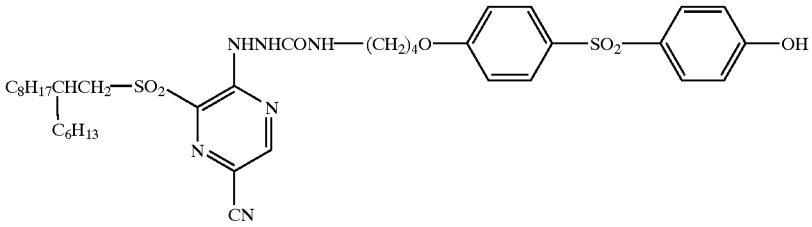
D-116
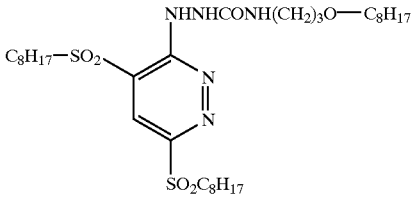
D-117
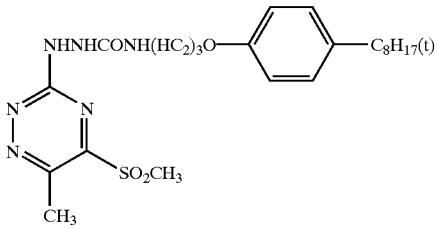
D-118
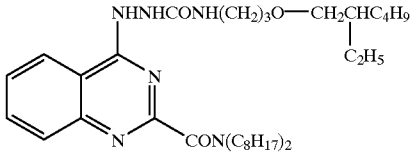
D-119
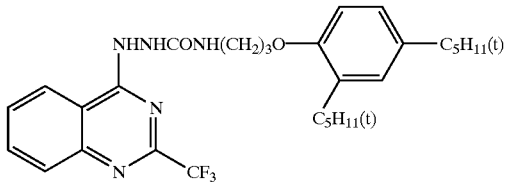
D-120
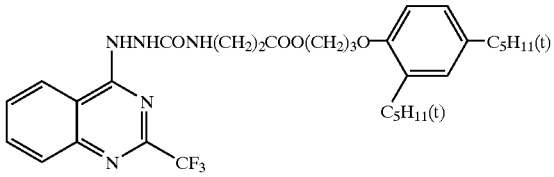
D-121
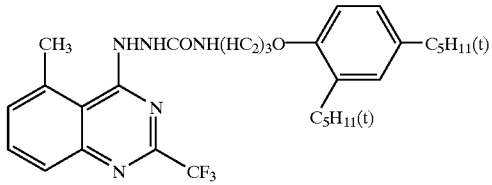
D-122
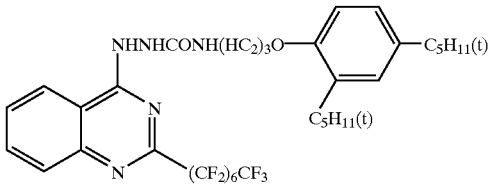
D-123
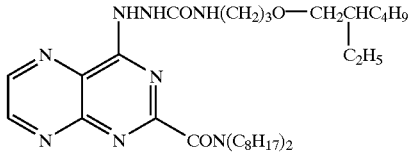

-continued
D-124
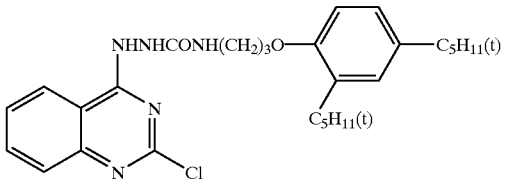
D-125
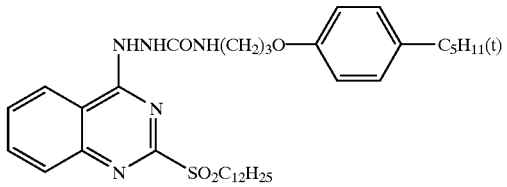
D-126
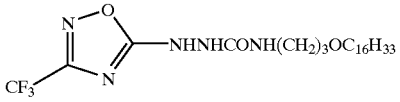
D-127
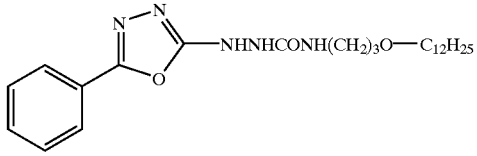
D-128
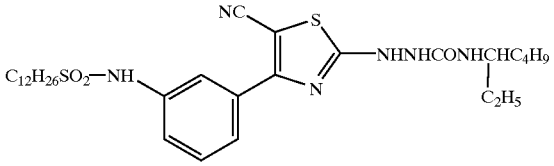
D-129
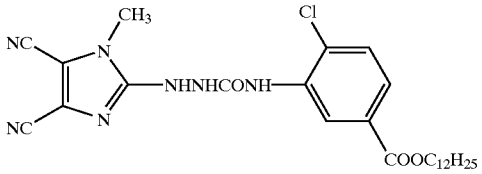
D-130
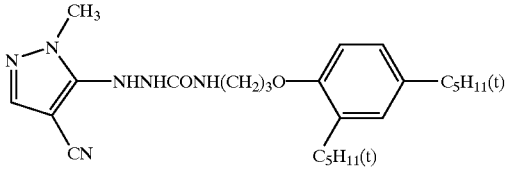
D-131
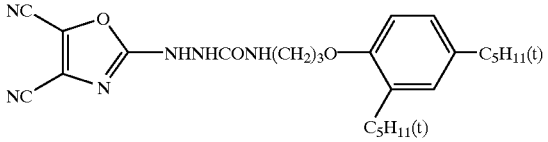
D-132
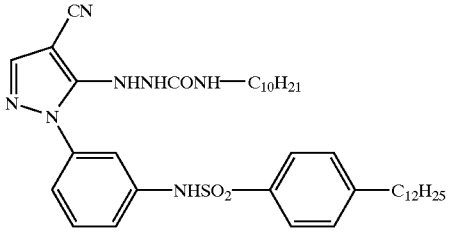
D-133
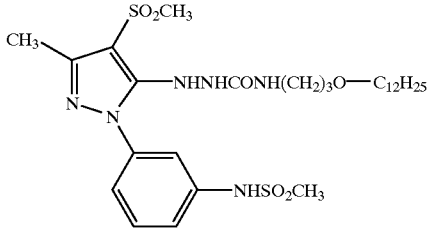
D-134
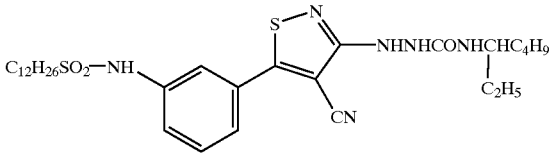
D-135
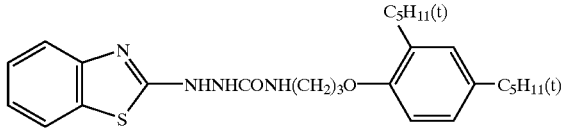
D-136
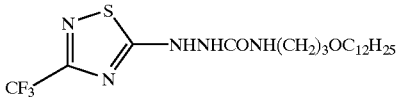
D-137
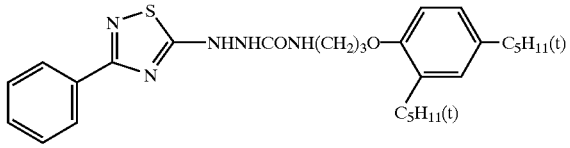
D-138
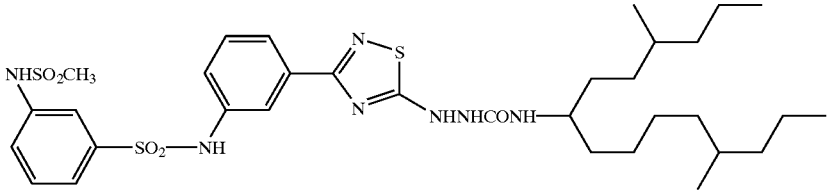

-continued
D-139
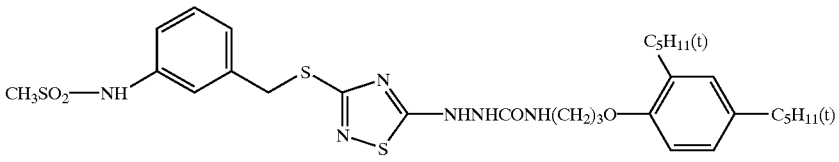
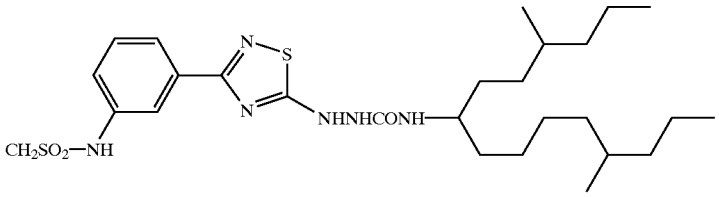
D-141
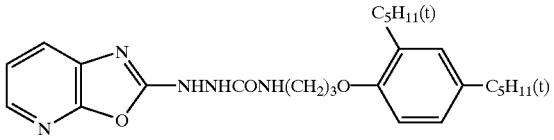
D-142
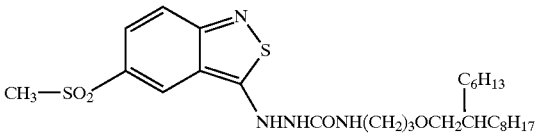
D-143
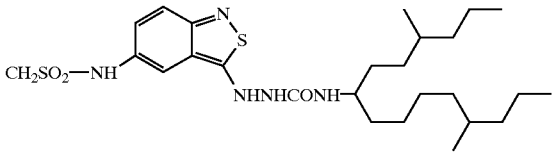
D-144
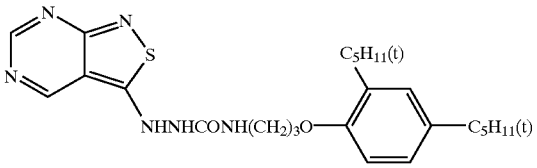
D-145
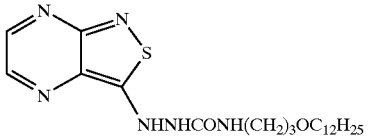
D-146
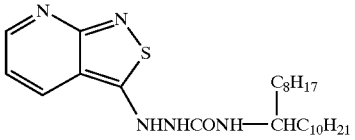
D-147
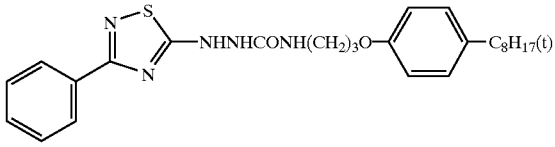
D-148
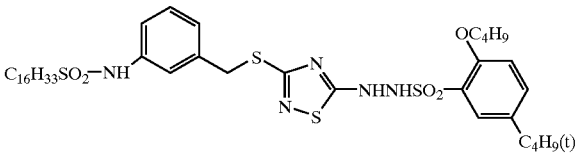
D-149
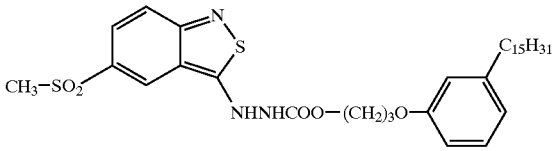
D-150
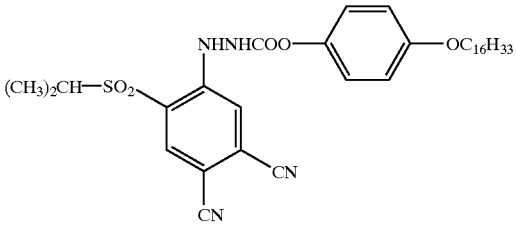
D-151
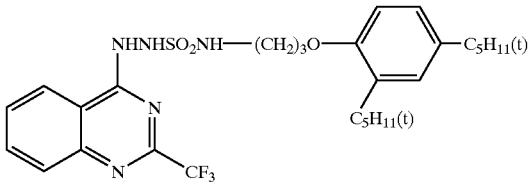
D-152
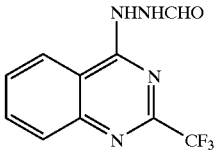

-continued

D-153

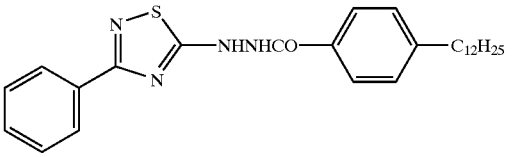

D-154

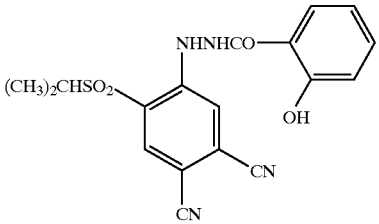

D-155

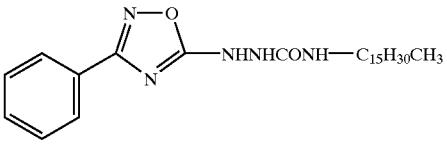

D-156

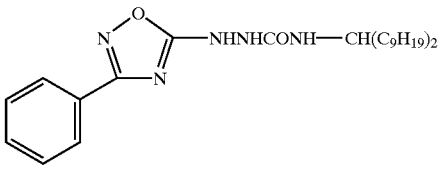

While the amount of the compound represented by the formula (D) maybe selected within a wide range, it is preferably 0.01–100 times, more preferably 0.1–10 times, of silver ions in mole.

The compound represented by the formula (D) may be added in any form, for example, as a solution, powder, solid microparticle dispersion, emulsion, oil-protected dispersion and so forth. Particularly preferably, it is added as a solid microparticle dispersion. The solid microparticle dispersion can be formed by a known pulverization means (for example, a ball mill, vibration ball mill, sand mill, colloid mill, jet mill, roller mill etc.). Further, when solid microparticle dispersion is prepared, a dispersing aid may be used. The solid microparticles have a mean particle size of 0.05–5.0 $\mu$m, preferably 0.1–1 $\mu$m.

The reducing agent used in the present invention may be added to any layers on the same side as the image-forming layer. However, the compounds are preferably added to the image-forming layer or a layer adjacent thereto. The reducing agent may also be a precursor that is derived to effectively function only at the time of development.

In the present invention, conventionally known various reducing agents may be used as an auxiliary reducing agent. As such reducing agents, there can be used, for example, those disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,667,958, 3,679,426, 3,751,252, 3,751,255, 3,761,270, 3,782,949, 3,839,048, 3,928,686 and 5,464,738, German Patent No. 2,321,328, EP692732A and so forth. Specific examples thereof include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with ascorbic acid such as a combination of 2,2-bis (hydroxymethyl) propionyl-β-phenylhydrazine with ascorbic acid; combinations of polyhydroxybenzene with hydroxylamine, reductone and/or hydrazine such as a combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl α-cyano-2-methylphenylacetate and ethyl α-cyanophenyl-acetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl)methane; combinations of a bis-β-naphthol with a 1,3-dihydroxybenzene derivative such as 2,4-dihydroxybenzophenone and 2,4-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-dione etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl) methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; chromanols such as tocopherol and so forth. Among these, preferred reducing agents are hindered phenols.

In the present invention, a halogen precursor is preferably used. The halogen precursor that can be used in the present invention will be explained hereafter. The halogen precursor used in the present invention is a compound that can release a halogen by an action of heat or light. Compounds having such a function are organic polyhalogenated compounds having two or more halogen atoms on the same carbon atom in the molecule. Examples thereof include, those compounds disclosed in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-6-208193, JP-A-7-5621, JP-A-7-2781, JP-A-8-15809 and U.S. Pat. Nos. 5,340,712, 5,369,000 and 5,464,737.

Halogen precursors preferably used for the present invention are those compounds represented by the following formula (H).

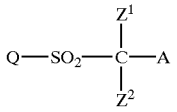

(H)

In the formula (H), Q represents an aryl group or a heterocyclic group, both of which may have one or more substituents. $Z^1$ and $Z^2$ each independently represent a halogen atom. A represents a hydrogen atom or an electron withdrawing group.

In the formula (H), the aryl group represented by Q is preferably a monocyclic or condensed ring aryl group having 6–30 carbon atoms, preferably a monocyclic or condensed ring aryl group having 6–20 carbon atoms. For example, it may be phenyl group, naphithyl group or the like, particularly preferably phenyl group.

In the formula (H), the heterocyclic group represented by Q is 3- to 10-membered, saturated or unsaturated heterocyclic group containing at least one atom selected from nitrogen (N) oxygen (O) and sulfur (S). The heterocyclic group may be monocyclic or may form a condensed ring with another ring or other rings.

Illustrative examples of the heterocyclic group include thienyl, furyl, pyrrolyl, pyrazolyl, pyridyl, pyrazinyl, pyrimidinyl, pyridazinyl, indolizinyl, isoindolizinyl, 3H-indolyl, indolyl, 1H-indazolyl, purinyl, 4H-quinolizinyl, isoquinolyl, quinolyl, phthalazinyl, naphthyridinyl, quinoxalinyl, quinazolinyl, cinnolinyl, pteridinyl, carbazolyl, β-carbonylyl, phenanthridinyl, acridinyl, perimidinyl, phenanthrolinyl, phenazinyl, phenarsazinyl, phenothiazinyl, furazanyl, phenoxazinyl, isochromanyl, chromanyl, pyrrolidinyl, pyrrolinyl, imidazolidinyl, imidazolinyl, pyrazolidinyl, pyrazolinyl, piperidyl, piperazinyl, indolinyl, isoindolinyl, quinuclidinyl, morpholinyl, triazolyl, tetrazolyl, thiadiazolyl, benzimidazolyl, benzoxazolyl, benzothiazolyl, benzotriazolyl, triazinyl, uracil, triazopyrimidinyl and so forth. Preferably, Q is thienyl, pyridyl, isoquinolyl, quinolyl, triazolyl, benzimidazolyl or benzothiazolyl.

In the formula (H), the aryl group or heterocyclic group represented by Q may have a substituent other than the $—SO_2—C(Z^1)(Z^2)A$ group. Any generally known substituents may be used so long as they do not adversely affect the photographic performance. Examples of the substituent include, for example, a linear, branchedor cyclic alkyl group having preferably 1–20, more preferably 1–12, particularly preferably 1–4 carbon atoms (for example, methyl, ethyl, iso-propyl, t-butyl, n-octyl, t-amyl, cyclohexyl etc.), an alkenyl group having preferably 2–20, more preferably 2–12, particularly preferably 2–8 carbon atoms (for example, vinyl, allyl, 2-butenyl, 3-pentenyl etc.), an alkynyl group having preferably 2–20, more preferably 2–12, particularly preferably 2–8 carbon atoms (for example, propargyl, 3-pentynyl etc.), an aryl group having preferably 6–30, more preferably 6–20, particularly preferably 6–12 carbon atoms (for example, phenyl, p-methylphenyl, naphthyl etc.), an amino group having preferably 0–20, more preferably 0–10, particularly preferably 0–6 carbon atoms (for example, amino, methylamino, dimethylamino, diethylamino, dibenzylamino etc.) an alkoxy group having preferably 1–20, more preferably 1–12, particularly preferably 1–8 carbon atoms (for example, methoxy, ethoxy, butoxy etc.), an aryloxy group having preferably 6–20, more preferably 6–16, particularly preferably 6–12 carbon atoms (for example, phenyloxy, 2-naphthyloxy etc.), an acyl group having preferably 1–20, more preferably 1–16, particularly preferably 1–12 carbon atoms (for example, acetyl, benzoyl, formyl, pivaloyl etc.), an alkoxycarbonyl group having preferably 2–20, more preferably 2–16, particularly preferably 2–12 carbon atoms (for example, methoxycarbonyl, ethoxycarbonyl etc.), an aryloxycarbonyl group having preferably 7–20, more preferably 7–16, particularly preferably 7–10 carbon atoms (for example, phenoxycarbonyl etc.), an acyloxy group having preferably 1–20, more preferably 2–16, particularly preferably 2–10 carbon atoms (for example, acetoxy, benzoyloxy etc.), an acylamino group having preferably 1–20, more preferably 2–16, particularly preferably 2–10 carbon atoms (for example, acetylamino, benzoylamino etc.), an alkoxycarbonylamino group having preferably 2–20, more preferably 2–16, particularly preferably 2–12 carbon atoms (for example, methoxycarbonylamino etc.), an aryloxycarbonylamino group having preferably 7–20, more preferably 7–16, particularly preferably 7–12 carbon atoms (for example, phenyloxycarbonylamino etc.), a sulfonylamino group having preferably 1–20, more preferably 1–16, particularly preferably 1–12 carbon atoms (for example, methanesulfonylamino, benzenesulfonylamino etc.), a sulfamoyl group having preferably 0–20, more preferably 0–16, particularly preferably 0–12 carbon atoms (for example, sulfamoyl, methylsulfamoyl, dimethylsulfamoyl, phenylsulfamoyl etc.), a carbamoyl group having preferably 0–20, more preferably 0–16, particularly preferably 0–12 carbon atoms (for example, carbamoyl, diethylcarbamoyl, phenylcarbamoyl etc.), a ureido group having preferably 1–20, more preferably 1–16, particularly preferably 1–12 carbon atoms (for example, ureido, methylureido, phenylureido etc.), an alkylthio group having preferably 1–20, more preferably 1–16, particularly preferably 1–12 carbon atoms (for example, methylthio, ethylthio etc.), an arylthio group having preferably 6–20, more preferably 6–16, particularly preferably 6–12 carbon atoms (for example, phenylthio etc.), a sulfonyl group having preferably 1–20, more preferably 1–16, particularly preferably 1–12 carbon atoms (for example, mesyl, benzenesulfonyl, tosyl etc.), a sulfinyl group having preferably 1–20, more preferably 1–16, particularly preferably 1–12 carbon atoms (for example, methanesulfinyl, benzenesulfinyl etc.), a phosphoramide group having preferably 1–20, more preferably 1–16, particularly preferably 1–12 carbon atoms (for example, diethylphosphoramide, phenylphosphoramide etc.), hydroxy group, mercapto group, a halogen atom (for example, fluorine atom, chlorine atom, bromine atom, iodine atom), cyano group, sulfo group or a salt thereof, carboxyl group or a salt thereof, nitro group, hydroxamic group, sulfino group, hydrazino group, sulfonylthio group, thiosulfonyl group, a heterocyclic group (for example, imidazolyl, pyridyl, furyl, piperidyl, morpholyl etc.), disulfide group, a polyethyleneoxy group, a quaternary ammonium group and so forth. These substituents may further be substituted.

$Z^1$ and $Z^2$ each independently represent a halogen atom, preferably bromine atom.

A represents a hydrogen atom or an electron withdrawing group, preferably a hydrogen atom or bromine atom, particularly preferably bromine atom.

These compounds may be used as a combination of two or more kinds of the compounds.

Specific examples of the halogen-releasing precursor represented by the formula (H) will be shown below. However, the scope of the present invention is not limited to these examples.

II-1
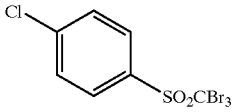
II-2
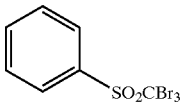
II-3
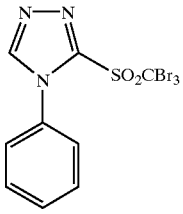
II-4
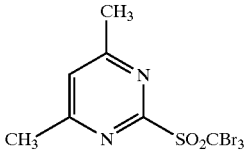
II-5
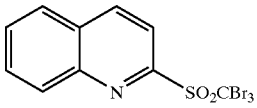
II-6
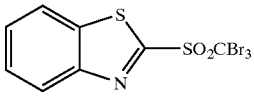
II-7
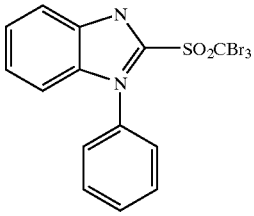
II-8
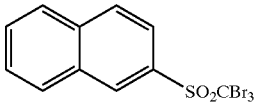
II-9
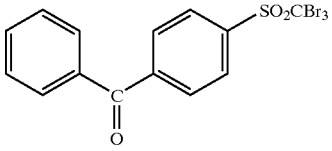
II-10
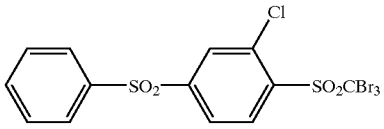
-continued
II-11
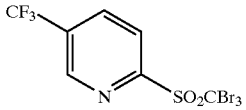
II-12
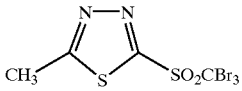
II-13
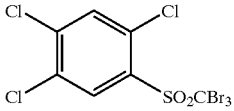
II-14
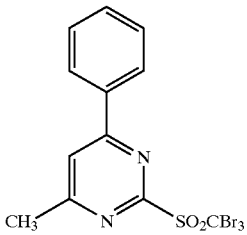
II-15
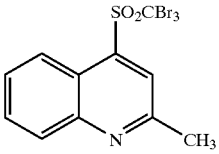
II-16
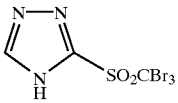
II-17
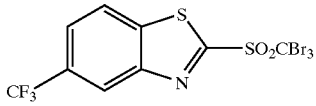
II-18
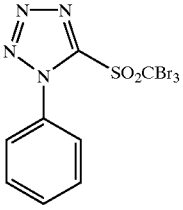
II-19
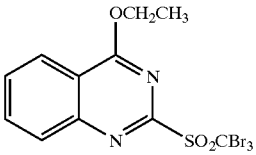
II-20
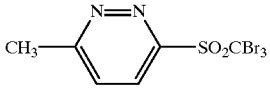
II-21
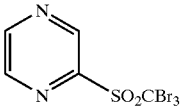

-continued

II-22

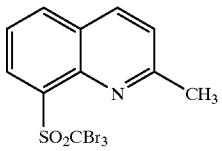

II-23

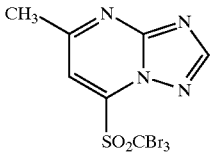

II-24

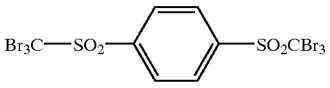

II-25

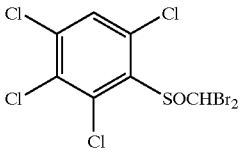

II-26

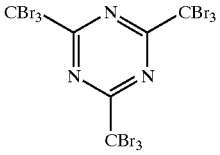

II-27

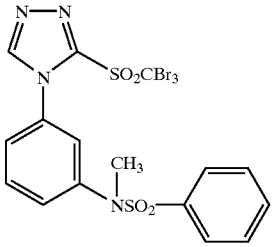

II-28

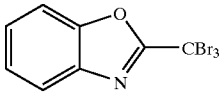

II-29

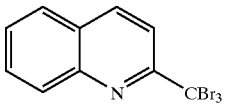

II-30

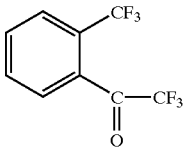

-continued

II-31

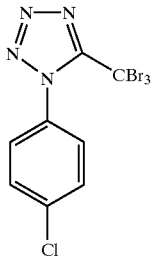

II-32

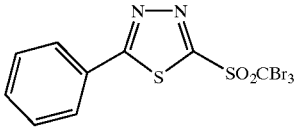

II-33

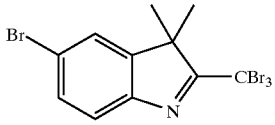

II-34

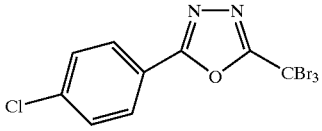

II-35

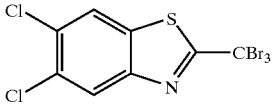

II-36

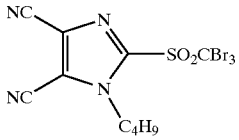

II-37

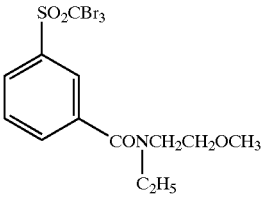

II-38

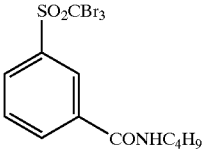

The halogen-releasing precursor represented by the formula (H) is used in a desired amount for obtaining desired performance such as sensitivity and fog. However, it is preferably used in an amount of $10^{-4}$ to 1 mole, more preferably $10^{-3}$ to $5\times10^{-1}$ mole, per mole of non-photosensitive silver salt in the image-forming layer.

The halogen-releasing precursor represented by the formula (H) may be dissolved in water or an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve and added to a coating solution, so that it should be present in films as microcrystals in films after drying. Alternatively, the halogen-releasing precursor represented by the formula (H) may also be used as an emulsified dispersion mechanically prepared according to a known emulsification dispersion method by using an oil such as dibutyl phthalate, tricresyl phosphate, glyceryl triacetate or diethyl phthalate, ethyl acetate or cyclohexanone as an auxiliary solvent for dissolution. Or, the halogen-releasing precursor represented by the formula (H) may be added to a coating solution as a fine solid dispersion in a suitable solvent such as water prepared by using a known dispersing machine such as ball mill, colloid mill and sand grinder mill, or a dispersing machine utilizing ultrasonic wave, and dispersion medium such as glass beads, zirconia beads and zircon silicate beads according to a known method for solid dispersion.

The halogen-releasing precursor is particularly preferably added as a solid dispersion. Addition as preliminarily prepared fine solid dispersion is preferred, because it enables addition of the precursor having stably uniform particle size, and thus aggregation thereof in a coating solution or fluctuation of performance can be avoided. In particular, when an aqueous dispersion of thermoplastic resin is used as the binder of the photosensitive image-forming layer, the addition of solid dispersion is most preferred. In this case, the reducing agent is also preferably added as solid dispersion. The halogen-releasing precursor particles in the solid dispersion preferably have a mean particle size of 0.05–5 $\mu$m, more preferably 0.1–1 $\mu$m. The reducing agent particles in the solid dispersion preferably have a mean particle size of 0.05–5 $\mu$m, more preferably 0.1–1 $\mu$m.

The halogen-releasing precursor used for the present invention may be used as a combination of two or more kinds of the compound. The halogen-releasing precursor is preferably contained in the photothermographic image-recording layer, intermediate layer or protective layer. It is particularly preferably contained in the photothermographic image-recording layer.

In the present invention, an ultrahigh contrast agent is preferably used. An ultrahigh contrast agent can provide ultrahigh contrast images preferred as images for plate making. While various ultrahigh contrast agents have been conventionally known for wet type development, ultrahigh contrast agents mentioned below can be preferably used for the thermally processed image-recording material of the present invention.

As the ultrahigh contrast agent that can be used for the present invention, various known compounds can be used. There have been known, for example, hydrazine compounds such as those compounds disclosed in U.S. Pat. Nos. 5,464,738, 5,496,695, 5,512,411, 5,536,622, Japanese Patent Publication (Kokoku, hereinafter referred to as JP-B) 6-77138, JP-B-6-93082, JP-A-6-230497, JP-A-6-289520, JP-A-6-313951, JP-A-7-5610, JP-A-77783, JP-A-7-104426 and so forth; the acrylonitrile derivatives disclosed in U.S. Pat. Nos. 5,545,515 and 5,635,339; the malondialdehydes disclosed in U.S. Pat. No. 5,654,130; the isoxazoles disclosed in U.S. Pat. No. 5,705,339 and so forth. As development accelerators, there have been known the amine compounds disclosed in U.S. Pat. No. 5,545,505, the hydroxamic acids disclosed in U.S. Pat. No. 5,545,507, the hydrogen donors disclosed in U.S. Pat. No. 5,637,449 and so forth. Those known materials can be used for the present invention. Particularly preferred are compounds selected from substituted alkene derivatives, substituted isooxazole derivatives, and acetal compounds, which are represented by the following formulas (11) to (13).

(11)

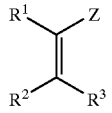

(12)

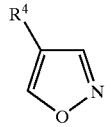

(13)

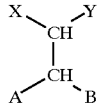

In the formula (11), $R^1$, $R^2$ and $R^3$ each independently represents a hydrogen atom or a substituent, Z represents an electron withdrawing group. In the formula (11), $R^1$ and Z, $R^2$ and $R^3$, $R^1$ and $R^2$, or $R^3$ and Z may be combined with each other to form a ring structure. In the formula (12), $R_4$ represents a substituent. In the formula (13), X and Y each independently represents a hydrogen atom or a substituent, A and B each independently represents an alkoxy group, an alkylthio group, an alkylamino group, an aryloxy group, an arylthio group, an anilino group, a heterocyclyloxy group, a heterocyclylthio group or a heterocyclylamino group. In the formula (13), X and Y, or A and B may be combined with each other to form a ring structure.

Examples of the substituent represented by $R^1$, $R^2$ or $R^3$ in the formula (11) include, for example, a halogen atom (e.g., fluorine, chlorine, bromide, iodine atoms), an alkyl group (including an aralkyl group, a cycloalkyl group and active methine group), an alkenyl group, an alkynyl group, an aryl group, a heterocyclic group (including N-substituted nitrogen-containing heterocyclic group), a quaternized nitrogen-containing heterocyclic group (e.g., pyridinic group), an acyl group, an alkoxycarbonyl group, an aryloxycarbonyl group, a carbamoyl group, a carboxy group or a salt thereof, an imino group, an imino group substituted by N atom, a thiocarbonyl group, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxyl group (or a salt thereof), an alkoxy group (including a group containing an ethyleneoxy group or propyleneoxy group repeating unit), an aryloxy group, a heterocyclyloxy group, an acyloxy group, an (alkoxy or aryloxy)carbonyloxy group, a carbamoyloxy group, a sulfonyloxy group, an amino group, an (alkyl, aryl or heterocyclyl)amino group, an acylamino group, a sulfonamido group, a ureido group, a thioureido group, an imido group, an (alkoxy or aryloxy) carbonylamino group, a sulfamoylamino group, a semicarbazide group, a thiosemicarbazide group, a hydrazino group, a quaternary ammonio group, an oxamoylamino group, an (alkyl or aryl)sulfonylureido group, an acylureido group, an acylsulfamoylamino group, a nitro group, a mercapto group, an (alkyl, aryl or heterocyclyl)thio group, an acylthio group, an (alkyl or aryl)sulfonyl group, an (alkyl or aryl) sulfinyl group, a sulfo group or a salt thereof, a sulfamoyl group, an acylsulfamoyl group, a sulfonylsulfamoyl group or a salt thereof, a phosphoryl group, a group containing phosphoramide or phosphoric acid ester structure, a silyl group and a stannyl group. These substituents each may further have a substituent selected from these substituents.

The electron withdrawing group represented by Z in the formula (11) is a substituent having a Hammett's substituent constant σp of a positive value, and specific examples thereof include a cyano group, an alkoxycarbonyl group, an aryloxycarbonyl group, a carbamoyl group, an imino group, an imino group substituted at N atom, a thiocarbonyl group, a sulfamoyl group, an alkylsulfonyl group, an arylsulfonyl group, a nitro group, a halogen atom, a perfluoroalkyl group, a perfluoroalkanamido group, a sulfonamido group, an acyl group, a formyl group, a phosphoryl group, a carboxyl group, a sulfo group (or a salt thereof), aheterocyclic group, an alkenyl group, an alkynyl group, an acyloxy group, an acylthio group, a sulfonyloxy group and an aryl group substituted with any one of the above-described electron withdrawing groups. The heterocyclic group is a saturated or unsaturated heterocyclic group, and examples thereof include a pyridyl group, a quinolyl group, a pyrazinyl group, a benzotriazolyl group, an imidazolyl group, a benzimidazolyl group, a hydantoin-1-yl group, a urazol-1-yl group, a succinimido group and a phthalimido group. The electron withdrawing group represented by Z in the formula (11) may further have a substituent The electron withdrawing group represented by Z in the formula (11) may preferably be a group having a total carbon atom number of from 0 to 30 such as cyano group, an alkoxycarbonyl group, an aryloxycarbonyl group, a carbamoyl group, a thiocarbonyl group, an imino group, an imino group substituted at N atom, a sulfamoyl group, an alkylsulfonyl group, an arylsulfonyl group, a nitro group, a perfluoroalkyl group, an acyl group, a formyl group, a phosphoryl group, an acyloxy group, an acylthio group or a phenyl group substituted with one or more arbitrary electron withdrawing groups, more preferably cyano group, an alkoxycarbonyl group, a carbamoyl group, a thiocarbamoyl group, an imino group, an imino group substituted at N atom, a sulfamoyl group, an alkylsulfonyl group, an arylsulfonyl group, an acyl group, a formyl group, a phosphoryl group, a trifluoromethyl group, or a phenyl group substituted with one or more arbitrary electron withdrawing group, particularly preferably cyano group, an alkoxycarbonyl group, a carbamoyl group, an imino group, an imino group substituted at N atom, an alkylsulfonyl group, an arylsulfonyl group, an acyl group or formyl group.

The substituent represented by $R^1$ in the formula (11) may preferably be a group having a total carbon atom number of from 0 to 30, and specific examples of the group include the same groups as those explained as the electron withdrawing group represented by Z in the formula (11), as well as an alkyl group, an alkenyl group, an alkoxy group, an aryloxy group, a heterocyclyloxy group, an alkylthio group, an arylthio group, a heterocyclylthio group, an amino group, an alkylamino group, an arylamino group, a heterocyclylamino group, a ureido group, an acylamino group, a silyl group and a substituted or unsubstituted aryl group, more preferably the same groups as those explained as the electron withdrawing group represented by Z in the formula (11), a substituted or unsubstituted aryl group, alkenyl group, alkylthio group, arylthio group, alkoxy group, silyl group and acylamino group, further preferably an electron withdrawing group, an aryl group, an alkenyl group and an acylamino group.

When $R^1$ represents an electron withdrawing group, the preferred scope thereof is the same as the preferred scope of the electron withdrawing group represented by Z.

The substituents represented by $R^2$ and $R^3$ in the formula (11) may preferably be the same groups as those explained as the electron withdrawing group represented by Z in the formula (11), as well as an alkyl group, hydroxyl group (or a salt thereof) mercapto group (or a salt thereof), an alkoxy group, an aryloxy group, a heterocyclyloxy group, an alkylthio group, an arylthio group, a heterocyclylthio group, an amino group, an alkylamino group, an aniline group, a heterocyclylamino group, an acylamino group, a substituted or unsubstituted phenyl group and so forth. It is more preferred that one of R and R is a hydrogen atom and the other is a substituent. In this case, the substituent may preferably be an alkyl group, hydroxyl group (or a salt thereof), mercapto group (or a salt thereof), an alkoxy group, an aryloxy group, a heterocyclyloxy group, an alkylthio group, an arylthio group, a heterocyclylthio group, an amino group, an alkylamino group, an anilino group, a heterocyclylamino group, an acylamino group (particularly, a perfluoroalkanamido group), a sulfonamido group, a substituted or unsubstituted phenyl group, a heterocyclic group or the like, more preferably hydroxyl group (or a salt thereof), mercapto group (or a salt thereof), an alkoxy group, an aryloxy group, a heterocyclyloxy group, an alkylthio group, an arylthio group, a heterocyclylthio group, an amino group or a heterocyclic group, particularly preferably hydroxyl group (or a salt thereof), an alkoxy group or a heterocyclic group.

In the formula (11), it is also preferred that Z together with $R^1$ or $R^2$ together with $R^3$ form a ring structure. The ring structure formed is a non-aromatic carbon ring or a non-aromatic heterocycle, preferably a 5- to 7-membered ring structure having a total carbon atom number, including those of substituents thereon, of from 1 to 40, more preferably from 3 to 35.

The compound represented by the formula (11) is more preferably a compound wherein Z represents cyano group, a formyl group, an acyl group, an alkoxycarbonyl group, an imino group or a carbamoyl group, $R^1$ represents an electron withdrawing group, and one of $R^2$ and $R^3$ represents a hydrogen atom and the other represents a hydroxyl group (or a salt thereof), mercapto group (or a salt thereof), an alkoxy group, an aryloxy group, a heterocyclyloxy group, an alkylthio group, an arylthio group, a heterocyclylthio group, an amino group or a heterocyclic group.

A class of most preferable compounds represented by the formula (11) are constituted by those wherein Z and $R^1$ combine with each other to form a non-aromatic 5- to 7-membered ring structure, and one of $R^2$ and $R^3$ represents a hydrogen atom and the other represents hydroxyl group (or a salt thereof), mercapto group (or a salt thereof), an alkoxy group, an aryloxy group, a heterocyclyloxy group, an alkylthio group, an arylthio group, a heterocyclylthio group, an amino group or a heterocyclic group.

Specific examples of the 5- to 7-membered non-aromatic cyclic structure formed by Z and $R^1$ are, for example, indane-1,3-dione ring, pyrrolidine-2,4-dione ring, pyrazolidine-3,5-dione ring, oxazolidine-2,4-dione ring, 5-pyrazolone ring, imidazolidine-2,4-dione ring, thiazolidine-2,4-dione ring, oxolane-2,4-dione ring, thiolane-2,4-dione ring, 1,3-dioxane-4,6-dione ring, cyclohexane-1,3-dione ring, 1,2,3,4-tetrahydroquinoline-2,4-dione ring, cyclopentane-1,3-dione ring, isoxazolidine-3,5-dione ring, barbituric acid ring, 2,3-dihydrobenzofuran-3-one ring, pyrazolotriazole ring (for example, 7H-pyrazolo[1,5-b][1,2,4]triazole, 7H-pyrazolo[5,1-c][1,2,4]triazole, 7H-pyrazolo[1,5-a]benzimidazole etc.), pyrrolotriazole ring (for example, 5H-pyrrolo[1,2-b][1,2,4]-triazole, 5H-pyrrolo

[2,1-c][1,2,4]triazole etc.), 2-cyclopentene-1,3-dione ring, 2,3-dihydrobenzothiophen-3-one-1,1-dioxide ring, chroman-2,4-dione ring, 2-oxazolin-5-one ring, and so forth. Among these, preferred are indane-1,3-dione ring, pyrrolidine-2,4-dione ring, pyrazolidine-3,5-dione ring, 5-pyrazolone ring, barbituric acid ring, 2-oxazolin-5-one ring and so forth.

In the formula (12), examples of the substituent represented by $R^4$ include those explained as the substituent represented by $R^1$, $R^2$ or $R^3$ in the formula (11).

The substituent represented by R in the formula (12) may preferably be an electron withdrawing group or an aryl group. Where $R^{14}$ represents an electron withdrawing group, the electron withdrawing group may preferably be a group having a total carbon atom number of from 0 to 30, such as cyano group, nitro group, an acyl group, a formyl group, an alkoxycarbonyl group, an aryloxycarbonyl group, an alkylsulfonyl group, an arylsulfonyl group, a carbamoyl group, a sulfamoyl group, a perfluoroalkyl group, a phosphoryl group, an imino group, a sulfonamide group, or a heterocyclic group, more preferably cyano group, an acyl group, a formyl group, an alkoxycarbonyl group, a carbamoyl group, a sulfamoyl group, an alkylsulfonyl group, an arylsulfonyl group, a sulfonamide group or a heterocyclic group.

Where $R^4$ represents an aryl group, the aryl group may preferably be a substituted or unsubstituted phenyl group having a total carbon atom number of from 6 to 30. Examples of the substituent include those described as the substituent represented by $R^1$, $R^2$ or $R^3$ in the formula (11). An electron withdrawing group is preferred.

Examples of the substituent represented by X or Y in the formula (13) include those described as the substituent represented by $R^1$, $R^2$ or $R^3$ in the formula (11). The substituent represented by X or Y may preferably be a substituent having a total carbon number of from 1 to 50, more preferably from 1 to 35, such as cyano group, an alkoxycarbonyl group, an aryloxycarbonyl group, a carbamoyl group, an imino group, an imino group substituted at N atom, a thiocarbonyl group, a sulfamoyl group, an alkylsulfonyl group, an arylsulfonyl group, nitro group, aperfluoroalkyl group, an acyl group, a formyl group, a phosphoryl group, an acylamino group, an acyloxy group, an acylthio group, a heterocyclic group, an alkylthio group, an alkoxy group, an aryl group or the like, more preferably cyano group, nitro group, an alkoxycarbonyl group, a carbamoyl group, an acyl group, a formyl group, an acylthio group, an acylamino group, a thiocarbonyl group, a sulfamoyl group, an alkylsulfonyl group, an arylsulfonyl group, an imino group, an imino group substituted at N atom, a phosphoryl group, a trifluoromethyl group, a heterocyclic group, a substituted phenyl group or the like, particularly preferably cyano group, an alkoxycarbonyl group, a carbamoyl group, an alkylsulfonyl group, an arylsulfonyl group, an acyl group, an acylthio group, an acylamino group, a thiocarbonyl group, a formyl group, an imino group, an imino group substituted atN atom, aheterocyclic group, a phenyl group substituted by an arbitrary electron withdrawing group or the like.

X and Y may also preferably combine with each other to form a non-aromatic carbon ring or a non-aromatic heterocycle. The ring structure formed is preferably a 5- to 7-membered ring. Examples of the ring structure formed by X and Y are similar to those exemplified for the non-aromatic 5- to 7-membered ring that can be formed by Z and $R^1$ bonded together in the formula (11), and the preferred scope thereof if also similar to that of the ring structure formed by Z and $R^1$. Those rings may further have a substituent, and the total carbon atom number thereof is from 1–40, more preferably from 1–35.

The substituents represented by A and B in the formula (13) may further have one or more substituents, and they are preferably groups having a total carbon atom number of from 1 to 40, more preferably from 1 to 30.

In the formula (13), A and B more preferably combine with each other to form a ring structure. The ring structure formed is preferably a 5- to 7-membered non-aromatic heterocycle having a total carbon atom number of from 1 to 40, more preferably from 3 to 30. Examples of a structure formed by the linking of A and B (—A—B—) include —O—$(CH_2)_2$—O—, —O—$(CH_2)_3$—O—, —S—$(CH_2)_2$—S—, —S—$(CH_2)_3$—S—, —S—Ph—S—, —N$(CH_3)$—$(CH_2)_2$—O—, —O—$(CH_2)_3$—S—, —N$(CH_3)$—Ph—S—, —N(Ph)—$(CH_2)_2$—S— and so forth.

The compounds represented by the formulas (11) to (13) for use in the present invention may be introduced with a group capable of adsorbing to silver halide. They may also be introduced with a ballast group or a polymer commonly used in the field of immobile photographic additives such as a coupler, and they may also contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclyl)thio group, or adissociative group capable of dissociationwith abase (e.g., carboxyl group, sulfo group, an acylsulfamoyl group, a carbamoylsulfamoyl group). Examples of compounds having such groups include those compounds described in JP-A-63-29751, U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, JP-A-63-234246, JP-A-2-285344, JP-A-1-100530, JP-A-7-234471, JP-A-5-333466, JP-A-6-19032, JP-A-6-19031, JP-A-5-45761, U.S. Pat. Nos. 4,994,365 and 4,988,604, JP-A-7-259240, JP-A-7-5610, JP-A-7-244348 and German Patent No. 4,006,032.

Particularly useful compounds used for the present invention as the ultrahigh contrast agent are the substituted alkene derivatives represented by the formula (11). Among those, further useful compounds are those compounds of the formula (11) wherein Z and $R^1$ combine each other to form a 5- to 7-membered non-aromatic ring structure, and one of $R^2$ and $R^3$ represents a hydrogen atom, and the other represents hydroxyl group (or a salt thereof), mercapto group (or a salt thereof), an alkoxy group, an aryloxy group, a heterocyclyloxy group, an alkylthio group, an arylthio group, a heterocyclylthio group, an amino group or a heterocyclic group.

Specific examples of the compounds represented by the formulas (11) to (13) for use in the present invention are shown below. However, the scope of the present invention is not limited to the following compounds.

1

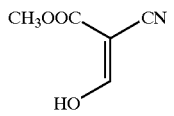

2

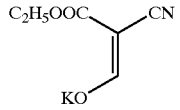

-continued
3
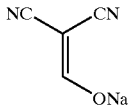
4
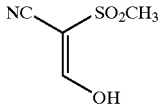
5
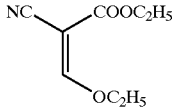
6
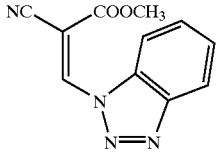
7
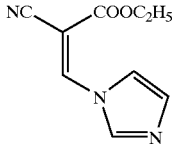
8
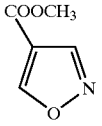
9
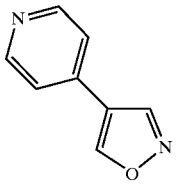
10
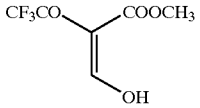
11
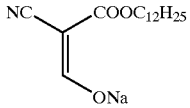
12
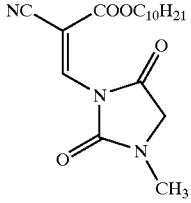
-continued
13
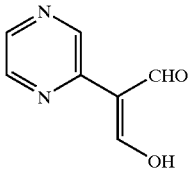
14
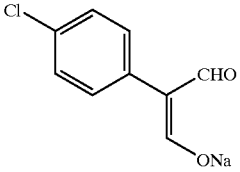
15
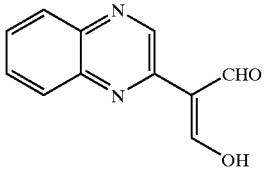
16
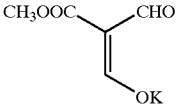
17
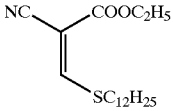
18
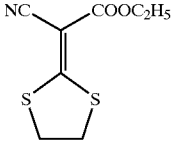
19
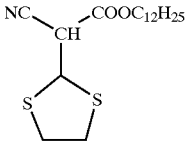
20
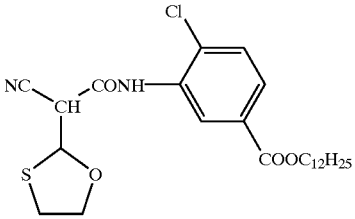
21
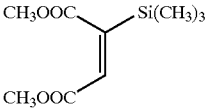
22
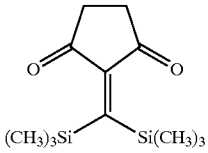

-continued
23
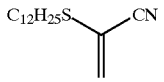
24
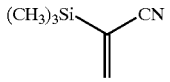
25
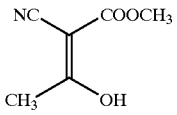
26
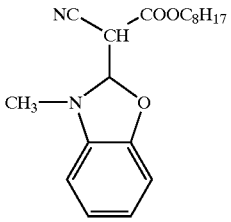
27
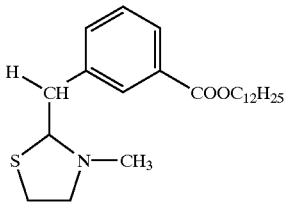
28
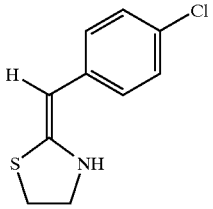
29
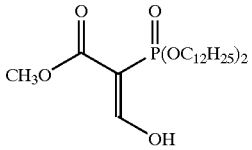
30
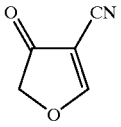
31
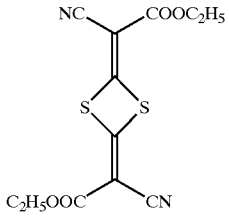
-continued
32
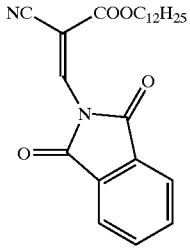
33
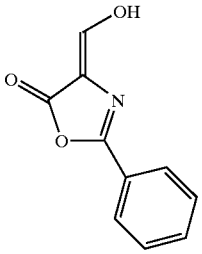
34
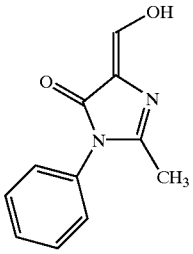
35
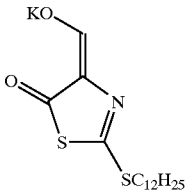
36
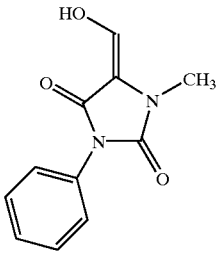
37
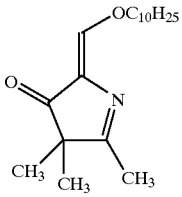

-continued
38
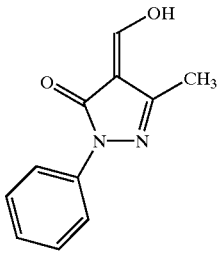
39
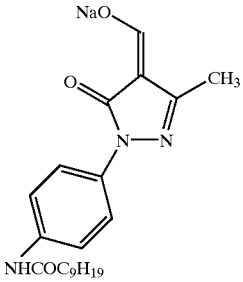
40
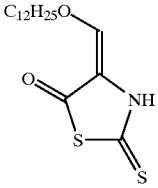
41
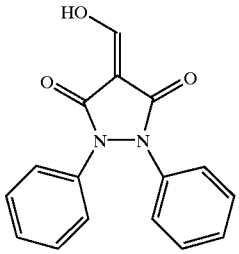
42
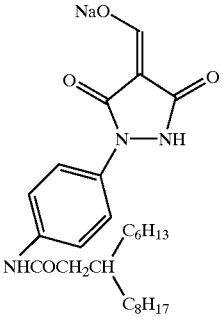
-continued
43
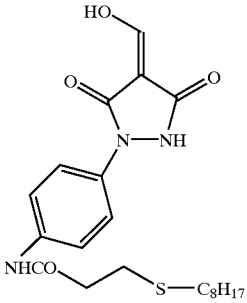
44
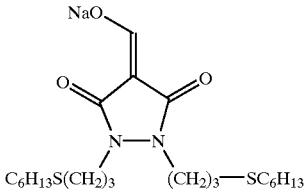
45
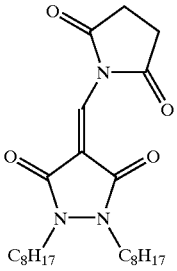
46
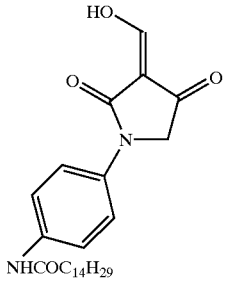
47
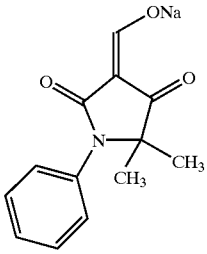
48
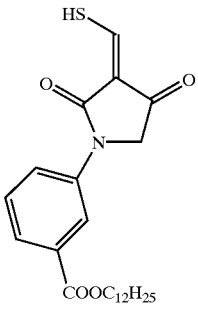

-continued
49
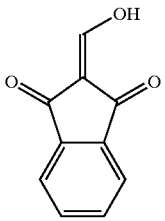
50
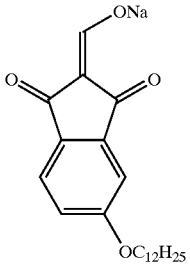
51
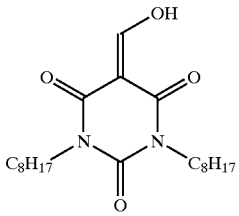
52
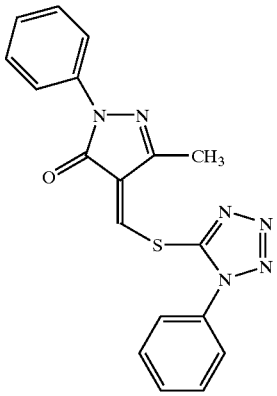
53
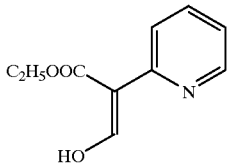
54
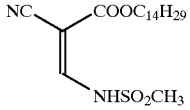
-continued
55
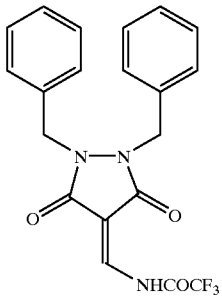
56
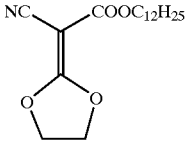
57
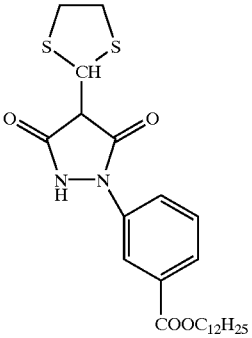
58
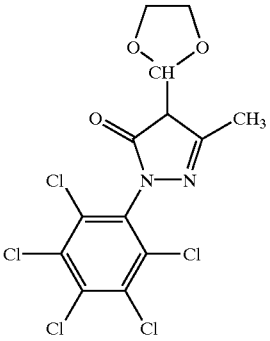
59
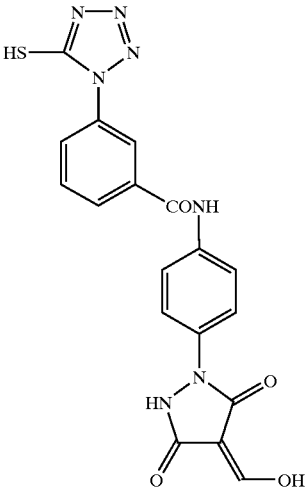

-continued
60
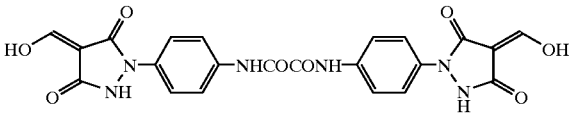
61
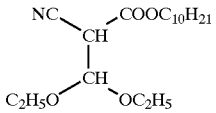
62
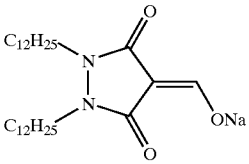
63
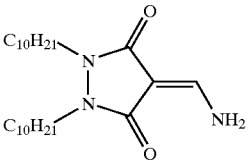
64
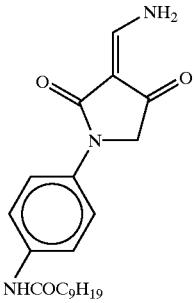
65
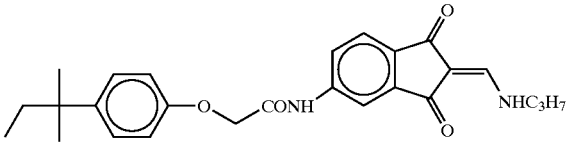
66
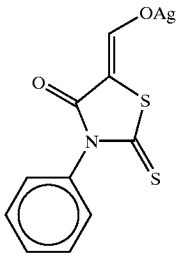
67
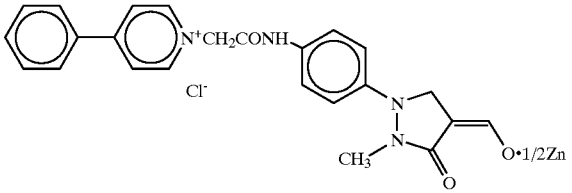
-continued
68
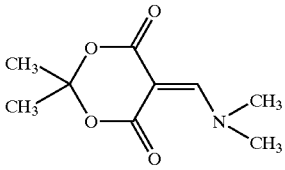
69
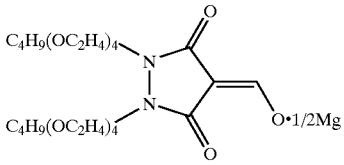
70
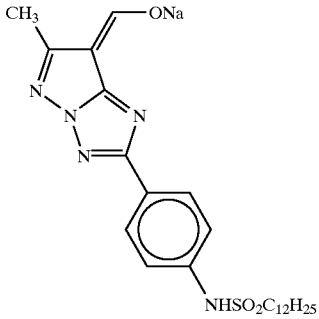
71
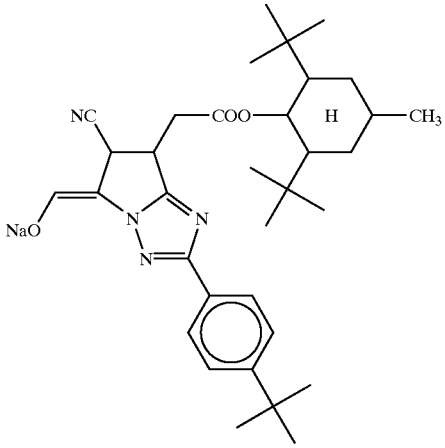
72
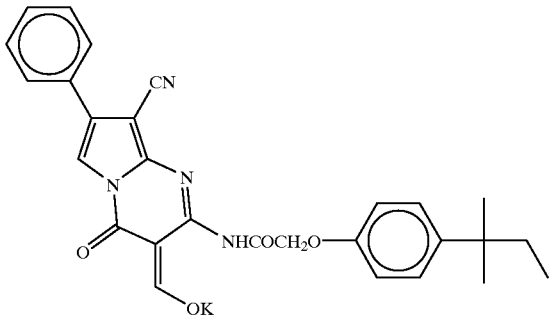
The compounds represented by formulas (11) to (13) can be easily synthesized according to known methods. For example, the compounds may be synthesized by referring to the methods described in U.S. Pat. Nos. 5,545,515, 5,635,339 and 5,654,130, International Patent Publication WO97/

34196 or Japanese Patent Application Nos. 9-354107, JP-A-11-133546 and JP-A-11-95365.

The compounds represented by the formulas (11) to (13) used in the present invention may be used alone or in combination of two or more kinds of compounds. In addition to these compounds, any of the compounds described in U.S. Pat. Nos. 5,545,515, 5,635,339, 5,654,130, 5,705,324, 5,686,228, JP-A-10-161270, JP-A-11-119372, Japanese Patent Application No. 9-354107, JP-A-11-133546, JP-A-11-119373, JP-A-11-109546, JP-A-11-95365, JP-A-11-95366 and JP-A-11-149136 may also be used in combination.

In the present invention, various hydrazine derivatives described in JP-A-10-161270 may be used in combination.

The compounds represented by the formulas (11) to (13) for use in the present invention may be used after being dissolved in water or an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

The compounds may also be used as an emulsified dispersion mechanically prepared according to an already well known emulsification dispersion method by using an oil such as dibutyl phthalate, tricresyl phosphate, glyceryl triacetate or diethyl phthalate, ethyl acetate or cyclohexanone as an auxiliary solvent for dissolution. Alternatively, the hydrazine derivatives may be used after dispersion of a powder of the hydrazine derivatives in a suitable solvent such as water by using a ball mill, a colloid mill or the like, or by means of ultrasonic wave according to a known method for solid dispersion.

The compounds represented by the formulas (11) to (13) for use in the present invention may be added to any layers on a support provided on the side of the image-forming layer, i.e., the image-forming layer and the other layers provided on the same side. The compounds may preferably be added to the image-forming layer or a layer adjacent thereto.

The amount of the compounds represented by the formulas (11) to (13) for use in the present invention is preferably from $1\times10^{-6}$ to 1 mol, more preferably from $1\times10^{-5}$ to $5\times10^{-1}$ mole, most preferably from $2\times10^{-5}$ to $2\times10^{-1}$ mole, per mole of silver.

The photosensitive silver halide used for the present invention will be explained in detail hereafter.

The photosensitive silver halide used for the present invention is not particularly limited as for the halogen composition, and silver chloride, silver chlorobromide, silver bromide, silver iodobromide, silver chloroiodobromide and so forth may be used. The halide composition may have a uniform distribution in the grains, or the composition may change stepwise or continuously in the grains. Silver halide grains having a core/shell structure may also be preferably used. Core/shell grains having preferably a double to quintuple structure, more preferably a double to quadruple structure, may be used. A technique for localizing silver bromide on the surface of silver chloride or silver chlorobromide grains may also be preferably used.

For the preparation of the photosensitive silver halide used for the present invention, methods well known in the art, e.g., the methods described in Research Disclosure, No. 17029 (June, 1978) and U.S. Pat. No. 3,700,458, can be used. More specifically, applicable methods for the present invention include a method comprising a step of adding a halogen-containing compound to an already prepared organic acid silver salt to convert a part of silver of the organic acid silver salt into a photosensitive silver halide, and a method comprising steps of preparing photosensitive silver halide grains by adding a silver-supplying compound and a halogen-supplying compound to a solution of gelatin or another polymer and then mixing the prepared grains with an organic acid silver salt. In particular, the latter method is preferred for the present invention. As for a grain size of the photosensitive silver halide, smaller grains are desirable to prevent cloudiness after image formation. Specifically, the grain size may preferably be not greater than 0.20 $\mu$m, more preferably from 0.01 to 0.15 $\mu$m, further preferably from 0.02 to 0.12 $\mu$m. The term "grain size" used herein means "ridge length" of silver halide grains when the silver halide grains are regular crystals in cubic or octahedral form. Where silver halide grains are tabular grains, the term means the diameter of a circle having the same area as a projected area of the main surface of the tabular grain. Where the silver halide grains are irregular crystals, such as spherical or rod-like grains, the term means the diameter of a sphere having the same volume as the grain.

Examples of the form of silver halide grains include a cubic form, octahedral form, tabular form, spherical form, rod-like form and potato-like form. In particular, cubic grains and tabular grains are preferred for the present invention. When tabular silver halide grains are used, an average aspect ratio is preferably from 100:1 to 2:1, more preferably from 50:1 to 3:1. Silver halide grains having round corners are also preferably used in the present invention. Surface index (Miller index) of outer surfaces of the photosensitive silver halide grains is not particularly limited. However, it is desirable that [100] face be present in a high proportion, which can achieve high spectral sensitizing efficiency when a spectral sensitizing dye adsorbed thereto. The proportion of [100] face is preferably 50% or more, more preferably 65% or more, further preferably 80% or more.

The photosensitive silver halide for use in the present invention preferably contains a metal of Group VII or VIII in the periodic table of elements, or metal complex thereof. The metal of Group VII or VIII of the periodic table or center metal of the metal complex thereof is preferably rhodium, rhenium, ruthenium, osmium or iridium. These metal complexes may be used each alone, or two or more of them may be used in combination, or two or more complexes with the same or different metals may also be used in combination. The content of the metals and metal complexes thereof is preferably from $1\times10^{-9}$ to $1\times10^{-2}$ mole, more preferably from $1\times10^{-8}$ to $1\times10^{-4}$ mole based on one mole of silver. More specifically, the metal complexes having the structures described in JP-A-7-225449 may be used.

As the rhodium compound preferably used in the present invention, a water-soluble rhodium compound may be used. Examples include a rhodium (III) halogenide compounds and rhodium complex salts having a halogen, an amine or an oxalate as a ligand, such as hexachlororhodium (III) complex salt, pentachloroaquorhodium (III) complex salt, tetrachlorodiaquorhodium (III) complex salt, hexabromorhodium (III) complex salt, hexaamminerhodium (III) complex salt and trioxalatorhodium (III) complex salt.

The amount of the rhodium compound is preferably from $1\times10^{-8}$ to $5\times10^{-6}$ mole, more preferably from $5\times10^{-8}$ to $1\times10^{-6}$ mole based on one mole of silver halide.

The rhenium, ruthenium or osmium preferably used in the present invention is added in the form of a water-soluble complex salt described in JP-A-63-2042, JP-A-1-285941, JP-A-2-20852 and JP-A-2-20855. Particularly preferred examples are hexacoordinate complex salts represented by the following formula:

$$[ML_6]^{n-}$$

wherein M represents Ru, Re or Os, L represents a ligand, and n represents 0, 1, 2, 3 or 4.

In this case, the counter ion plays no important role and an ammonium or alkali metal may be is used.

Preferred examples of the ligand include a halide ligand, a cyanide ligand, a cyan oxide ligand, a nitrosyl ligand, a thionitrosyl ligand and so forth.

The amount of these compounds is preferably from $1\times10^{-9}$ to $1\times10^{-5}$ mole, particularly preferably from $1\times10^{-8}$ to $1\times10^{-6}$ mole, based on one mole of silver halide.

These compounds may be optionally added in any step during the preparation of silver halide emulsion grains before coating of the emulsion. In particular, they are preferably added during the formation of emulsion so that they should be incorporated into silver halide grains.

As the iridium compound preferably used for the present invention, various compounds may be used. Examples thereof include hexachloroiridium, hexammineiridium, trioxalatoiridium, hexacyanoiridium, pentachloronitrosyliridium and so forth. Those iridium compounds are used after being dissolved in water or an appropriate solvent, and a method commonly used for stabilizing the iridium compound solution, more specifically, a method comprising a step of adding an aqueous solution of hydrogen halide (e.g., hydrochloric acid, bromic acid, hydrofluoric acid) or alkali metal halide (e.g., KCl, NaCl, KBr, NaBr) may be used. Instead of using water-soluble iridium, different silver halide grains doped beforehand with iridium may be added and dissolved at the time of preparation of silver halide.

The silver halide grains for use in the present invention may further contain a metal atom such as cobalt, iron, nickel, chromium, palladium, platinum, gold, thallium, copper and lead. In the case of cobalt, iron, chromium or ruthenium compound, a hexacyano metal complex is preferably used. Specific examples include ferricyanate ion, ferrocyanate ion, hexacyanocobaltate ion, hexacyanochromate ion, hexacyanoruthenate ion and so forth. However, the present invention is not limited to these examples. The metal complex may be added, for example, uniformly in the silver halide, added in a higher concentration in the core part or in the shell part, and a way of the addition of the metal complex is not particularly limited.

The above-described metal is used preferably in an amount of from $1\times10^{-9}$ to $1\times10^{-4}$ mole based on one mole of silver halide. The metal may be converted into a metal salt in the form of a simple salt, a composite salt or a complex salt, and added at the time of preparation of silver halide grains.

The photosensitive silver halide grains used for the present invention may be desalted by water washing according to amethod known in the art, such as noodle washing and flocculation. However, the grains may not be desalted in the present invention.

The silver halide emulsion for use in the present invention is preferably subjected to chemical sensitization. The chemical sensitization may be performed using a known method such as sulfur sensitization, selenium sensitization, tellurium sensitization, and noble metal sensitization. These sensitization methods may be used each alone or in any combination. When these sensitization methods are used in combination, a combination of sulfur sensitization and gold sensitization, a combination of sulfur sensitization, selenium sensitization and gold sensitization, a combination of sulfur sensitization, tellurium sensitization and gold sensitization, and a combination of sulfur sensitization, selenium sensitization, tellurium sensitization and gold sensitization, for example, are preferred.

The sulfur sensitization is usually performed by adding a sulfur sensitizer to an emulsion and stirring the emulsion at a high temperature of 40° C. or higher for a given time. A known compound may be used as the sulfur sensitizer, and examples thereof include a sulfur compound contained in gelatin, as well as various sulfur compounds such as thiosulfates, thioureas, thiazoles and rhodanines. Preferred sulfur compounds are thiosulfate and thiourea compounds. The amount of the sulfur sensitizer varies depending on various conditions such as pH and a temperature during the chemical ripening and the size of silver halide grain. A preferred amount may be from $10^{-7}$ to $10^{-2}$ mole, more preferably from $10^{-5}$ to $10^{-3}$ mole, based on one mole of silver halide.

As the selenium sensitizer for use in the present invention, a known selenium compound may be used. The selenium sensitization is usually performed by adding a labile and/or non-labile selenium compound to an emulsion and stirring the emulsion at a high temperature of 40° C. or higher for a given time. Examples of the labile selenium compound include the compounds described in JP-B-44-15748, JP-B-43-13489, JP-A-4-25832, JP-A-4-109240 and JP-A-3-121798. Among them, particularly preferred compounds are those represented by formulas (VIII) and (IX) of JP-A-4-324855.

The tellurium sensitizer for use in the t present invention is a compound forming silver telluride, presumably working as a sensitization nucleus, on the surface or inside of a silver halide grain. The rate of the formation of silver telluride in a silver halide emulsion can be examined according to the method described in JP-A-5-313284. Examples of the tellurium sensitizer include diacyl tellurides, bis(oxycarbonyl) tellurides, bis(carbamoyl) tellurides, diacyl tellurides, bis (oxycarbonyl) ditellurides, bis(carbamoyl) ditellurides, compounds having a P═Te bond, tellurocarboxylates, Te-organyltellurocarboxylic acid esters, di(poly)tellurides, tellurides, tellurols, telluroacetals, tellurosulfonates, compounds having a P—Te bond, Te-containing heterocyclic rings, tellurocarbonyl compounds, inorganic tellurium compounds, colloidal tellurium and so forth.

The amount of the selenium or tellurium sensitizer varies depending on silver halide grains, chemical ripening conditions to be used or the like. However, it is usually from $10^{-8}$ to $10^{-2}$ mole or so, preferably from $10^{-7}$ to $10^{-3}$ mole or so, based on one mole of silver halide. The conditions for chemical sensitization in the present invention are not particularly limited. In general, pH of from 5–8, pAg of from 6–11, preferably from 7–10 may be applied, and a temperature may be from 40–95° C., preferably from 45–85° C.

Noble metal sensitizers for use in the present invention include sensitizers of gold, platinum, palladium and iridium, and particularly, sensitizers of gold compounds are preferred. Examples of the gold sensitizers include chloroauric acid, potassium chloroaurate, potassium aurithiocyanate, gold sulfide and so forth. They can be used in an amount of about $10^{-7}$ mole to about $10^{-2}$ mole based on one mole of silver halide.

Silver halide emulsions used in the present invention may be added with thiosulfonic acid compounds by the method mentioned in EP293917A.

In the thermally processed image recording material of the present invention, one kind of photosensitive silver halide emulsion may be used or two or more different emulsions (for example, those having different average grain sizes, different halogen compositions, different crystal habits or those subjected to different chemical sensitization conditions) may be used in combination.

The amount of the photosensitive silver halide is 0.01–5.0 g/m$^2$, preferably 0.05–2.0 g/m$^2$, as an amount of silver.

As the organic binder used for the present invention, hydrophobic and thermoplastic organic binders are used. They consist of, for example, a naturally occurring polymer, synthetic polymer or copolymer or other media that can form a film, such as gelatins modified to be hydrophobic, modified poly(vinyl alcohols), cellulose acetates, cellulose acetate butyrates, poly(vinylpyrrolidones), poly(vinyl acetates), poly(vinyl chlorides), polyacrylates, poly(methyl methacrylates), copoly(styrene/maleic anhydrides), copoly (styrene/acrylonitriles), copoly(styrene/butadienes), poly (vinyl acetals) (e.g., poly(vinyl formal), poly(vinyl butyral)), poly (esters), poly (urethanes), phenoxy resins, poly (vinylidene chlorides), poly(epoxides), poly(carbonates) poly(vinyl acetates), poly(amides) and so forth. The binder may be formed from water, organic solvent or emulsion by coating it.

As the organic binder used for the present invention, polymer latex is particularly preferred. Polymer latex can be coated without using an organic solvent. Therefore, it favorably does not emit vaporized organic solvent gas into atmosphere during the drying of coated film and it is favorably free from the problem that diffusion of organic solvent gas into environment since the organic solvent does not remain in the film. The polymer latex is preferably used in an amount of 50 weight % or more with respect to the total amount of binder. The polymer latex may be used not only in these layers, but also in a back layer. When the thermally processed image recording material of the present invention is used for, in particular, printing use in which dimensional change is critical, the polymer latex should be used also in the back layer. The term "polymer latex" used herein means a dispersion comprising hydrophobic water-insoluble polymer dispersed in a water-soluble dispersion medium as fine particles. The dispersed state may be one in which polymer is emulsified in a dispersion medium, one in which polymer underwent emulsion polymerization, micelle dispersion, one in which polymer molecules having a hydrophilic portion are dispersed in a molecular state or the like. Polymer latex used in the present invention is mentioned in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and so forth. The dispersed particles preferably have a mean particle size of about 1–50000 nm, more preferably about 5–1000 nm. The particle size distribution of the dispersed particles is not particularly limited, and the particles may have either wide particle size distribution or monodispersed particle size distribution.

Other than ordinary polymer latex of a uniform structure, the polymer latex used in the present invention may be latex of the so-called core/shell type. In this case, use of different glass transition temperatures of the core and shell may be preferred.

Preferred range of the glass transition temperature (Tg) of the polymer latex used as the binder varies for the protective layer, back layer and organic acid silver salt layer. As for the photosensitive layer or organic acid silver salt layer, the glass transition temperature is 40° C. or lower, preferably −30 to 40° C., for accelerating diffusion of photographic elements during the heat development. Polymer latex used for the protective layer or back layer (in particular, outermost layer) preferably has a glass transition temperature of 25–100° C., because these layers are brought into contact with various apparatuses.

The polymer latex used in the present invention preferably shows a minimum film forming temperature (MFT) of about −30 to 90° C., more preferably about 0–70° C. A film-forming aid may be added in order to control the minimum film forming temperature. The film-forming aid is also referred to as a plasticizer, and consists of an organic compound (usually an organic solvent) that lowers the minimum film forming temperature of the polymer latex. It is explained in, for example, the aforementioned Soichi Muroi, "Gosei Latex no Kagaku (Chemistry of Synthetic Latex)", Kobunshi Kanko Kai (1970).

Examples of polymer species used for the polymer latex used in the present invention include acrylic resins, polyvinyl acetate resins, polyester resins, polyurethane resins, rubber resins, polyvinyl chloride resins, polyvinylidene chloride resins, polyolefin resins, copolymers of monomers constituting these resins and so forth. The polymers may be linear, branched or crosslinked. They may be so-called homopolymers in which a single kind of monomer is polymerized, or copolymers in which two or more different kinds of monomers are polymerized. The copolymers may be random copolymers or block copolymers. The polymers may have a number average molecular weight of 5,000 to 1,000,000, preferably from 10,000 to 100,000. Polymers having a too small molecular weight may unfavorably suffer from insufficient mechanical strength of the image-forming layer, and those having a too large molecular weight may unfavorably suffer from bad film forming property.

Examples of the polymer latex used as the binder of the image-forming layer of the thermally processed image recording material of the present invention include latex of methyl methacrylate/ethyl acrylate/methacrylic acid copolymer, latex of methyl methacrylate/2-ethylhexyl acrylate/styrene/acrylic acid copolymer, latex of styrene/butadiene/acrylic acid copolymer, latex of styrene/butadiene/divinylbenzene/methacrylic acid copolymer, latex of methyl methacrylate/vinyl chloride/acrylic acid copolymer, latex of vinylidene chloride/ethyl acrylate/acrylonitrile/methacrylic acid copolymer and so forth. Such polymers are also commercially available and examples thereof include acrylic resins such as CEBIAN A4635, 46583, 4601 (all produced by Dicel Kagaku Kogyo Co., Ltd), Nipol Lx811, 814, 821, 820, 857 (all produced by Nippon Zeon Co., Ltd.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber resins such as LACSTAR 7310K, 3307B, 4700H, 7132C (all produced by Dai-Nippon Ink & Chemicals, Inc.), Nipol Lx416, 410, 438C, 2507 (all produced by Nippon Zeon Co., Ltd.); polyvinyl chloride resins such as G351, G576 (both produced by Nippon Zeon Co., Ltd.); polyvinylidene chloride resins such as L502, L513 (both produced by Asahi Chemical Industry Co., Ltd.), ARON D7020, D504, D5071 (all produced by Mitsui Toatsu Co., Ltd.); and olefin resins such as CHEMIPEARL S120 and SA100 (both produced by Mitsui Petrochemical Industries, Ltd.) and so forth. These polymers may be used individually or if desired, as a blend of two or more of them.

When the binder is dissolved in an organic solvent and coated, acetal resins such as polyvinyl butyral and polyvinyl formal can be used as the binder. Polyvinyl butyral is particularly preferred.

As the hydrophilic polymer contained in the photothermographic image recording layer and protective layer of the thermally processed image recording material of the present invention, which serves as a dispersion stabilizer, polyvinyl alcohol, methyl cellulose, hydroxypropyl cellulose, carboxymethyl cellulose, hydroxypropylmethyl cellulose and so forth are preferably used.

The amount of these hydrophilic polymers is preferably 30 weight % or less, more preferably 10 weight % or less, of the total binder of these layers. While any lower limit is not particularly defined for the amount, it is around 0.1 weight % or less. Further, the amount of these hydrophilic polymer is preferably 3 weight % or less, more preferably 1 weight % or less, of the total binder of the protective layer. While any lower limit is not particularly defined also for this amount, it is around 0.1 weight % or less.

As a surfactant used for the present invention as a dispersion stabilizer, known anionic surfactants can be used.

The amount of these surfactants is preferably 5 weight % or less, more preferably 2 weight % or less, of the total binder. While any lower limit is not particularly defined also for this amount, it is around 0.1 weight % or less.

The total amount of the binder in the photothermographic image-recording layer of the thermally processed image recording layer of the present invention is preferably in the range of 0.2–30 g/m$^2$, more preferably in the range of 1–15 g/m$^2$. The total amount of the binder in each intermediate layer is preferably in the range of 0.1–5 g/m$^2$, more preferably in the range of 0.3–3 g/m$^2$. The photothermographic image-recording layer, intermediate layer and protective layer of the thermally processed image recording layer of the present invention may contain a crosslinking agent for crosslinking, surfactant for improving coatability and so forth.

The total amount of the binder in the protective layer (per one layer) is preferably in the range of 0.2–10 g/m$^2$, more preferably in the range of 1–5 g/m$^2$. The protective layer may contain a surfactant for improving coatability and so forth. When two or more protective layers are provided, a coating solution for lower protective layer preferably has a pH of 5–8, and a coating solution for upper protective layer preferably has a pH of 2–7.

In the present invention, improved antistatic property can be obtained by further adding a fluorine-containing surfactant.

Preferred fluorine-containing surfactants for use in the invention include surfactants that have a fluoroalkyl, fluoroalkenyl or fluoroaryl group having at least 4 carbon atoms (usually 15 or less), and have, as ionic groups, anionic groups (for example, sulfonic acid or salts thereof, sulfuric acid or salts thereof, carboxylic acid or salts thereof, phosphoric acid or salts thereof), cationic groups (for example, amine salts, ammonium salts, aromatic amine salts, sulfonium salts, phosphonium salts), betaine groups (for example, carboxyamine salts, carboxyammonium salts, sulfoamine salts, sulfoammonium salts, phosphoammonium salts), or nonionic groups (substituted or unsubstituted poly (oxyalkylene) groups, polyglyceryl groups or sorbitane residue groups).

Such fluorine-containing surfactants have been disclosed in, for example, JP-A-49-10722, British Patent 1,330,356, U.S. Pat. Nos. 4,335,201 and 4,347,308, British Patent 1,417,915, JP-A-55-149938, JP-A-58-196544, British Patent No. 1,439,402 and so forth.

No limitation is imposed upon the layer to which the fluorine-containing surfactant is added provided that it is included in the image recording material, and it can be included, for example, in the surface protective layer, photothermographic recording layer, intermediate layer, undercoat layer or back layer. It is, however, preferably added to the surface protective layer, and while it may be added to one of the protective layers on the image-forming layer side and the back layer side, it is further preferably added to at least the protective layer on the image-forming layer side.

When the surface protective layer is composed of two or more layers, the fluorine-containing surfactant can be added to any of these layers, or it may be used in the form of an overcoat over the surface protective layer.

The amount of fluorine-containing surfactant may be 0.0001–1 g, preferably 0.0002–0.25 g, particularly preferably 0.0003–0.1 g, per 1 m$^2$ of the image recording material.

Furthermore, two or more kinds of the fluorine-containing surfactants can be used as a mixture.

In the present invention, an undercoat layer or moisture barrier layer containing a vinylidene chloride copolymer is preferably provided on both sides of a support. The vinylidene chloride copolymer may consist of a single kind of vinylidene chloride copolymer or two or more kinds of vinylidene chloride copolymers. The vinylidene chloride copolymer is used in such an amount that the undercoat layer containing the vinylidene chloride copolymer should have a total thickness for one side of 0.3 $\mu$m or more, preferably 0.3 to 4 $\mu$m.

Such a layer may contain a crosslinking agent, matting agent and so forth, in addition to the vinylidene chloride copolymer.

For the thermally processed image-recording material of the present invention, various kinds of support can be used. Typical supports comprise polyester such as polyethylene terephthalate and polyethylene naphthalate, cellulose nitrate, cellulose ester, polyvinylacetal, polycarbonate or the like. Among these, biaxially stretched polyester, especially polyethylene terephthalate (PET), is preferred in view of strength, dimensional stability, chemical resistance and so forth. The support preferably has a thickness of 90–500 $\mu$m as a base thickness except for the undercoat layer. The support may be a transparent or translucent support, or a white a reflective support. As the white reflective support, polyester films incorporated with white inorganic pigment and so forth can be used.

Preferably used as the support of the thermally processed image-recording material of the present invention is a polyester film, in particular, polyethylene terephthalate film, subjected to a heat treatment in a temperature range of 130–185° C. in order to relax internal distortion formed in the film during the biaxial stretching so that thermal shrinkage distortion occurring during the heat development should be eliminated. Such a thermal relaxation treatment may be performed at a constant temperature within the above temperature range, or it may be performed with raising the temperature.

The heat treatment of the support may be performed for the support in the form of a roll, or it may be performed for the support that is conveyed as a web. When it is performed for a support that is conveyed as a web, it is preferred that the conveying tension should be not more than 7 kg/cm$^2$, in particular, not more than 4.2 kg/cm$^2$. The lower limit of the conveying tension is, while not particularly limited, 0.5 kg/cm$^2$ or so.

This heat treatment is preferably performed after a treatment for improving adhesion of the image-forming layer and the back layer to the support, application of the undercoat layer and so forth.

The thermal shrinkage of the support upon heating at 120° C. for 30 seconds is preferably −0.03% to +0.01% for the machine direction (MD), and 0 to 0.04% for the transverse direction (TD).

The support may be applied with, other than the vinylidene chloride copolymer layer, an undercoat layer containing SBR, polyester, gelatin or the like as a binder, as required. The undercoat layer generally has a thickness of 0.01–5 μm, more preferably 0.05–1 μm (for one layer).

The thermally processed image recording material of the present invention may contain a light-absorbing material and a filter dye such as those mentioned in U.S. Pat. Nos. 3,253,921, 2,274,782, 2,527,583 and 2,956,879. The dyes can be mordanted as described in, for example, U.S. Pat. No. 3,282,699. The filter dye is preferably used in such an amount that absorbance at an exposure wavelength of 0.1–3, particularly preferably 0.2–1.5, should be achieved.

The photothermographic image-recording layer for use in the thermally processed image recording material of the present invention may contain a dye or a pigment of various types to improve color tone or prevent irradiation. Any dye or pigment may be used for the photosensitive layer, and examples thereof include pigments and dyes mentioned in the color index. Specific examples thereof include organic pigments and inorganic pigments such as pyrazoloazole dyes, anthraquinone dyes, azo dyes, azomethine dyes, oxonol dyes, carbocyanine dyes, styryl dyes, triphenylmethane dyes, indoaniline dyes, indophenol dyes and phthalocyanines. Preferred examples of the dye used for the present invention include anthraquinone dyes (e.g., Compounds 1 to 9 mentioned in JP-A-5-341441, Compounds 3–6 to 3–18 and 3–23 to 3–38 mentioned in JP-A-5-165147), azomethine dyes (e.g., Compounds 17 to 47 mentioned in JP-A-5-341441), indoaniline dyes (e.g., Compounds 11 to 19 mentioned in JP-A-5-289227, Compound 47 mentioned in JP-A-5-341441, Compounds 2–10 and 2–11 mentioned in JP-A-5-165147 and so forth) and azo dyes (Compounds 10 to 16 mentioned in JP-A-5-341441). These dyes may be added in any form, for example, as a solution, emulsion or solid microparticle dispersion, or as a polymer mordant mordanted with a dye. However, water-soluble substances are preferably added as an aqueous solution, and water-insoluble substances are preferably added as a solid microparticle dispersion. The amount of these compounds may be determined depending on a desired amount of absorption. In general, they are preferably used in an amount of from 1 μg to 1 g per 1 $m^2$ of the image recording material.

When an additive known as a "toning agent (toning agent)" capable of improving images is added, the optical density increases in some cases. Also, the toning agent may be advantageous in forming a black silver image depending on the case. The toning agent is preferably contained on the surface having the photosensitive layer in an amount of from 0.1–50 mole %, more preferably from 0.5–20 mole %, per mole of silver. The toning agent may be a so-called precursor that is derived to effectively exhibit the function only at the time of development.

For thermally processed image recording material using a silver salt of an organic acid, toning agents over a wide range are known and these are disclosed in JP-A-46-6077, JP-A-47-10282, JP-A-49-5019, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. Nos. 3,080,254, 3,446,648, 3,782,941, 4,123,282 and 4,510,236, British Patent No. 1,380,795, Belgian Patent No. 841910 and so forth. Examples of the toning agent include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)-aryldicarboxyimides such as N,N-(dimethylaminomethyl)phthalimide and N,N-(dimethylaminomethyl) naphthalene-2,3-dicarboxyimide; blocked pyrazoles, isothiuronium derivatives and a certain kind of photobleaching agents, such as N,N'-hexamethylenebis(1-carbamoyl-3,5-dimethylpyrazole), 1,8-(3,6-diazaoctane)bis(isothiuroniumtrifluoroacetate) and 2-(tribromomethylsulfonyl)benzothiazole; 3-ethyl-5-[(3-ethyl-2-benzothiazolinylidene)-1-methylethylidene]-2-thio-2,4-oxazolidinedione; phthalazinone, phthalazinone derivatives and metal salts thereof, such as 4-(1-naphthyl) phthalazinone, 6-chlorophthalazinone, 5,7-dimethyloxyphthalazinone and 2,3-dihydro-1,4-phthalazinedione; combinations of phthalazinone with a phthaiic acid derivative (e.g., phthalic acid, 4-methylphthalic acid, 4-nitrophthalic acid, tetrachlorophthalic acid anhydride); phthalazine, phthalazine derivatives (e.g., 4-(1-naphthyl)phthalazine, 6-chlorophthalazinone, 5,7-dimethoxyphthalazine, isopropylphthalazine, 6-isobutylphthalazine, 6-tert-butylphthalazine, 5,7-dimethylphthalazine and 2,3-dihydrophthalazine) and metal salts thereof; combinations of a phthalazine and a phthalic acid derivative (e.g., phthalic acid, 4-methylphthalic acid, 4-nitrophthalic acid, tetrachlorophthalic acid anhydride), quinazolinedione, benzoxazine and naphthoxazine derivatives; rhodium complexes which function not only as a toning agent but also as a halide ion source for the formation of silver halide at the site, such as ammonium hexachlororhodate (III), rhodium bromide, rhodium nitrate and potassium hexachlororhodate (III); inorganic peroxides and persulfates such as ammonium disulfide peroxide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asymmetric triazines such as 2,4-dihydroxpyrimidine and 2-hydroxy-4-aminopyrimidine; and azauracil and tetraazapentalene derivatives such as 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene and so forth.

The toning agent used in the present invention is preferably added as an aqueous solution. However, when it is water-insoluble, it may be added in any form of a methanol solution, powder, solid microparticle dispersion and so forth. The solid fine particle dispersion is performed using known pulverization means (e.g., ball mill, vibrating ball mill, sand mill, colloid mill, jet mill, roller mill). At the time of solid microparticle dispersion, a dispersion aid may also be used.

The sensitizing dye used for the present invention may be any one of those that can spectrally sensitize the silver halide grains at a desired wavelength region when they are adsorbed on the silver halide grains. As such sensitizing dyes, usable are, for example, cyanine dyes, merocyanine dyes, complex cyanine dyes, complex merocyanine dyes, holopolar cyanine dyes, styryl dyes, hemicyanine dyes, oxonole dyes, hemioxonole dyes and so forth. Sensitizing dyes which are usable in the present invention are described in, for example, Research Disclosure, Item 17643, IV-A (December, 1978, page 23) Item 1831X (August, 1978, page 437) and also in the references as referred to in them. In particular, sensitizing dyes showing color sensitivity suitable for spectral characteristics of light sources of various laser imagers, scanners, image setters, process cameras and so forth can advantageously be selected.

Exemplary dyes for spectral sensitization for red light from light sources such as He—Ne laser, red semiconductor laser, and LED include Compounds I-1 to I-38 disclosed in JP-A-54-18726, Compounds I-1 to I-35 disclosed in JP-A-6-75322, Compounds I-1 to I-34 disclosed in JP-A-7-287338, Dyes 1 to 20 disclosed in JP-B-55-39818, Compounds I-1 to I-37 disclosed in JP-A-62-284343, and Compounds I-1 to I-34 disclosed in JP-A-7-287338.

Spectral sensitization as to the wavelength region of from 750 to 1,400 nm from semiconductor laser light sources can advantageously be obtained with various known dyes including cyanine dyes, merocyanine dyes, styryl dyes, hemicyanine dyes, oxonol dyes, hemioxonol dyes and xanthene dyes. Useful cyanine dyes are cyanine dyes having a basic nucleus such as thiazoline nucleus, oxazoline nucleus, pyrroline nucleus, pyridine nucleus, oxazole nucleus, thiazole nucleus, selenazole nucleus or imidazolenucleus. Useful merocyaninedyesaremerocyaninedyes having the above-described basic nucleus or an acidic nucleus such as thiohydantoin nucleus, rhodanine nucleus, oxazolidinedione nucleus, thiazolinedione nucleus, barbituric acid nucleus, thiazolinone nucleus, malononitrile nucleus or pyrazolone nucleus. Of these cyanine and merocyanine dyes, those having an imino group or a carboxyl group are particularly effective. The dye may be appropriately selected from known dyes described in, for example, U.S. Pat. Nos. 3,761,279, 3,719,495 and 3,877,943, British Patent Nos. 1,466,201, 1,469,117 and 1,422,057, JP-B-3-10391, JP-B-6-52387, JP-A-5-341432, JP-A-6-194781 and JP-A-6-301141.

The dyes particularly preferably used for the present invention are cyanine dyes having a thioether bond containing substituent (e.g., dyes described in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425, International Patent Application published in Japanese for Japanese national phase (Kohyo, hereinafter referred to as JP-W-A) 7-500926 and U.S. Pat. No. 5,541,054), dyes having a carboxylic acid group (e.g., dyes disclosed in JP-A-3-163440, JP-A-6-301141, and U.S. Pat. No. 5,441,899), merocyanine dyes, polynuclearmerocyanine dyes and polynuclear cyanine dyes (dyes disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-A-W-55-50111, British Patent No. 1,467,638, and U.S. Pat. No. 5,281,515) and so forth.

Dyes forming J-band have been disclosed in U.S. Pat. Nos. 5,510,236, 3,871,887 (Example 5), JP-A-2-96131, JP-A-59-48753 and so forth, and they can preferably be used for the present invention.

These sensitizing dyes may be used either individually or in combination of two or more thereof. The combination of sensitizing dyes is often used for the purpose of supersensitization. In combination with the sensitizing dye, a dye which itself has no spectral sensitization effect or a material which absorbs substantially no visible light, but which exhibits supersensitization may be incorporated into the emulsion. Useful sensitizing dyes, combinations of dyes which exhibit supersensitization, and materials which show supersensitization are described in Research Disclosure, Vol. 176, 17643, page 23, Item IV-J (December, 1978), JP-B-49-25500, JP-B-43-4933, JP-A-59-19032, JP-A-59-192242 and so forth.

The sensitizing dye may be added to the silver halide emulsion by dispersing it directly in the emulsion or may be added to the emulsion after dissolving it in a solvent such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide, and the solvent may be a sole solvent or a mixed solvent.

The amount of the sensitizing dye used in the present invention may be selected according to the performance such as sensitivity or fog. However, it is preferably from $10^{-6}$ to 1 mole, more preferably from $10^{-4}$ to $10^{-1}$ mole, per mole of silver halide in the image-forming layer (photosensitive layer).

The silver halide emulsion and/or silver salt of an organic acid for use in the present invention can be further prevented from the production of additional fog or stabilized against the reduction in sensitivity during the stock storage, by an antifoggant, a stabilizer or a stabilizer precursor. Examples of antifoggants, stabilizers and stabilizer precursors which can be appropriately used individually or in combination include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechol described in U.S. Pat. No. 3,235,652, oximes, nitrons and nitroindazoles described in British Patent No. 623,448, polyvalent metal salts described in U.S. Pat. No. 2,839,405, thiuronium salts described in U.S. Pat. No. 3,220,839, palladium, platinum and gold salts described in U.S. Patent Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, and phosphorus compounds described in U.S. Pat. No. 4,411,985.

The thermally processed image-recording material of the present invention may contain a benzoic acid compound for the purpose of achieving high sensitivity or preventing fog. The benzoic acid compound for use in the present invention may be any benzoic acid derivative, but preferred examples of the structure include the compounds described in U.S. Pat. Nos. 4,784,939 and 4,152,160 and JP-A-9-329865, JP-A-9-329864 and JP-A-9-281637. The benzoic acid compound for use in the present invention may be added to any site of the image-forming material, but the layer to which the benzoic acid is added is preferably a layer on the surface having the image-forming layer (photosensitive layer), more preferably an organic acid silver salt-containing layer, intermediate layer or protective layer. Particularly preferably, it is added to an intermediate layer or protective layer. The benzoic acid compound may be added at any step during the preparation of a coating solution. In the case of adding the benzoic acid compound to an organic acid silver salt-containing layer, it may be added at any step from the preparation of the organic acid silver salt until the preparation of coating solution, but is preferably added in the period after the preparation of the organic acid silver salt and immediately before the coating. The benzoic acid compound for use in the present invention may be added in any form of powder, solution, microparticle dispersion and so forth, or may be added as a solution containing a mixture of the benzoic acid compound with other additives such as a sensitizing dye, reducing agent and toning agent. The benzoic acid compound may be added in any amount. However, the addition amount thereof is preferably from $1\times10^{-6}$ to 2 mole, more preferably from $1\times10^{-3}$ to 0.5 mole, per mole of silver.

The thermally processed image recording material of the present invention may contain a mercapto compound, disulfide compound or thione compound so as to control the development by inhibiting or accelerating the development, improve the spectral sensitization efficiency or improve the storage stability before or after the development.

In the case of using a mercapto compound in the present invention, any structure may be used but those represented by Ar—SM or Ar—S—S—Ar are preferred, wherein M is a hydrogen atom or an alkali metal atom, and Ar is an aromatic ring or condensed aromatic ring containing one or more nitrogen, sulfur, oxygen, selenium or tellurium atoms, preferably a heteroaromatic ring such as benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of halogen (e.g., Br, Cl), hydroxy, amino, carboxy, alkyl (e.g., alkyl having one or more carbon atoms, preferably from 1 to 4 carbon atoms), alkoxy (e.g., alkoxy having one or more carbon atoms, preferably from 1 to 4 carbon atoms) and aryl (which may have a substituent). Examples of the mercapto substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)-benzenesulfonate, N-methyl-N'-[3-(5-mercaptotetrazolyl)phenyl]urea, 2-mercapto-4-phenyloxazole, 2-[3-(9-carbazolyl)propylimino]-3-(2-mercaptoethyl)benzothiazoline and so forth. However, the present invention is not limited to these.

The amount of the mercapto compound added to the photothermographic image-recording layer is preferably from 0.0001–1.0 mole, more preferably from 0.001–0.3 mole, per mole of silver.

The thermally processed image recording material of the present invention may contain a polyhydric alcohol (for example, glycerins and diols described in U.S. Pat. No. 2,960,404) and so forth as a plasticizer.

The thermally processed image recording material of the present invention desirably contain a matting agent in the surface protective layer in order to prevent the problem of adhesion when a plurality of the materials are stacked. The matting agent consists of, in general, microparticles of a water-insoluble organic or inorganic compound. Any matting agent may be employed, and those well known in the art may be used, such as organic matting agents mentioned in U.S. Pat. Nos. 1,939,213, 2,701,245, 2,322,037, 3,262,782, 3,539,344 and 3,767,448, or inorganic matting agents mentioned in U.S. Pat. Nos. 1,260,772, 2,192,241, 3,257,206, 3,370,951, 3,523,022 and 3,769,020. Specific examples of the organic compounds that can be used as the matting agent include, for example, water-dispersible vinyl polymers such as polymethyl acrylate, polymethyl methacrylate, polyacrylonitrile, acrylonitrile/α-methylstyrene copolymer, polystyrene, styrene/divinylbenzene copolymer, polyvinyl acetate, polyethylene carbonate and polytetrafluoroethylene; cellulose derivatives such as methyl cellulose, cellulose acetate and cellulose acetate propionate; starch derivatives such as carboxy starch, carboxynitrophenyl starch and urea/formaldehyde/starch reaction product; gelatin hardened with a known hardener and hardened gelatin in the form of a microcapsule hollow particle produced by coacervation hardening and so forth. As for the inorganic compounds, for example, silicon dioxide, titanium dioxide, magnesium dioxide, aluminum oxide, barium sulfate, calcium carbonate, silver chloride desensitized by a known method, silver bromide desensitized by a known method, glass, diatomaceous earth and so forth can be preferably used. The matting agent may be used as a mixture of different substances as required. The matting agent has an effect of forming unevenness on the surface of the protective layer to reduce the contact area so that the problem of adhesion should be prevented. Therefore, its mean grain size is preferably larger than the thickness of the protective layer. However, even a matting agent in a smaller size may form aggregates and protrude on the surface. Therefore, it is not necessarily essential that it should have a size larger than the thickness of the protective layer. Practically useful size is 1 μm or more. Further, if the particle size is unduly large, it becomes likely that the matting agent goes down into the image-forming layer to inhibit the image formation and thus form pinholes. In this respect, practically useful size is 10 μm or less. Therefore, in the present invention, the mean particle size of the matting agent is preferably 1 μm or more, and 10 μm or less. Further, a narrow particle size distribution of the matting agent is more preferred, and a monodispersion degree of 10% or less is desirable. It is also possible to obtain a required mean particle size, shape and particle size distribution during the preparation of the matting agent or by mixing two or more kinds of matting agents.

When a plurality of protective layers are used, the effect of the matting agent may be obtained by adding it in any one of the layers, since the protective layer is generally a thin layer. However, it is preferably added to the outermost surface layer or a layer as near the surface as possible.

Coating solutions for photothermographic image-recording layer of the thermally processed image recording material of the present invention are adjusted to pH 5.5–7.8. The acid used for the pH adjustment is preferably an acid not containing halogen. While pH of the protective layer may vary depending on the added agents, it is relatively low, i.e., 2–7. When a plurality of protective layers are used, a layer near the photosensitive layer desirably has pH of 4–7, and a layer remote from the photosensitive layer desirably has a lower pH, i.e., 2–5.

When a transparent support is used in the present invention, the back layer preferably has a maximum absorption of from about 0.3 to 2.0 for a desired wavelength range. Where the desired range is 750–1,400 nm, the back layer may preferably have an optical density of 0.005 or more but less than 0.5 in the range of 360–750 nm, and more preferably act as an antihalation layer having optical density of 0.001 or more but less than 0.3. Where the desired range is less than 750 nm, the back layer may preferably be an antihalation layer having a maximum absorption of 0.3 or more but 2.0 or less in a desired range of wavelength before the formation of images, and an optical density of 0.005 or more but less than 0.3 for the range of 360–650 nm after the formation of images. The method for decreasing the optical density after the formation of image to a level within the above-mentioned range is not particularly limited. For example, a method for reducing the density through decoloration of dye by heating as mentioned in Belgian Patent No. 733,706, or a method for reducing the density using decoloration by light irradiation mentioned in JP-A-54–17833 may be used.

When antihalation dyes are used in the present invention, the dyes may be any compounds so long as they have an intended absorption in a desired wavelength region and sufficiently low absorption in a visible region after the development, and also provide an absorption spectral pattern desired for the aforementioned back layer. Examples of such dyes include, as a single dye, the compounds mentioned in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and JP-A-3-24539 (from page 14, left lower column to page 16, right lower column); and as a dye which is decolored after the development, the compounds mentioned in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-B-50-16648, JP-B-2-41734 and U.S. Pat. Nos. 4,088,497, 4,283,487, 4,548,896 and 5,187,049. However, the scope of the present invention is not limited to these examples.

In the present invention, the binder suitable for the back layer may be transparent or translucent, and generally colorless. Examples the materials therefor include natural polymers and synthetic resins including homopolymers and copolymers, and other film-forming media. Specific examples thereof include, for example, gelatin, gum arabic, poly(vinyl alcohol), hydroxyethyl cellulose, cellulose acetate, cellulose acetate butyrate, poly(vinylpyrrolidone), casein, starch, poly(acrylic acids), poly(methyl methacrylates), poly(vinyl chlorides), poly(methacrylic acids), copoly(styrene/maleic anhydrides), copoly(styrene/acrylonitriles), copoly(styrene/butadienes), poly(vinyl acetals) (e.g., poly(vinyl formal), poly(vinyl butyral)), poly (esters), poly(urethanes), phenoxy resins, poly(vinylidene chlorides), poly(epoxide), poly(carbonate), poly (vinyl acetate), cellulose esters and poly (amides) The binder may be coated after being dissolved in water or an organic solvent or in the form of an emulsion.

The amount of the total binder in the back layer is preferably 0.01–10 g/m$^2$, more preferably 0.5–5 g/m$^2$.

In a preferred embodiment of the present invention, a matting agent is added to the back layer to lower its Beck's smoothness. Beck's smoothness can preferably be adjusted to be 2000 seconds or less but 10 seconds or more, more preferably 1500 seconds or less but 50 seconds or more by changing the particle size, addition amount and so forth. Beck's smoothness can be determined according to JIS P8119 and TAPPI T479.

According to the present invention, the outermost layers on the image-forming layer side and/or the opposite side preferably contain a lubricant.

No particular limitation is imposed upon the lubricant used in the present invention, and any compounds which, when present at the surface of an object, reduce the friction coefficient of the surface relative to that observed when the compound is absent can be used for this purpose.

Typical examples of the lubricant which can be used in the present invention include silicone based lubricants disclosed in U.S. Pat. No. 3,042,522, British Patent No. 955,061, U.S. Pat. Nos. 3,080,317, 4,004,927, 4,047,958 and 3,489,567, British Patent No. 1,143,118 and so forth, higher fatty acid based, alcohol based and acid amide based lubricants disclosed in U.S. Pat. Nos. 2,454,043, 2,732,305, 2,976,148 and 3,206,311, German Patent Nos. 1,284,295, 1,284,294 and so forth, metal soaps disclosed in British Patent No. 1,263,722, U.S. Pat. No. 3,933,516 and so forth, ester based and ether based lubricants disclosed in U.S. Pat. Nos. 2,588,765, 3,121,060, British Patent No. 1,198,387 and so forth, the taurine based lubricants disclosed in U.S. Pat. Nos. 3,502,473 and 3,042,222 and so forth.

Specific examples of the lubricant preferably used include, CELLOSOL 524 (main ingredient is carnauba wax), POLYLON A, 393, H-481 (main ingredient is polyethylene wax), HIMICRON G-110 (main ingredient is ethylene bis-stearic acid amide), HIMICRON G-270 (main ingredient is stearic acid amide) (all from Chukyo Oil & Fat Co., Ltd.).

The amount of the lubricant used is 0.1–50 weight %, preferably 0.5–30 weight % of binder contained in a layer to which the lubricant is added.

The layers of the thermally processed image recording material of the present invention such as the image-forming layer, protective layer and back layer each may contain a hardening agent. Examples of the hardening agent include polyisocyanates described in U.S. Pat. No. 4,281,060, JP-A-6-208193 and so forth, epoxy compounds described in U.S. Pat. Nos. 4,791,042 and so forth, and vinyl sulfone-based compounds described in JP-A-62-89048 and so forth.

In the present invention, a surfactant may also be used to improve the coating property and so forth. Examples of the surfactant include nonionic, anionic, cationic and fluorocarbon surfactants, from which the surfactant may be appropriately chosen and used. Specific examples thereof include fluorocarbon polymer surfactants mentioned in JP-A-62-170950, U.S. Pat. No. 5,380,644 and so forth, fluorocarbon surfactants mentioned in JP-A-60-244945, JP-A-63-188135 and so forth, polysiloxane surfactants mentioned in U.S. Pat. No. 3,885,965 and so forth, and polyalkylene oxides and anionic surfactants mentioned in JP-A-6-301140 and so forth.

The photothermographic emulsion used in the present invention can be coated by various coating methods including dip coating, air knife coating, flow coating, and extrusion coating using a hopper of the type mentioned in U.S. Pat. No. 2,681,294. If desired, two or more layers may be simultaneously coated by the methods mentioned in U.S. Pat. No. 2,761,791 and British Patent No. 837,095.

Although the thermally processed image recording material of the present invention may be developed by any method, the development is usually performed by heating a thermally processed image recording material exposed imagewise. As preferred embodiments of heat development apparatus to be used, there are heat development apparatuses in which a thermally processed image recording material is brought into contact with a heat source such as heat roller or heat drum as disclosed in JP-B-5-56499, Japanese Patent No. 684453, JP-A-9-292695, JP-A-9-297385 and WO95/30934, and heat development apparatuses of non-contact type as disclosed in JP-A-7-13294, WO97/28489, WO97/28488 and WO97/28487. Particularly preferred embodiments are the heat development apparatuses of non-contact type. The temperature for the development is preferably 80–250° C., more preferably 100–140° C. The development time is preferably 1–180 seconds, more preferably 10–90 seconds.

As a method for preventing uneven development or mechanical indent due to dimensional change of the thermally processed image recording material during the heat development, it is effective to employ a method for forming images wherein the material is heated at a temperature of 80° C. or higher but lower than 115° C. (preferably 113° C. or lower) for 5 seconds or more so as not to develop images, and then subjected to heat development at 110° C. or higher (preferably 130° C. or lower) to form images (so-called multi-step heating method).

It is preferred that the thermally processed image recording material should be gradually cooled after the heat development. The cooling rate from the development temperature to 70° C. is 200° C./minute or less, preferably 150° C./minute to 50° C./minute.

The thermally processed image recording material of the present invention can be exposed in any manner. As light source of exposure, laser rays are preferred. As the laser used in the present invention, gas lasers, YAG lasers, dye lasers, semiconductor lasers and so forth are preferred. A combination of semiconductor laser and second harmonic generating device may also be used.

The thermally processed image recording material of the present invention shows a low haze at the exposure, and is liable to incur generation of interference fringes. For preventing the generation of interference fringes, a technique of entering a laser ray obliquely with respect to the image recording material disclosed in JP-A-5-113548 and so forth and a method of using a multi mode laser disclosed in WO95/31754 have been known, and these techniques are preferably used.

The thermally processed image recording material of the present invention is preferably exposed such that the laser rays are overlapped and the scanning lines are not viewed as described in SPIE, vol. 169, "Laser Printing", pages 116 to 128 (1979) JP-A-4-51043, WO95/31754 and so forth.

EXAMPLE

The present invention will be specifically explained with reference to following Examples. Materials, use amounts, ratios, processing contents, manipulations and the like shown in the following examples can be optionally changed so long as such change does not depart from the spirit of the present invention. Therefore, the scope of the present invention is not limited to the following examples.

The materials used in the example will be explained first.

<Preparation of Support Provided with Back Layer and Heat-Treated>

On a PET base having a thickness of 120 μm, the following layers were provided.

(Coating of Undercoat Layers)

The following Undercoat layer (a) and Undercoat layer (b) were applied on one side of the PET base, and each dried at 180° C. for 4 minutes.

| | |
|---|---|
| Undercoat layer (a) | |
| Polymer latex V-5 (core shell type latex comprising 90% by weight of core and 10% by weight of shell, core: vinylidene chloride/methyl acrylate/methyl methacrylate/acrylonitrile/acrylic acid = 93/3/3/0.9/0.1 (weight %), shell; vinylidene chloride/methyl acrylate/methyl methacrylate/acrylonitrile/acrylic acid = 88/3/3/3/3 (weight %), weight average molecular weight: 38000) | 3.0 g/m$^2$ as solid content |
| 2,4-Dichloro-6-hydroxy-s-triazine | 23 mg/m$^2$ |
| Matting agent (polystyrene, average diameter: 2.4 μm) | 1.5 mg/m$^2$ |
| Undercoat layer (b) | |
| Alkali-treated gelatin ($Ca^{2+}$ content: 30 ppm, jelly strength: 230 g) | 83 mg/m$^2$ |
| Compound A | 1 mg/m$^2$ |
| Compound H | 2 mg/m$^2$ |
| Methyl cellulose | 4 mg/m$^2$ |
| Emalex 710 (polyoxyethylene produced by Nihon Emulsion Co.) | 3 mg/m$^2$ |

(Coating of Back Layer)

The following back layers were provided on the other side of the PET base.

| | |
|---|---|
| (Nihon Junyaku Co., Ltd.) | 38 mg/m$^2$ |
| $SnO_2$/Sb (weight ratio: 9/1, acicular grains, Ishihara Sangyo Kaisha, Ltd., trade name: FS-10D) | 200 mg/m$^2$ |
| Dye A | 20 mg/m$^2$ |
| Matting agent (Polymethyl methacrylate, average particle size: 5 μm) | 10 mg/m$^2$ |
| Crosslinking agent (Denacol EX-614B, Nagase Kasei Co., Ltd.) | 13 mg/m$^2$ |
| Second back layer | |
| Latex binder (CHEMIPEARL S-120, Mitsui Petrochemical Industries, Ltd.) | 500 mg/m$^2$ |
| Colloidal silica (Snowtex-C, Nissan Chemical Industries, Ltd.) | 40 mg/m$^2$ |
| Crosslinking agent (Denacol EX-614B, Nagase Kasei Co., Ltd.) | 30 mg/m$^2$ |

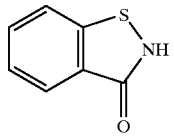

Compound A

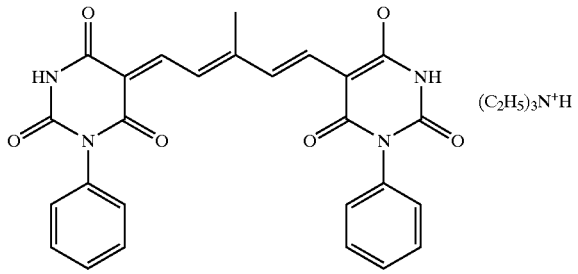

Dye A

-continued

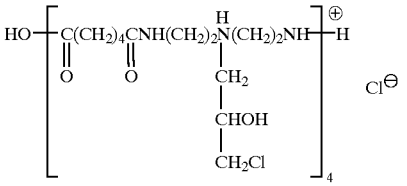

Compound H

The both back layers were successively applied, and each dried at 180° C. for 4 minutes.

(Heat Treatment of Support)

After the undercoat layers and the back layers were coated and dried, the support was subjected to a first heat treatment at 130° C. for 10 minutes with a tension of 5 kg/cm$^2$, and then a second heat treatment at 40° C. for 15 seconds with a tension of 10 kg/cm$^2$.

<Preparation of Photosensitive Silver Halide Emulsion>

Into 700 mL of water, 11 g of phthalized gelatin, 30 mg of potassium bromide and 10 mg of sodium thiosulfonate were dissolved, and after adjusting the mixture to a temperature of 35° C. and pH of 5.0, 159 mL of an aqueous solution containing 18.6 g of silver nitrate and an aqueous solution containing 1 mol/L of potassium bromide were added by the control double jet method over 6.5 minutes while keeping pAg to be at 7.7. Subsequently, 476 mL of an aqueous solution containing 55.4 g of silver nitrate and an aqueous solution containing 1 mol/L of potassium bromide were added by the control double jet method over 30 minutes while keeping the pAg to be at 7.7, and then 1 g of 4-hydroxy-6-methyl-1,3,3a,7-tetrazaindene was added. Thereafter, the pH was lowered to cause coagulation precipitation to effect desalting, then 0.1 g of phenoxyethanol was added, and the pH and the pAg were adjusted to 5.9 and 8.2, respectively, to complete the preparation of silver bromide grains (cubic grains having an average grain size of 0.12 μm, a coefficient of variation for diameter of projected area of 8%, and a (100) face ratio of 88%).

The silver halide grains obtained above were warmed to 60° C., added with sodium thiosulfonate in an amount of $8.5\times10^{-4}$ mole per mole of silver, ripened for 120 minutes, quenched to 40° C., added with $1\times10^{-5}$ mole of Sensitizing dye A, $5\times10^{-5}$ mole of Compound B, $5\times10^{-5}$ mole of N-methyl-N'-{3-mercaptotetrazolyl}phenyl}urea and 100 ppm of Compound A, and quenched to 30° C. to obtain Silver halide emulsion A.

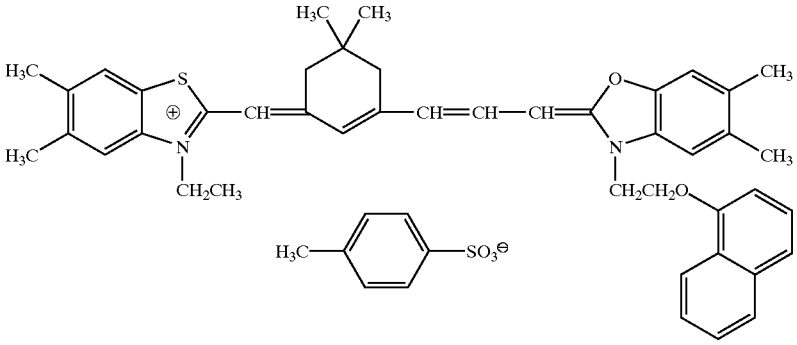

Sensitizing dye A

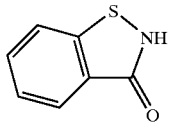

Compound A

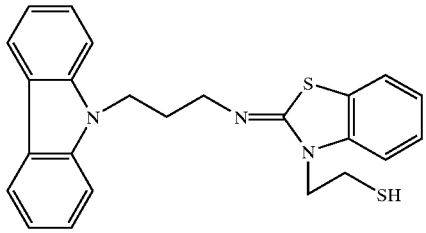

Compound B

<Preparation of Organic Acid Silver Salt Dispersion A>

To 4.4 g of stearic acid, 39.4 g of behenic acid and 770 mL of distilled water, 103 mL of 1 mol/L aqueous NaOH solution was added at 90° C. with stirring, allowed to react for 240 minutes, and cooled to 75° C. Then, 112.5 mL of an aqueous solution containing 19.2 g of silver nitrate was added over 45 seconds to the reaction mixture, which was then left as it was for 20 minutes to be cooled to 30° C. Thereafter, the solid content was separated by suction filtration, and washed with water until the conductivity of the filtrate became 30 μS/cm. The solid content obtained as described above was added with 100 mL of 10 weight % aqueous solution of polyvinyl alcohol, and water of such an amount that the total weight should become 270 g, and roughly dispersed by an automatic mortar. This roughly dispersed organic acid silver salt was further dispersed by a nanomizer (Nanomizer Co., Ltd.) at a pressure of 1000 kg/cm$^3$ upon impact to obtain an acicular grain dispersion in which grains had an average short axis length of 0.04 $\mu$m, an average long axis length of 0.8 $\mu$m and a variation coefficient of 30%.

<Preparation of Dispersion of Reducing Agent>

Reducing Agent Dispersion A

To 100 g of Reducing agent A, 100 g of denatured polyvinyl alcohol (MP-203 produced by Kuraray Co., Ltd.), and 2.1 g of Leopol BX (trade name, Takemoto Oil & Fat Co., Ltd., sodium triisopropylnaphthalenesulfonate) 600 g of water was added, and thoroughly stirred to obtain slurry. The slurry was introduced into a vessel together with 840 g of dispersion beads (zirconia particles having a mean particle size of 0.5 mm), and dispersed in a dispersing machine (1/4G Sand Grinder Mill, manufactured by Imex) for 5 hours to prepare Reducing agent dispersion A having a mean particle size of 0.4 $\mu$m.

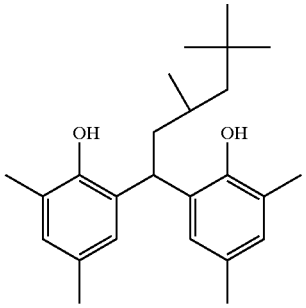

Reducing agent A

Reducing Agent Dispersions B–D

In a similar manner, Reducing agent dispersions B–D were prepared by using Reducing agents B–D instead of Reducing agent A.

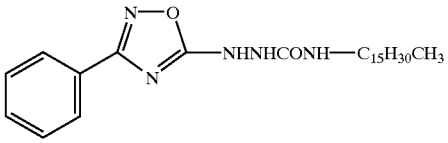

Reducing agent B

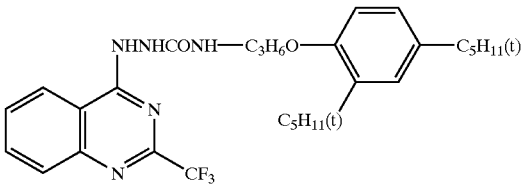

Reducing agent C

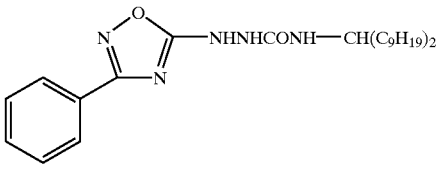

Reducing agent D

<Preparation of Solubilized Phthalazine Derivative Solution A>

The following components were mixed in the amounts shown below and stirred to obtain Solubilized solution A of Phthalazine derivative A mentioned below.

| | |
|---|---|
| Phthalazine derivtive A | 25 g |
| Leopol BX (trade name, Takemoto Oil & Fat Co., Ltd., sodium triisoproplnaphthalenesulfonate) | 2.1 g |
| Polyvinyl alcohol (PVA-217, produced by Kuraray Co., Ltd., 20% aqueous solution) | 100 g |
| Water | 373 g |

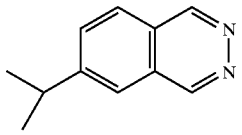

Phthalazine derivative A

<Preparation of Solid Microparticle Dispersion of Organic Polyhalogenated Compound>

To 30 g of Organic polyhalogenated compound A, 0.5 g of hydroxypropylmethyl cellulose, 0.5 g of Compound C and 88.5 g of water were added and sufficiently stirred to form slurry, which was then left for 3 hours. Then, solid microparticle dispersion was prepared in the same manner as that for the preparation of the solid microparticle dispersions of reducing agents. As for particle size, 80 weight % of the particles had a particle size of 0.3 $\mu$m or more but 1.0 $\mu$m or less.

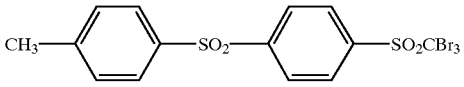

Organic polyhalogenated compound A

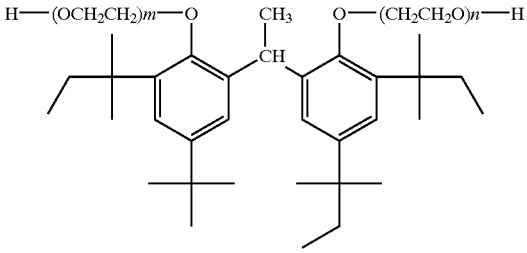

Compound C $m + n = 27$

<Preparation of Salicylic Acid Derivative Dispersion A>

In an amount of 210 g of water was added to 30 g of Salicylic acid derivative A, 30 g of denatured polyvinyl alcohol (MP-203 produced by Kuraray Co., Ltd.) and 0.6 g of Leopol BX (trade name, Takemoto Oil & Fat Co., Ltd., sodium triisopropylnaphthalenesulfonate) and mixed sufficiently to form slurry. The slurry was introduced into a vessel together with 960 g of dispersion beads (zirconia particles having a mean particle size of 0.5 mm), and dispersed in a dispersing machine (1/4G Sand Grinder Mill, manufactured by Imex) for 5 hours. The dispersion was diluted with 105 g and taken out to obtain Salicylic acid derivative dispersion A having a mean particle size of 0.4 $\mu$m.

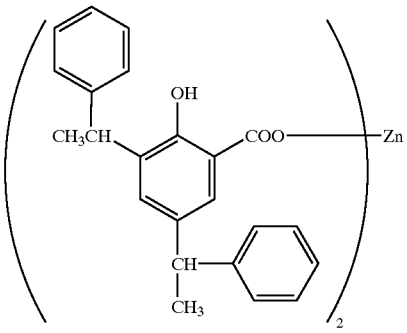

Salicylic acid derivative A

<Preparation of Color Image Forming Material Dispersion A>

In an amount of 600 g of water was added to 100 g of Color image forming material A mentioned below and 125 g of polyvinyl alcohol, and thoroughly stirred to obtain slurry. The slurry was introduced into a vessel together with 840 g of dispersion beads (zirconia particles having a mean particle size of 0.5 mm), and dispersed in a dispersing machine (1/4G Sand Grinder Mill, manufactured by Imex) for 5 hours to obtain Color image forming material dispersion A having a mean particle size of 0.7 $\mu$m.

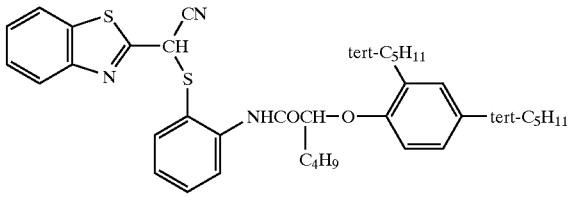

Color image forming material A

<Preparation of Color Image Forming Material Dispersions B–G>

In a similar manner, Color image forming material dispersions B–G were prepared by using Color image forming materials B–G instead of Color image forming material A.

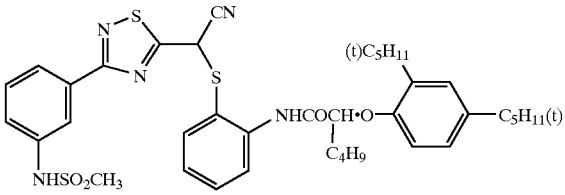

Color image forming material B

-continued

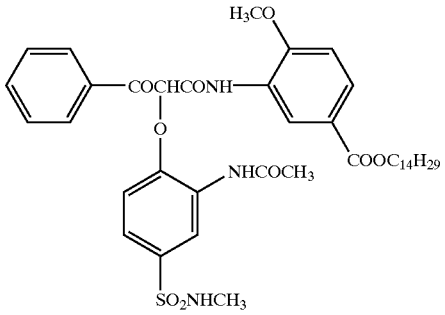

Color image forming material C

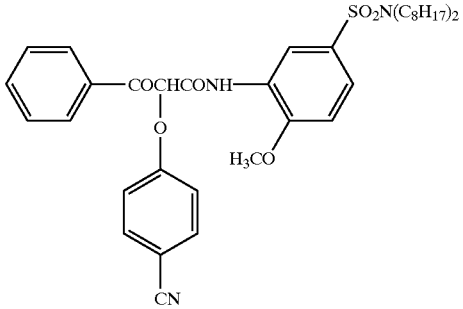

Color image forming material D

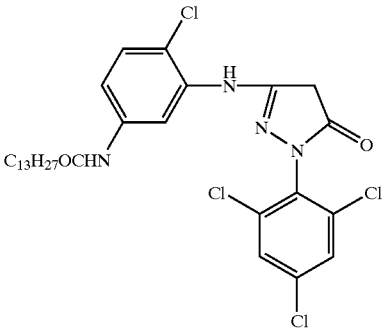

Color image forming material E

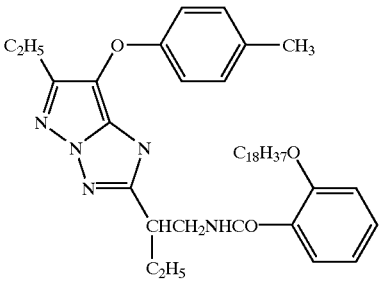

Color image forming material F

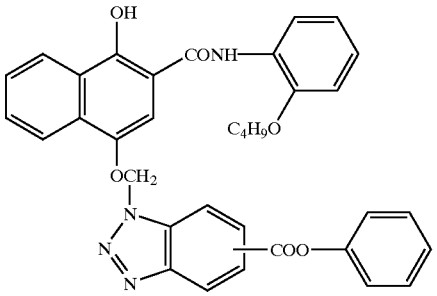

Color image forming material G

<Preparation of Ultrahigh Contrast Agent Dispersion A>

In an amount of 250 g of water was added to 10 g of Ultrahigh contrast agent A, 10 g of denatured polyvinyl alcohol (MP-203 produced by Kuraray Co., Ltd.) and 0.2 g of Leopol BX (trade name, Takemoto Oil & Fat Co., Ltd., sodium triisopropylnaphthalenesulfonate) and mixed sufficiently to form slurry. The slurry was introduced into a vessel together with 960 g of dispersion beads (zirconia particles having a mean particle size of 0.5 mm), and dispersed in a dispersing machine (1/4G Sand Grinder Mill, manufactured by Imex) for 5 hours. The dispersion was diluted with 105 g and taken out to obtain Ultrahigh contrast agent dispersion A having a mean particle size of 0.2 $\mu$m.

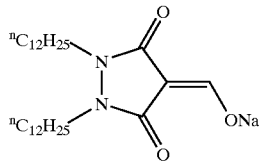

Ultrahigh contrast agent A

Example 1

On the side provided with Undercoat layers (a) and (b) of the aforementioned PET support having back and undercoat layers, the following image-recording layer and protective layer were coated simultaneously as stacked layers.

(Preparation and Coating of Image-recording Layer)

In an amount of 41 g of the aforementioned organic acid silver salt dispersion A, 9.3 g of Photosensitive silver halide emulsion A, 35.5 g of Reducing agent dispersion A, 13.2 g of Reducing agent dispersion B, 25.3 g of Color image forming material dispersion A, 2.1 g of Salicylic acid derivative dispersion A, 21 g of Lacstar #3307B (produced by Dainippon Ink & Chemicals, Inc., SBR latex, Tg: 13° C., 49 weight %), 4.9 g of 10 weight % solution of Kuraray Poval MP-203, 5.7 g of Solubilized phthalazine derivative solution A, 4.8 g of the organic polyhalogenated compound dispersion, 3 mg of 5-methylbenzotriazol, 2 mg of Dye A, 2.5 g of Ultrahigh contrast agent dispersion A and 25 g of water were combined and mixed sufficiently. The coating solution was coated so that the applied silver amount should become 1.0 g/m$^2$.

(Preparation and Coating of Protective Layer)

In an amount of 109 g of polymer latex containing 27.5% of solid content (copolymer of methyl methacrylate/styrene/2-ethylhexyl acrylate/2-hydroxyethyl methacrylate/methacrylic acid=59/9/26/5/1, glass transition temperature: 55° C.) was added with 3.75 g of $H_2O$, then added with 4.5 g of 2,2,4-trimethyl-1,3-pentanediol-mono(2-methylpropanate) as a film-forming aid, 0.45 g of Compound 2, 0.125 g of Compound 3, 0.0125 mole of Compound 4 and 2.25 g of polyvinyl alcohol (PVA-217 produced by Kuraray Co., Ltd.), and further added with $H_2O$ to an amount of 150 g to form a coating solution. The coating solution was coated on the photosensitive layer in such an amount that the amount of coated polymer latex should become 2.0 g/m$^2$.

Compound 2

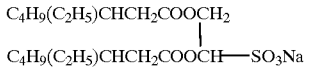

-continued

Compound 3

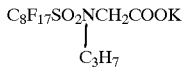

Compound 4

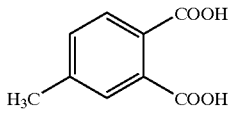

Dye A

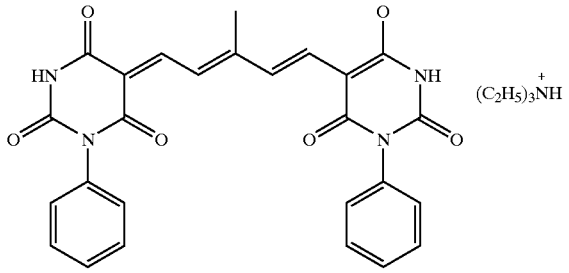

Two of the layers were simultaneously coated as stacked layers, and after coating, they were dried at 60° C. for 2 minutes. The obtained sample will be referred to as Sample 1.

(Preparation of Comparative Sample 1)

There was prepared a coating solution for image-recording layer identical to that for Sample 1 except that it did not contain Color image forming material A. and it was coated in various coating amounts. A protective layer was coated in the same manner as in Example 1. Sample numbers and coated silver amounts are as follows.

Comparative sample 1a: coated silver amount=1.0 g/m$^2$
Comparative sample 1b: coated silver amount=1.4 g/m$^2$
Comparative sample 1c: coated silver amount=1.4 g/m$^2$ (Formation of Dye Image by Heat Development)

Sample 1 according to the present invention, Comparative samples 1a, 1b and 1c were light-exposed by a xenon flash light of an emission time of $10^{-6}$ seconds through an interference filter having a peak at 780 nm and a step wedge having a density difference of 0.1, and subjected to heat development treatment at 117° C. for 10 seconds. As a result, black images were obtained. For the maximal blackening area and non-image area of each sample, density for visible region ($D_V$) and density for ultraviolet region ($D_{UV}$) were measured by a Macbeth densitometer (TD904). The results are shown in Table 1. Sample 1 according to the present invention showed good results, i.e., a high $D_{UV}$ for image areas as high as 4.80, and a low $D_{UV}$ for non-image areas as low as 0.19. On the other hand, the comparative samples showed unfavorable results, that is, $D_{UV}$ did not reach the level of Sample 1, even when the coated silver amount was increased up to 1.4 g/m$^2$, and $D_{UV}$ for non-image areas became higher than that of Sample 1.

Then, spectrophotometric absorption spectra of images were determined and analyzed. In the image areas of Sample 1, yellow dye images showing the absorption maximum at 425 nm were produced, and the absorbance of 425 nm increased by 2.1 compared with Comparative sample 1a.

TABLE 1

| | Coated silver amount ($g/m^2$) | Image area ($D_V$) | Image area ($D_{UV}$) | Non-image area ($D_V$) | Non-image area ($D_{UV}$) |
|---|---|---|---|---|---|
| Sample 1 | 1.0 | 3.25 | 4.80 | 0.07 | 0.19 |
| Comparative sample 1a | 1.0 | 3.00 | 2.35 | 0.07 | 0.17 |
| Comparative sample 1b | 1.2 | 3.49 | 2.74 | 0.09 | 0.20 |
| Comparative sample 1c | 1.4 | 4.19 | 3.29 | 0.12 | 0.25 |

(Evaluation of Mechanical Strength of Film)

Each sample light-exposed under white light was subjected to heat development at 117° C. for 10 seconds to form a developed blackened sample. A sapphire needle having a radius of 0.1 mm was pressed onto a surface of each sample, and moved at a velocity of 10 m/second while load of the needle was continuously changed. When the film was broken, the load was measured.

As a result, as shown in Table 2, it was found that the sample according to the present invention showed film strength higher than those of the comparative samples by twice or more. While the smaller coated silver amount constituted one of the factors providing the higher strength as seen from comparison of Comparative samples 1a and 1c, it is considered that the advantage of the sample of the present invention should be obtained due to other unexpected effects.

TABLE 2

| | |
|---|---|
| Sample 1 | 210 g |
| Comparative sample 1a | 147 g |
| Comparative sample 1b | 125 g |
| Comparative sample 1c | 100 g |

(Evaluation as Intermediate Material for Plate Making)

A PS plate was subjected to ultraviolet light exposure by using each of the aforementioned images obtained after the heat development as a masking film, which was adhered to the PS plate. That is, the PS plate was exposed imagewise by utilizing the impermeability of image areas for UV rays and transmission difference of the non-image areas. Then, the PS plate was developed under standard conditions to prepare a printing plate. The printing plate obtained from the sample according to the present invention showed good printability, i.e., higher printing durability and less scumming compared with the comparative samples.

Example 2

The process in Example 1 was repeated to form Samples 2–7 provided that 1.5% methanol solution of Ultrahigh contrast agent B having the following structure was used in place of 2.5 g of Ultrahigh contrast agent dispersion A, and that Reducing agent dispersions and Color image forming material dispersions shown in Table 3 were used in place of Reducing agent dispersion B and Color image forming material dispersion A, respectively. Samples 2–7 were evaluated in the same manner as shown in Example 1 and the results were shown in Table 4.

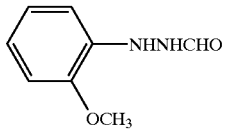

Ultrahigh contrast agent B

TABLE 3

| Sample No. | Reducing agent dispersion No. | Color image forming material dispersion No. | Image area ($D_V$) | Image area ($D_{UV}$) | Non-image area ($D_V$) | Non-image area ($D_{UV}$) |
|---|---|---|---|---|---|---|
| Sample 2 | B | B | 2.78 | 4.33 | 0.07 | 0.21 |
| Sample 3 | B | C | 3.03 | 4.17 | 0.07 | 0.21 |
| Sample 4 | B | D | 3.10 | 3.95 | 0.07 | 0.20 |
| Sample 5 | D | A | 2.92 | 4.65 | 0.07 | 0.22 |
| Sample 6 | C | E | 3.18 | 4.25 | 0.09 | 0.23 |
| Sample 7 | C | F | 3.15 | 4.30 | 0.09 | 0.23 |

The results shown in Table 4 indicate that Samples 2–7 attain high density for ultraviolet region and desirable properties as an intermediate material for plate making.

Mechanical strength of film in Samples 2–7 was evaluated in the same manner as shown in Example 1. Samples 2–7 had such a high strength of film as Sample 1.

What is claimed is:

1. A method for thermally forming images for plate making, which comprises forming an image for plate making by utilizing a thermally processed image recording material comprising a silver salt of an organic acid, a reducing agent, a color image forming material, an ultrahigh contrast agent and an organic binder on a support, wherein the image consists essentially of a developed silver image and a color forming dye image, and the color forming dye image shows an absorbance for ultraviolet region higher than that for visible region and has a transmission density of 0.3 or more for the region of 360–450 nm.

2. The method for thermally forming images for plate making according to claim 1, wherein the organic binder is a hydrophobic thermoplastic organic polymer.

3. The method for thermally forming images for plate making according to claim 1, wherein the organic binder consists of polymer latex dispersed in water.

4. The method for thermally forming images for plate making according to claim 1, wherein the reducing agent consists of microparticles solid-dispersed in water.

5. The method for thermally forming images for plate making according to claim 1, wherein the reducing agent consists of a compound represented by the formula $Q^1$—NHNH—$Q^2$ wherein $Q^1$ represents an aromatic group or 5- to 7-membered unsaturated ring bonding to —NHNH—$Q^2$ at a carbon atom, and $Q^2$ represents a carbamoyl group, an acyl group, an alkoxycarbonyl group, an aryloxycarbonyl group, a sulfonyl group or a sulfamoyl group.

6. The method for thermally forming images for plate making according to claim 1, wherein the thermally processed image recording material contains a halogen precursor.

7. The method for thermally forming images for plate making according to claim 6, wherein the halogen precursor consists of microparticles solid-dispersed in water.

8. The method for thermally forming images for plate making according to claim 1, wherein the color image forming material is a compound represented by any one of the following formulas (1) to (18):

(1)

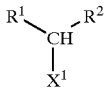

(2)

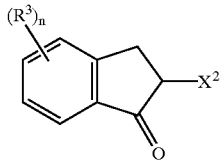

(3)

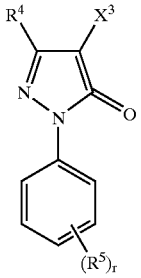

(4)

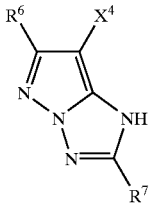

(5)

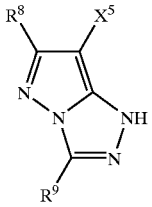

-continued (6)

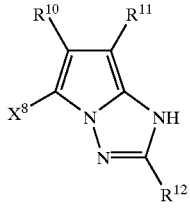

(7)

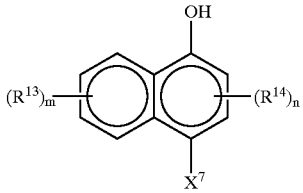

(8)

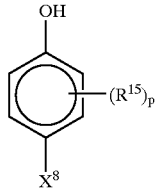

(9)

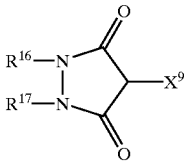

(10)

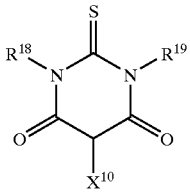

(11)

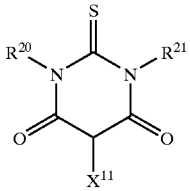

(12)

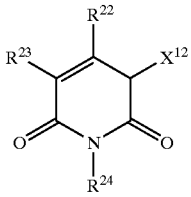

(13)

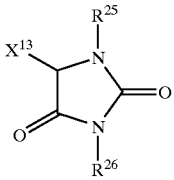

-continued (14)

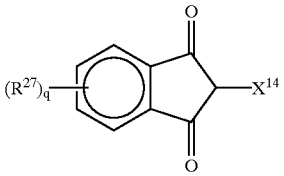

(15)

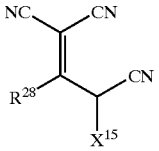

(16)

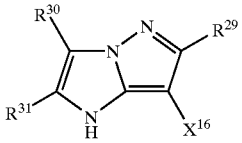

(17)

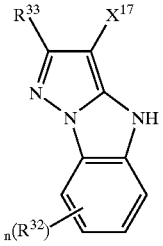

(18)

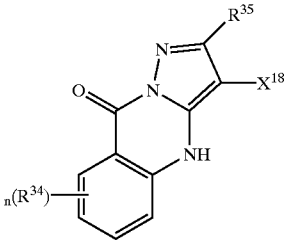

wherein, in the formulas (1) to (18) $X^1$ to $X^{18}$ each independently represents a hydrogen atom or a substituent; in the formula (1) $R^1$ and $R^2$ each independently represent an electron withdrawing redgroup; in the formulas (2) to (18), $R^3$ to $R^{35}$ each independently represent a hydrogen atom or a substituent, m, n, p and q each independently represent an integer of 0–4; and r represents an integer of 0–5.

9. The method for thermally forming images for plate making according to claim 1, wherein the color image forming material is in the form of solid-dispersed microparticles.

10. The method for thermally forming images for plate making according to claim 1, wherein the color image forming material is a two equivalent coupler.

11. A thermally processed image recording material for plate making comprising a silver salt of an organic acid, a reducing agent, a color image forming material, an ultrahigh contrast agent and an organic binder on a support, which forms an image consisting of a developed silver image and a color forming dye image, and in which the color forming dye image shows an absorbance for ultraviolet region higher than that for visible region and has a transmission density of 0.3 or more for the region of 360–450 nm.

12. The thermally processed image recording material for plate making according to claim 11, wherein the organic binder is a hydrophobic thermoplastic organic polymer.

13. The thermally processed image recording material for plate making according to claim 11, wherein the organic binder consists of polymer latex dispersed in water.

14. The thermally processed image recording material for plate making according to claim 11, wherein the reducing agent consists of microparticles solid-dispersed in water.

15. The thermally processed image recording material for plate making according to claim 11, wherein the reducing agent consists of a compound represented by the formula $Q^1$—NHNH—$Q^2$ wherein $Q^1$ represents an aromatic group or 5- to 7-membered unsaturated ring bonding to —NHNH—$Q^2$ at a carbon atom, and $Q^2$ represents a carbamoyl group, an acyl group, an alkoxycarbonyl group, an aryloxycarbonyl group, a sulfonyl group or a sulfamoyl group.

16. The thermally processed image recording material for plate making according to claim 11, wherein the color image forming material is a compound represented by any one of the following formulas (1) to (18):

(1)

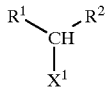

(2)

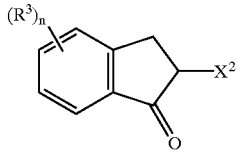

(3)

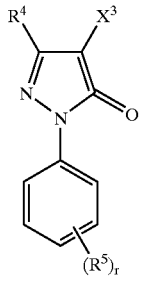

(4)

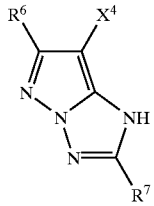

(5)

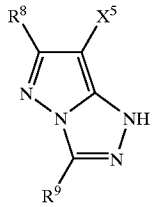

-continued (6)

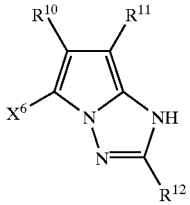

(7)

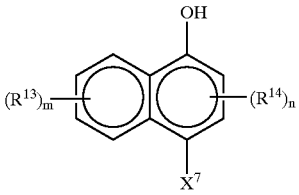

(8)

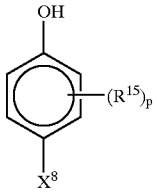

(9)

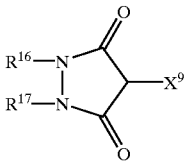

(10)

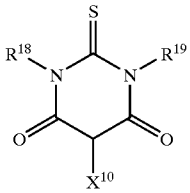

(11)

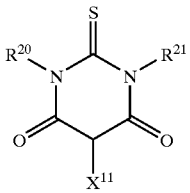

(12)

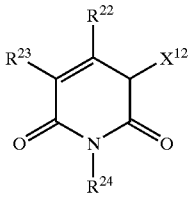

-continued (13)

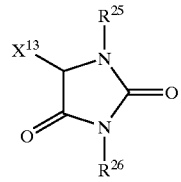

(14)

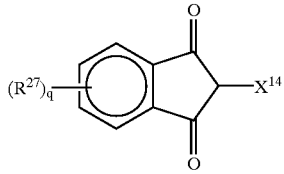

(15)

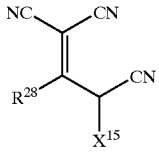

(16)

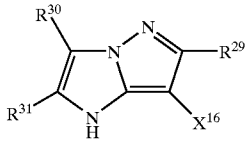

(17)

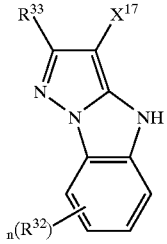

(18)

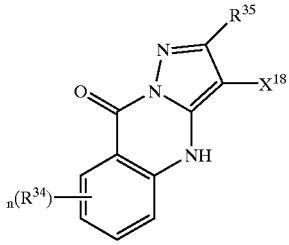

wherein, in the formulas (1) to (18), $X^1$ to $X^{18}$ each independently represents a hydrogen atom or a substituent; in the formula (1), $R^1$ and $R^2$ each independently represent an electron withdrawing group; in the formulas (2) to (18), $R^3$ to $R^{35}$ each independently represent a hydrogen atom or a substituent, m, n, p and q each independently represent an integer of 0–4; and r represents an integer of 0–5.

* * * * *